US011483646B1

(12) United States Patent
Pan et al.

(10) Patent No.: US 11,483,646 B1
(45) Date of Patent: Oct. 25, 2022

(54) BEAMFORMING USING FILTER COEFFICIENTS CORRESPONDING TO VIRTUAL MICROPHONES

(71) Applicant: Amazon Technologies, Inc., Seattle, WA (US)

(72) Inventors: Guangdong Pan, Quincy, MA (US); Philip Ryan Hilmes, Sunnyvale, CA (US); Robert Ayrapetian, Morgan Hill, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/995,994

(22) Filed: Jun. 1, 2018

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2410/05* (2013.01); *H04R 2430/23* (2013.01)

(58) Field of Classification Search
CPC .... H04R 1/406; H04R 3/005; H04R 2430/23; H04R 2410/05
See application file for complete search history.

(56) References Cited

U.S. PATENT DOCUMENTS

2006/0239471 A1* 10/2006 Mao ..... H04R 1/406 381/92
2017/0347217 A1* 11/2017 McGibney ..... H04S 7/303
2019/0364359 A1* 11/2019 Ferguson ..... G10L 21/0232

* cited by examiner

*Primary Examiner* — Ping Lee
(74) *Attorney, Agent, or Firm* — Pierce Atwood LLP

(57) ABSTRACT

Techniques for improving beamforming using filter coefficient values corresponding to virtual microphones are described. A system may define "virtual" microphone positions and determine corresponding filter coefficient values. These filter coefficient values may be applied to input audio data captured by actual physical microphones, enabling the system to improve performance of beamforming and/or to reduce a number of physical microphones without degrading performance. Offline testing and simulations may be performed to identify the best combination of virtual microphones and/or filter coefficient values for a particular look-direction. For example, the simulations may identify that a first filter coefficient corresponding to a first virtual microphone and a first direction will be associated with a first physical microphone and the first direction. During run-time processing, a device may generate beamformed audio data for the first direction by applying the first filter coefficient to input audio data captured by the first physical microphone.

20 Claims, 30 Drawing Sheets

FIG. 18A

Filter Coefficient Table
1810

| Position | Coordinates | Beam Direction | Filter Coefficient | Physical Microphone Present? |
|---|---|---|---|---|
| 1 | (0, 0) | 0 degrees | $W_1$ | Yes |
| 1 | (0, 0) | 90 degrees | $W_2$ | Yes |
| 1 | (0, 0) | 180 degrees | $W_3$ | Yes |
| 1 | (0, 0) | 270 degrees | $W_4$ | Yes |
| 2 | (1, 1) | 0 degrees | $W_5$ | No |
| 2 | (1, 1) | 90 degrees | $W_6$ | No |
| 2 | (1, 1) | 180 degrees | $W_7$ | No |
| 2 | (1, 1) | 270 degrees | $W_8$ | No |
| ... | ... | ... | ... | ... |
| *n* | (x, y) | *d* degrees | $W_n$ | <Y/N> |

FIG. 18B

Filter Coefficient Table
1820

| Beam Direction | Physical Microphone | Filter Coefficient | Virtual Microphone |
|---|---|---|---|
| 0 degrees | ($PMic_1$, $PMic_2$) | ($W_1$, $W_2$) | ($VMic_1$, $VMic_2$) |
| 30 degrees | ($PMic_1$, $PMic_2$) | ($W_3$, $W_4$) | ($VMic_3$, $VMic_4$) |
| 60 degrees | ($PMic_1$, $PMic_2$) | ($W_5$, $W_6$) | ($VMic_5$, $VMic_6$) |
| 90 degrees | ($PMic_1$, $PMic_2$) | ($W_7$, $W_8$) | ($VMic_7$, $VMic_8$) |
| 120 degrees | ($PMic_1$, $PMic_2$) | ($W_9$, $W_{10}$) | ($VMic_9$, $VMic_{10}$) |
| 150 degrees | ($PMic_1$, $PMic_2$) | ($W_{11}$, $W_{12}$) | ($VMic_{11}$, $VMic_{12}$) |
| 180 degrees | ($PMic_1$, $PMic_2$) | ($W_{13}$, $W_{14}$) | ($VMic_{13}$, $VMic_{14}$) |
| 210 degrees | ($PMic_1$, $PMic_2$) | ($W_{15}$, $W_{16}$) | ($VMic_{15}$, $VMic_{16}$) |
| ... | ... | ... | ... |
| 330 degrees | ($PMic_1$, $PMic_2$) | ($W_a$, $W_b$) | ($VMic_c$, $VMic_d$) |

Fixed Physical Microphones

FIG. 18C

Filter Coefficient Table
1830

| Beam Direction | Physical Microphone | Filter Coefficient | Virtual Microphone |
|---|---|---|---|
| 0 degrees | ($PMic_1$, $PMic_2$) | ($W_1$, $W_2$) | ($VMic_1$, $VMic_2$) |
| 30 degrees | ($PMic_1$, $PMic_2$) | ($W_3$, $W_4$) | ($VMic_3$, $VMic_4$) |
| 60 degrees | ($PMic_1$, $PMic_3$) | ($W_5$, $W_6$) | ($VMic_5$, $VMic_6$) |
| 90 degrees | ($PMic_1$, $PMic_3$) | ($W_7$, $W_8$) | ($VMic_7$, $VMic_8$) |
| 120 degrees | ($PMic_1$, $PMic_4$) | ($W_9$, $W_{10}$) | ($VMic_9$, $VMic_{10}$) |
| 150 degrees | ($PMic_1$, $PMic_4$) | ($W_{11}$, $W_{12}$) | ($VMic_{11}$, $VMic_{12}$) |
| 180 degrees | ($PMic_1$, $PMic_2$) | ($W_{13}$, $W_{14}$) | ($VMic_{13}$, $VMic_{14}$) |
| 210 degrees | ($PMic_1$, $PMic_2$) | ($W_{15}$, $W_{16}$) | ($VMic_{15}$, $VMic_{16}$) |
| ... | ... | ... | ... |
| 330 degrees | ($PMic_e$, $PMic_f$) | ($W_a$, $W_b$) | ($VMic_c$, $VMic_d$) |

Variable Physical Microphones

FIG. 18D

Filter Coefficient Table
1840

| Beam Direction | Frequency Range | Physical Microphone | Filter Coefficient | Virtual Microphone |
|---|---|---|---|---|
| 0 degrees | 0 kHz - 3 kHz | ($PMic_1$, $PMic_2$) | ($W_1$, $W_2$) | ($VMic_1$, $VMic_2$) |
| 0 degrees | 3 kHz - 8 kHz | ($PMic_1$, $PMic_2$) | ($W_3$, $W_4$) | ($VMic_3$, $VMic_4$) |
| 0 degrees | 8 kHz - 20 kHz | ($PMic_1$, $PMic_2$) | ($W_5$, $W_6$) | ($VMic_5$, $VMic_6$) |
| 30 degrees | 0 kHz - 3 kHz | ($PMic_1$, $PMic_2$) | ($W_7$, $W_8$) | ($VMic_7$, $VMic_8$) |
| 30 degrees | 3 kHz - 8 kHz | ($PMic_1$, $PMic_2$) | ($W_9$, $W_{10}$) | ($VMic_9$, $VMic_{10}$) |
| 30 degrees | 8 kHz - 20 kHz | ($PMic_1$, $PMic_2$) | ($W_{11}$, $W_{12}$) | ($VMic_{11}$, $VMic_{12}$) |
| 60 degrees | 0 kHz - 3 kHz | ($PMic_1$, $PMic_2$) | ($W_{13}$, $W_{14}$) | ($VMic_{13}$, $VMic_{14}$) |
| 60 degrees | 3 kHz - 8 kHz | ($PMic_1$, $PMic_2$) | ($W_{15}$, $W_{16}$) | ($VMic_{15}$, $VMic_{16}$) |
| ... | ... | ... | ... | ... |
| 330 degrees | 8 kHz - 20 kHz | ($PMic_1$, $PMic_2$) | ($W_a$, $W_b$) | ($VMic_c$, $VMic_d$) |

↑
Frequency Dependent

BEAMFORMING USING FILTER COEFFICIENTS CORRESPONDING TO VIRTUAL MICROPHONES

BACKGROUND

In audio systems, beamforming refers to techniques that are used to isolate audio from a particular direction. Beamforming may be particularly useful when filtering out noise from non-desired directions. Beamforming may be used for various tasks, including isolating voice commands to be executed by a speech-processing system.

Speech recognition systems have progressed to the point where humans can interact with computing devices using speech. Such systems employ techniques to identify the words spoken by a human user based on the various qualities of a received audio input. Speech recognition combined with natural language understanding processing techniques enable speech-based user control of a computing device to perform tasks based on the user's spoken commands. The combination of speech recognition and natural language understanding processing techniques is commonly referred to as speech processing. Speech processing may also convert a user's speech into text data which may then be provided to various text-based software applications.

Speech processing may be used by computers, hand-held devices, telephone computer systems, kiosks, and a wide variety of other devices, such as those with beamforming capability, to improve human-computer interactions.

BRIEF DESCRIPTION OF DRAWINGS

For a more complete understanding of the present disclosure, reference is now made to the following description taken in conjunction with the accompanying drawings.

FIGS. 18A-18D illustrate examples of lookup tables for filter coefficient values according to embodiments of the present disclosure.

DETAILED DESCRIPTION

Certain devices capable of capturing speech for speech processing may operate using a microphone array comprising multiple microphones, where beamforming techniques may be used to isolate desired audio including speech. Beamforming systems isolate audio from a particular direction in a multi-directional audio capture system. One technique for beamforming involves boosting audio received from a desired direction while dampening audio received from a non-desired direction.

In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesirable audio), which is detectable in similar energies from various directions, but may be less effective in eliminating noise emanating from a single source in a particular non-desired direction. The beamformer unit may also incorporate an adaptive beamformer unit/noise canceller that can adaptively cancel noise from different directions depending on audio conditions.

To improve beamforming, systems and methods are disclosed that associate filter coefficient values corresponding to virtual microphones with physical microphones for individual directions of interest. For example, the system can select "virtual" microphone positions (e.g., positions where no physical microphone is present) and determine filter coefficient values corresponding to the virtual microphone positions. These filter coefficient values may be applied to input audio data captured by the actual physical microphones. This enables the system to improve performance of beamforming and/or to reduce a number of physical microphones without degrading performance, as the "virtual" filter coefficient values may correct for errors inherent in the "actual" filter coefficient values associated with the physical microphone. Offline testing and simulations may be performed to identify the best combination of virtual microphones and/or filter coefficient values for a particular look-direction (e.g., direction of interest). For example, the simulations may identify that a first filter coefficient corresponding to a first virtual microphone and a first direction will be associated with a first physical microphone and the first direction. During run-time processing, a device may generate beamformed audio data for the first direction by applying the first filter coefficient to input audio data captured by the first physical microphone. The virtual microphones and/or filter coefficient values may vary based on look-direction and/or frequency within a look-direction, and in some examples the device may select different physical microphones based on the look-direction.

Figure 1:
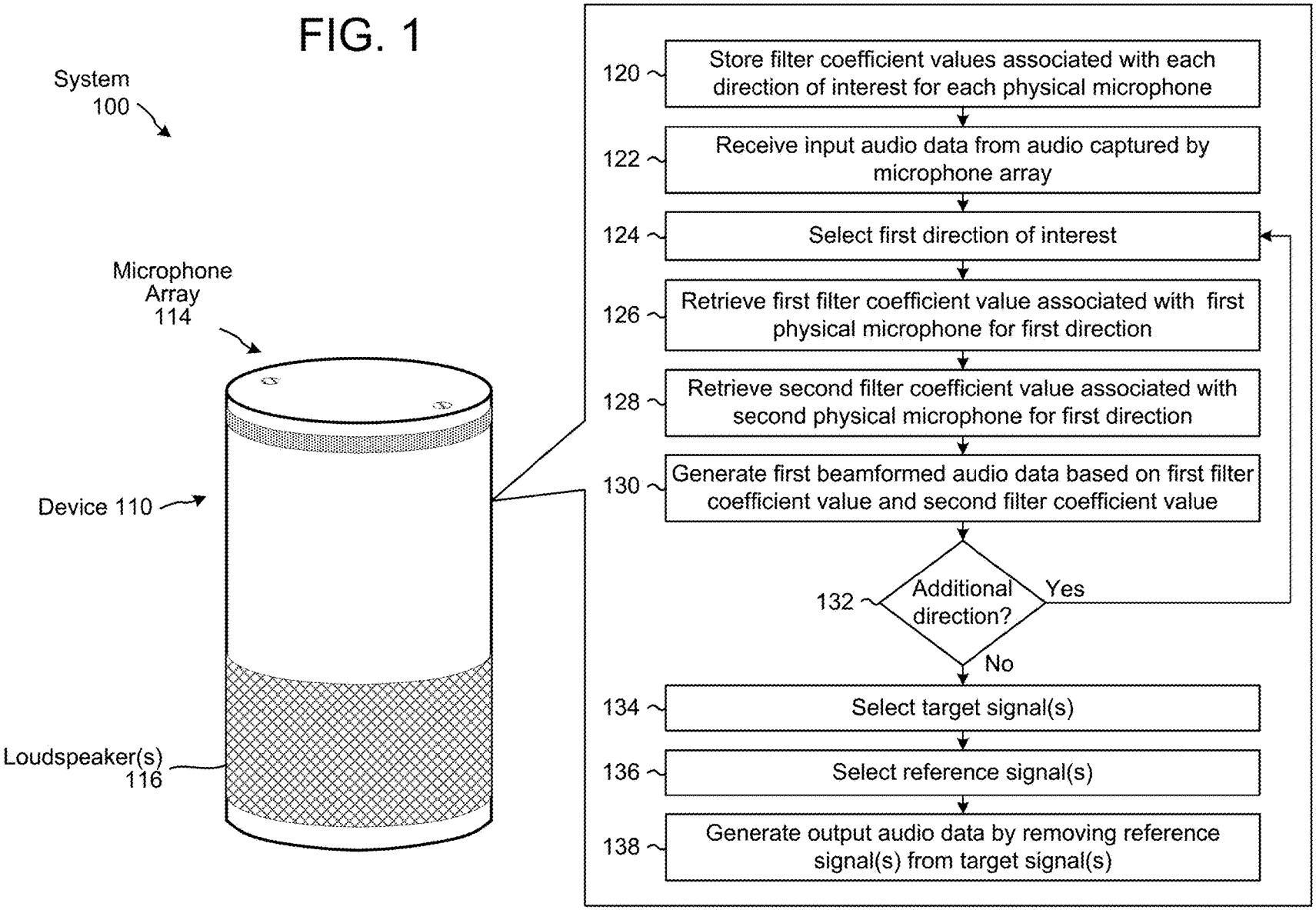
FIG. 1 illustrates a method for improving beam selection and reducing algorithm complexity according to embodiments of the present disclosure.

FIG. 1 illustrates a system 100 that includes a device 110 configured to capture input audio data and perform beamforming. As illustrated in FIG. 1, the device 110 may include a microphone array 114 and one or more loudspeaker(s) 116. However, the disclosure is not limited thereto and the device 110 may include additional components without departing from the disclosure.

The device 110 may receive playback audio data and may generate output audio corresponding to the playback audio data using the one or more loudspeaker(s) 116. While generating the output audio, the device 110 may capture input audio data using the microphone array 114. In addition to capturing desired speech (e.g., the input audio data includes a representation of speech from a first user), the device 110 may capture a portion of the output audio generated by the loudspeaker(s) 116, which may be referred to as an "echo" or echo signal, along with additional acoustic noise (e.g., undesired speech, ambient acoustic noise in an environment around the device 110, etc.).

Conventional systems isolate the speech in the input audio data by performing acoustic echo cancellation (AEC) to remove the echo signal from the input audio data. For example, conventional acoustic echo cancellation may generate a reference signal based on the playback audio data and may remove the reference signal from the input audio data to generate output audio data representing the speech.

As an alternative to generating the reference signal based on the playback audio data, Adaptive Reference Algorithm (ARA) processing may generate an adaptive reference signal based on the input audio data. To illustrate an example, the ARA processing may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform AEC by removing (e.g., subtracting) the reference signal from the target signal. As the input audio data is not limited to the echo signal, the ARA processing may remove other acoustic noise represented in the input audio data in addition to removing the echo. Therefore, the ARA processing may be referred to as performing AEC, adaptive noise cancellation (ANC), and/or adaptive interference cancellation (AIC) (e.g., adaptive acoustic interference cancellation) without departing from the disclosure. As discussed in greater detail below, the device 110 may include an adaptive beamformer and may be configured to perform AEC/ANC/AIC using the ARA processing to isolate the speech in the input audio data.

In some examples, the system 100 may use virtual microphones to reduce a number of physical microphones included in the microphone array 114 without significantly degrading the beamformed audio data. Additionally or alternatively, the system 100 may use virtual microphones without reducing the number of physical microphones included in the microphone array 114 to improve the beamformed audio data. This improvement is at least in part because these "virtual" filter coefficient values correct for errors inherent in the "actual" filter coefficient values associated with the physical microphones. For example, the "actual" filter coefficient values (e.g., filter coefficient values determined based on an actual position of the physical microphone) are determined for a specific direction of interest, but due to limitations inherent in determining the filter coefficient values, the "actual" filter coefficient values may not precisely correspond to the direction of interest. Using virtual microphones, the system 100 may identify a "virtual" filter coefficient value (e.g., filter coefficient values determined based on a different position than the physical microphone) that corrects for the error inherent in the "actual" filter coefficient value. Thus, the virtual filter coefficient value improves beamforming as it more accurately corresponds to the direction of interest.

Typically, beamforming is done by determining filter coefficient values (e.g., Finite Impulse Response (FIR) filter coefficient values) for each beam direction (e.g., look direction, direction of interest, etc.) based on a position of physical microphones in the microphone array 114. For example, a first position of a first physical microphone may correspond to a first filter coefficient associated with a first direction and a second position of a second physical microphone may correspond to a second filter coefficient associated with the first direction. Thus, to generate beamformed audio data in the first direction, the beamformer may apply the first filter coefficient value to first audio data captured by the first physical microphone and apply the second filter coefficient value to second audio data captured by the second physical microphone.

To further improve beamforming, the system 100 may determine filter coefficient values (e.g., Finite Impulse Response (FIR) filter coefficient values) for a plurality of virtual microphones and perform simulations to select the best filter coefficient value for each physical microphone and each direction of interest. Whereas the physical microphones are at fixed positions on the device 110, the virtual microphones may correspond to any position on the device 110, including a position that doesn't correspond to a physical microphone. For example, the system 100 may determine a radius associated with two physical microphones, may determine a desired number of virtual microphones (e.g., 6, 8, 12, 16, 24, 36, etc.), and may determine positions of the virtual microphones in a circle based on radius and the desired number of virtual microphones.

After determining the positions of the virtual microphones, the system 100 may determine filter coefficient values associated with each direction of interest for each of the virtual microphones. The filter coefficient values may be determined using minimum variance distortionless response (MVDR) beamformer techniques, Linearly Constrained Minimum Variance (LCMV) beamformer techniques, and/or generalized eigenvalue (GEV) beamformer techniques, although the disclosure is not limited thereto and the filter coefficient values may be determined using any technique known to one of skill in the art without departing from the disclosure.

The system 100 may perform a plurality of simulations, applying filter coefficient values associated with each of the virtual microphones to each of the physical microphones, and may determine the best filter coefficient values for each direction of interest. For example, the system 100 may associate a first filter coefficient value corresponding to a first virtual microphone with a first physical microphone and a first direction of interest, but associate a second filter coefficient value corresponding to a fourth virtual microphone with the first physical microphone and a second direction of interest. Thus, the filter coefficient values may be selected based on the simulation results to improve the results of beamforming. In some examples, using the virtual microphones may increase the output audio data generated by beamforming by 6-12 decibels (dB) in the direction of a loudspeaker, although this is provided as an example and the disclosure is not limited thereto. The filter coefficient values are fixed and the device 110 may generate beamformed audio data using the same filter coefficient values over time.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array 114 (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

To perform the beamforming operation, the device 110 may apply directional calculations to the input audio signals. In some examples, the device 110 may perform the directional calculations by applying filters to the input audio signals using filter coefficient values associated with specific directions. For example, the device 110 may perform a first directional calculation by applying first filter coefficient values to the input audio signals to generate the first beamformed audio data and may perform a second directional calculation by applying second filter coefficient values to the input audio signals to generate the second beamformed audio data.

The filter coefficient values used to perform the beamforming operation may be calculated offline (e.g., preconfigured ahead of time) and stored in the device 110. For example, the device 110 may store filter coefficient values associated with hundreds of different directional calculations (e.g., hundreds of specific directions) and may select the desired filter coefficient values for a particular beamforming operation at runtime (e.g., during the beamforming operation). To illustrate an example, at a first time the device 110 may perform a first beamforming operation to divide input audio data into 36 different portions, with each portion associated with a specific direction (e.g., 10 degrees out of 360 degrees) relative to the device 110. At a second time, however, the device 110 may perform a second beamforming operation to divide input audio data into 6 different portions, with each portion associated with a specific direction (e.g., 60 degrees out of 360 degrees) relative to the device 110.

These directional calculations may sometimes be referred to as "beams" by one of skill in the art, with a first directional calculation (e.g., first filter coefficient values) being referred to as a "first beam" corresponding to the first direction, the second directional calculation (e.g., second filter coefficient values) being referred to as a "second beam" corresponding to the second direction, and so on. Thus, the device 110 stores hundreds of "beams" (e.g., directional calculations and associated filter coefficient values) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficient values used to generate the first beam.

After beamforming, the device 110 may optionally perform adaptive interference cancellation using the ARA processing on the beamformed audio data. For example, after generating the plurality of audio signals (e.g., beamformed audio data) as described above, the device 110 may determine one or more target signal(s), determine one or more reference signal(s), and generate output audio data by subtracting at least a portion of the reference signal(s) from the target signal(s).

The device 110 may dynamically select target signal(s) and/or reference signal(s). Thus, the target signal(s) and/or the reference signal(s) may be continually changing over time based on speech, acoustic noise(s), ambient noise(s), and/or the like in an environment around the device 110. For example, the adaptive beamformer may select the target signal(s) by detecting speech, based on signal strength values (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the device 110 may identify the reference signal(s) based on the signal strength values and/or using other inputs without departing from the disclosure. Thus, the target signal(s) and/or the reference signal(s) selected by the device 110 may vary, resulting in different filter coefficient values over time.

As illustrated in FIG. 1, the device 110 may store (120) filter coefficient values associated with each direction of interest for each physical microphone. As mentioned above and described in greater detail below, the system 100 may perform a number of simulations using filter coefficient values associated with a plurality of virtual microphones and may determine filter coefficient values associated with the best results (e.g., highest power values) for each direction of interest. Thus, the device 110 may store these filter coefficient values in a lookup table, association table, database, and/or the like for run-time processing (e.g., to retrieve filter coefficient values during beamforming).

The device 110 may receive (122) input audio data corresponding to audio captured by the microphone array 114. For example, the device 110 may receive first audio data corresponding to a first physical microphone and may receive second audio data corresponding to a second physical microphone (e.g., input audio data corresponds to both the first audio data and the second audio data).

The device 110 may select (124) a first direction of interest, may retrieve (126) a first filter coefficient value associated with the first physical microphone for the first direction of interest, may retrieve (128) a second filter coefficient value associated with the second physical microphone for the first direction of interest, and may generate (130) first beamformed audio data based on the first filter coefficient value and the second filter coefficient value. For example, the device 110 may generate a first product of the first filter coefficient value and the first audio data, generate a second product of the second filter coefficient value and the second audio data, and generate the first beamformed audio data by summing the first product and the second product.

The device 110 may determine (132) whether there is an additional direction of interest, and if so, may loop to step 124 and perform steps 124-130 for the additional direction of interest. Once the device 110 has generated beamformed audio data for each direction of interest, the device 110 may select (134) target signal(s), select (136) reference signal(s), and generate (138) output audio data by removing (e.g., subtracting) the reference signal(s) from the target signal(s), as discussed in greater detail about with regard to the ARA algorithm. For example, the device 110 may select first beamformed audio data as the target signal, may select second beamformed audio data as the reference signal, and may generate the output audio data by subtracting at least a portion of the second beamformed audio data from the first beamformed audio data. While FIG. 1 illustrates the device 110 selecting a single target signal and a single reference signal, the disclosure is not limited thereto and the device 110 may determine one or more target signal(s) and/or one or more reference signal(s) without departing from the disclosure.

Further details of the device operation are described below following a discussion of directionality in reference to FIGS. 2-3C.

Figure 2:
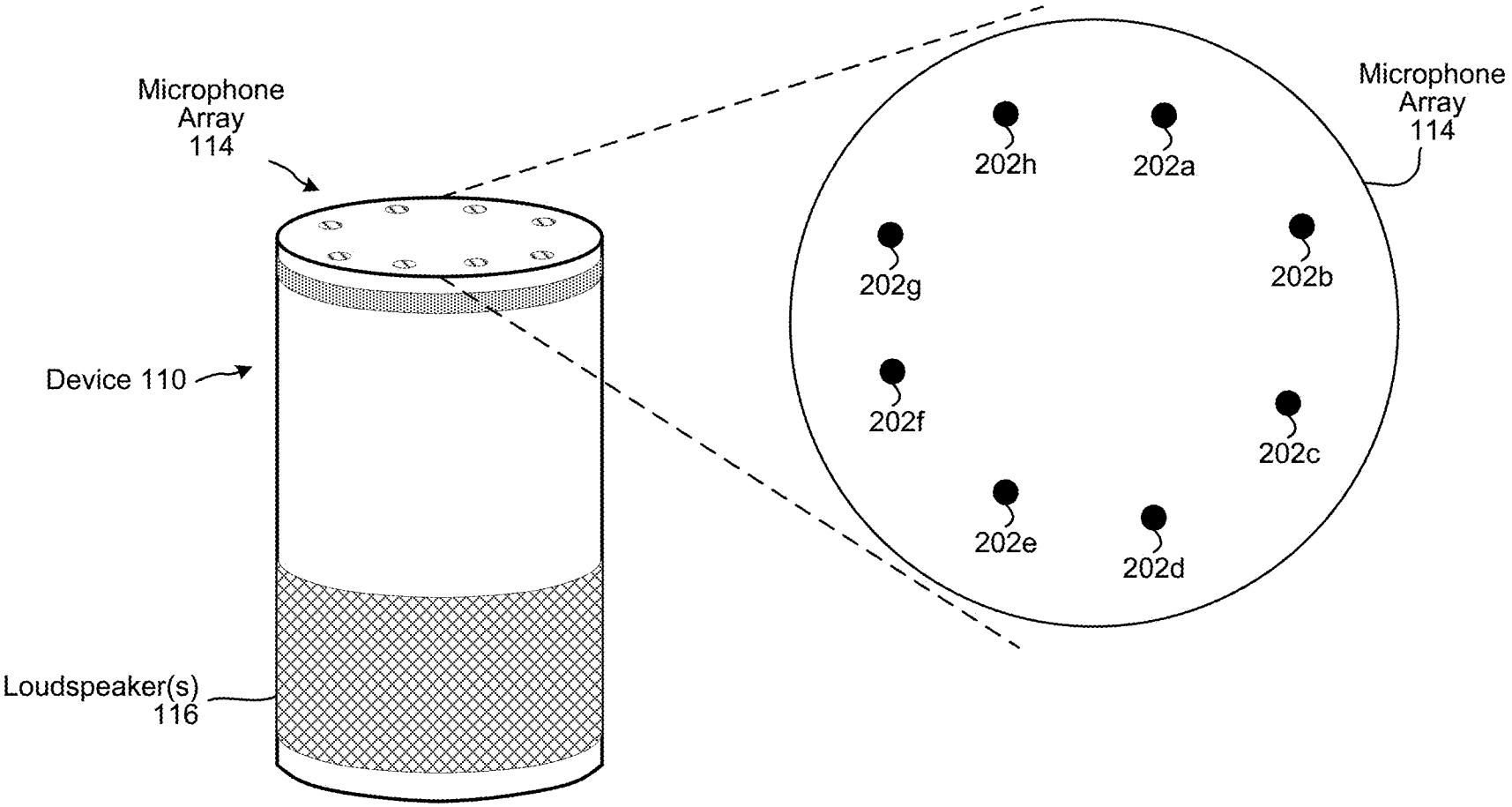
FIG. 2 illustrates a microphone array according to embodiments of the present disclosure.

As illustrated in FIG. 2, a device 110 may include, among other components, a microphone array 114, one or more loudspeaker(s) 116, a beamformer unit (as discussed below), or other components. The microphone array may include a number of different individual microphones. In the example configuration of FIG. 2, the microphone array 114 includes eight (8) microphones, 502*a*-502*h*. The individual microphones may capture sound and pass the resulting audio signal created by the sound to a downstream component, such as an analysis filterbank discussed below. Each individual piece of audio data captured by a microphone may be in a time domain. To isolate audio from a particular direction, the device may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the device may determine that the source of the audio that resulted in the segment of audio data may be located closer to the first microphone than to the second microphone (which resulted in the audio being detected by the first microphone before being detected by the second microphone).

Figure 3A:
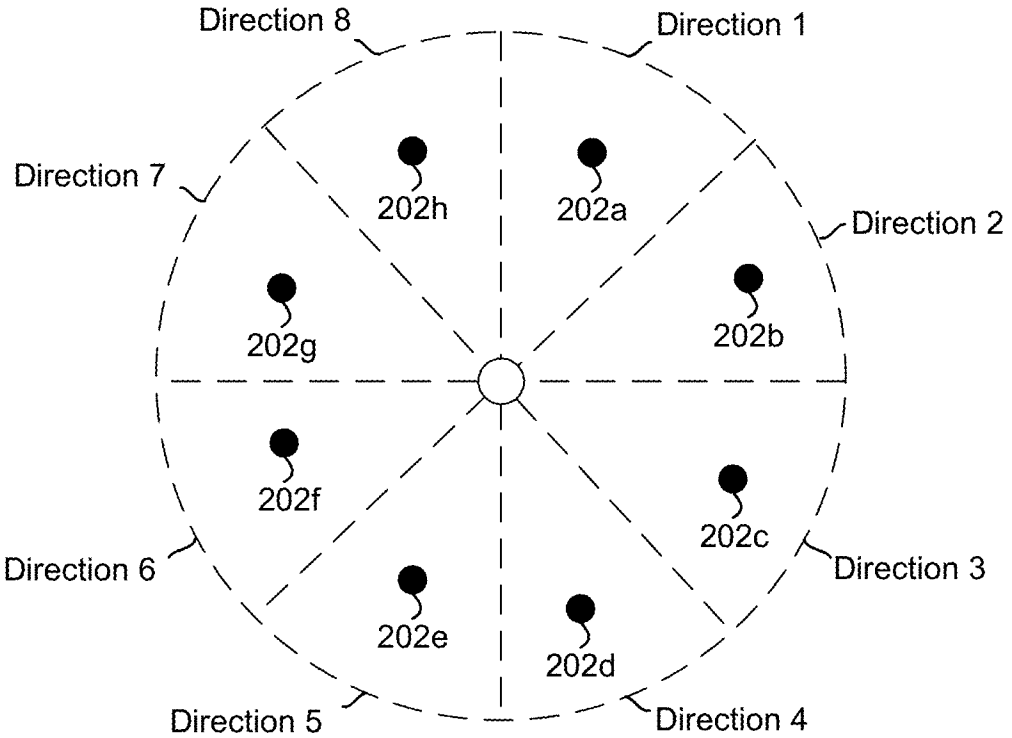
FIG. 3A illustrates associating directions with microphones of a microphone array according to embodiments of the present disclosure.
Figure 3B:
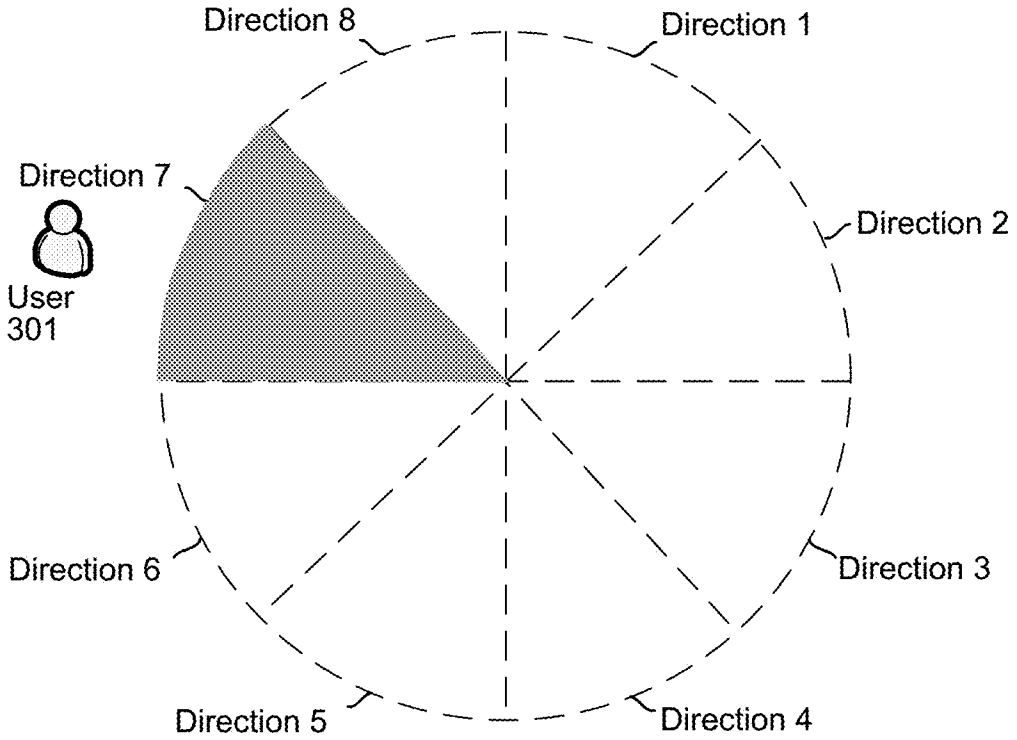
FIGS. 3B and 3C illustrate isolating audio from a direction to focus on a desired audio source according to embodiments of the present disclosure.
Figure 3C:
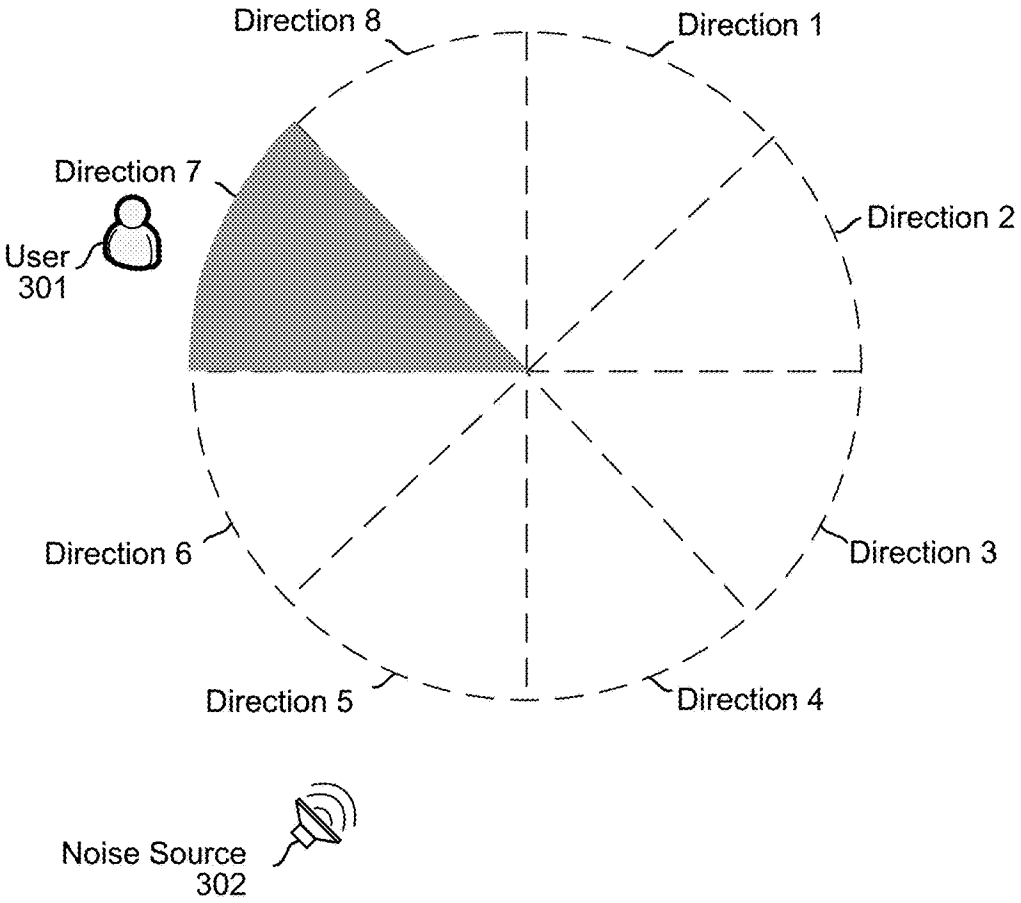

Using such direction isolation techniques, a device 110 may isolate directionality of audio sources. As shown in FIG. 3A, a particular direction may be associated with a particular microphone of a microphone array, where the azimuth angles for the plane of the microphone array may be divided into bins (e.g., 0-45 degrees, 46-90 degrees, and so forth) where each bin direction is associated with a microphone in the microphone array. For example, direction 1 is associated with microphone 502*a*, direction 2 is associated with microphone 502*b*, and so on. Alternatively, particular directions and/or beams may not necessarily be associated with a specific microphone without departing from the present disclosure.

To isolate audio from a particular direction the device may apply a variety of audio filters to the output of the microphones where certain audio is boosted while other audio is dampened, to create isolated audio corresponding to a particular direction, which may be referred to as a beam. While the number of beams may correspond to the number of microphones, this need not be the case. For example, a two-microphone array may be processed to obtain more than two beams, thus using filters and beamforming techniques to isolate audio from more than two directions. Thus, the number of microphones may be more than, less than, or the same as the number of beams. The beamformer unit of the device may have an adaptive beamformer (ABF) unit/fixed beamformer (FBF) unit processing pipeline for each beam, as explained below.

The device may use various techniques to determine the beam corresponding to the look-direction. If audio is detected first by a particular microphone the device 110 may determine that the source of the audio is associated with the direction of the microphone in the array. Other techniques may include determining what microphone detected the audio with a largest amplitude (which in turn may result in a highest strength of the audio signal portion corresponding to the audio). Other techniques (either in the time domain or in the sub-band domain) may also be used such as calculating a signal-to-noise ratio (SNR) for each beam, performing voice activity detection (VAD) on each beam, or the like.

For example, if audio data corresponding to a user's speech is first detected and/or is most strongly detected by microphone 502*g*, the device may determine that the user is located in a location in direction 7. Using a FBF unit or other such component, the device may isolate audio coming from direction 7 using techniques known to the art and/or explained herein. Thus, as shown in FIG. 4B, the device 110 may boost audio coming from direction 7, thus increasing the amplitude of audio data corresponding to speech from user 301 relative to other audio captured from other directions. In this manner, noise from diffuse sources that is coming from all the other directions will be dampened relative to the desired audio (e.g., speech from user 301) coming from direction 7.

One drawback to the FBF unit approach is that it may not function as well in dampening/canceling noise from a noise source that is not diffuse, but rather coherent and focused from a particular direction. For example, as shown in FIG. 3C, a noise source 302 may be coming from direction 5 but may be sufficiently loud that noise canceling/beamforming techniques using an FBF unit alone may not be sufficient to remove all the undesired audio coming from the noise source 302, thus resulting in an ultimate output audio signal determined by the device 110 that includes some representation of the desired audio resulting from user 301 but also some representation of the undesired audio resulting from noise source 302.

Figure 4:
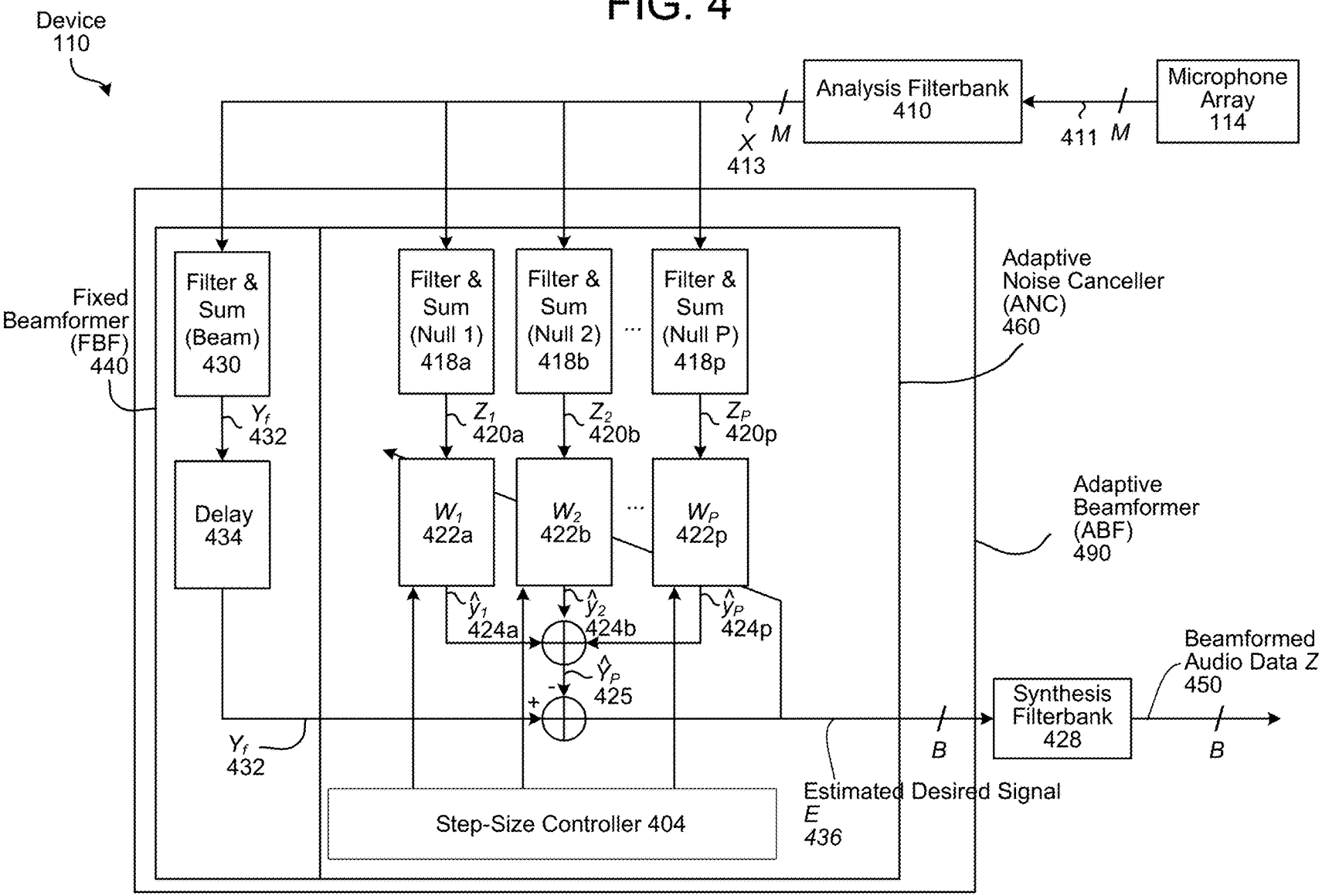
FIG. 4 illustrates a beamforming device that combines a fixed beamformer unit and an adaptive beamformer unit according to embodiments of the present disclosure.

FIG. 4 illustrates a high-level conceptual block diagram of a device 110 configured to performing beamforming using a fixed beamformer unit and an adaptive noise canceller that can remove noise from particular directions using adaptively controlled coefficients which can adjust how much noise is cancelled from particular directions. The FBF unit 440 may be a separate component or may be included in another component such as an adaptive beamformer (ABF) unit 490. As explained below, the FBF unit may operate a filter and sum component 430 to isolate the first audio signal from the direction of an audio source.

The device 110 may also operate an adaptive noise canceller (ANC) unit 460 to amplify audio signals from directions other than the direction of an audio source. Those audio signals represent noise signals so the resulting amplified audio signals from the ABF unit may be referred to as noise reference signals 420, discussed further below. The device 110 may then weight the noise reference signals, for example using filters 422 discussed below. The device may combine the weighted noise reference signals 424 into a combined (weighted) noise reference signal 425. Alternatively the device may not weight the noise reference signals and may simply combine them into the combined noise reference signal 425 without weighting. The device may then subtract the combined noise reference signal 425 from the amplified first audio signal 432 to obtain a difference 436. The device may then output that difference, which represents the desired output audio signal with the noise removed. The diffuse noise is removed by the FBF unit when determining the signal 432 and the directional noise is removed when the combined noise reference signal 425 is subtracted. The device may also use the difference to create updated weights (for example for filters 422) to create updated weights that may be used to weight future audio signals. The step-size controller 404 may be used modulate the rate of adaptation from one weight to an updated weight.

In this manner noise reference signals are used to adaptively estimate the noise contained in the output signal of the FBF unit using the noise-estimation filters 422. This noise estimate is then subtracted from the FBF unit output signal to obtain the final ABF unit output signal. The ABF unit output signal is also used to adaptively update the coefficients of the noise-estimation filters. Lastly, we make use of a robust step-size controller to control the rate of adaptation of the noise estimation filters.

As shown in FIG. 4, input audio data 411 captured by a microphone array may be input into an analysis filterbank 410. The filterbank 410 may include a uniform discrete Fourier transform (DFT) filterbank which converts input audio data 411 in the time domain into an microphone outputs 800 in the sub-band domain. The audio signal X may incorporate audio signals corresponding to multiple different microphones as well as different sub-bands (i.e., frequency ranges) as well as different frame indices (i.e., time ranges). Thus the audio signal from the mth microphone may be represented as $X_m(k,n)$, where k denotes the sub-band index and n denotes the frame index. The combination of all audio signals for all microphones for a particular sub-band index frame index may be represented as X(k,n).

Figure 5:
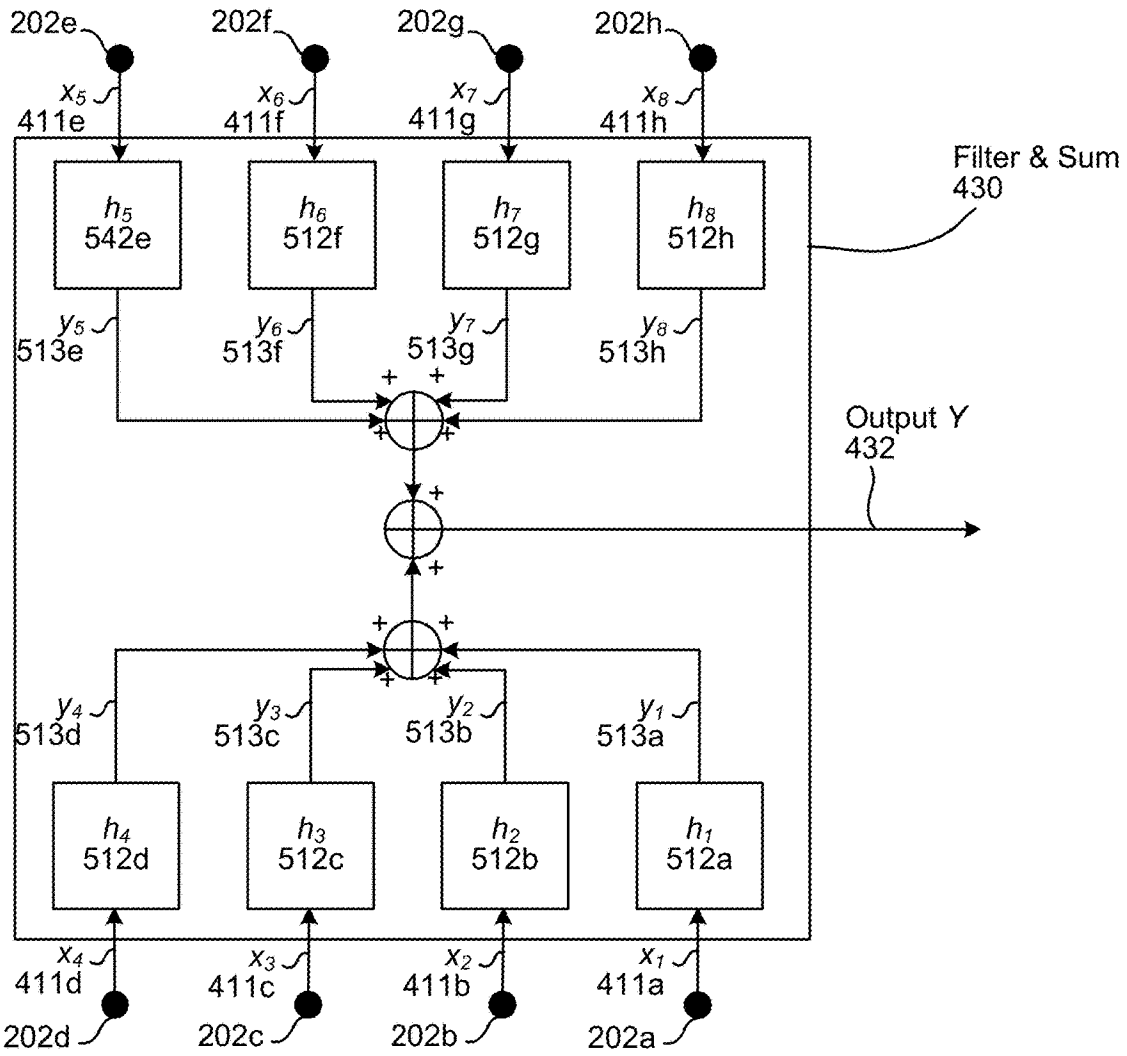
FIG. 5 illustrates a filter and sum component according to embodiments of the present disclosure.

The microphone outputs 800 may be passed to the FBF unit 440 including the filter and sum unit 430. The FBF unit 440 may be implemented as a robust super-directive beamformer unit, delayed sum beamformer unit, or the like. The FBF unit 440 is presently illustrated as a super-directive beamformer (SDBF) unit due to its improved directivity properties. The filter and sum unit 430 takes the audio signals from each of the microphones and boosts the audio signal from the microphone associated with the desired look direction and attenuates signals arriving from other microphones/directions. The filter and sum unit 430 may operate as illustrated in FIG. 5. As shown in FIG. 5, the filter and sum unit 430 may be configured to match the number of microphones of the microphone array. For example, for a microphone array with eight microphones, the filter and sum unit may have eight filter blocks 512. The input audio signals $x_1$ 411*a* through $x_8$ 411*h* for each microphone (e.g., microphones 1 through 8) are received by the filter and sum unit 430. The audio signals $x_1$ 411*a* through $x_8$ 411*h* correspond to individual microphones 502*a* through 502*h*, for example audio signal $x_1$ 411*a* corresponds to microphone 502*a*, audio signal $x_2$ 411*b* corresponds to microphone 502*b* and so forth. Although shown as originating at the microphones, the audio signals $x_1$ 411*a* through $x_8$ 411*h* may be in the sub-band domain and thus may actually be output by the analysis filterbank before arriving at the filter and sum component 430. Each filter block 512 is also associated with a particular microphone. Each filter block is configured to either boost (e.g., increase) or dampen (e.g., decrease) its respective incoming audio signal by the respective beamformer filter coefficient h depending on the configuration of the FBF unit. Each resulting filtered audio signal y 513 will be the audio signal x 411 weighted by the beamformer filter coefficient h of the filter block 512. For example, $y_1=x_1*h_1$, $y_2=x_2*h_2$, and so forth. The filter coefficient values are configured for a particular FBF unit associated with a particular beam.

Figure 6:
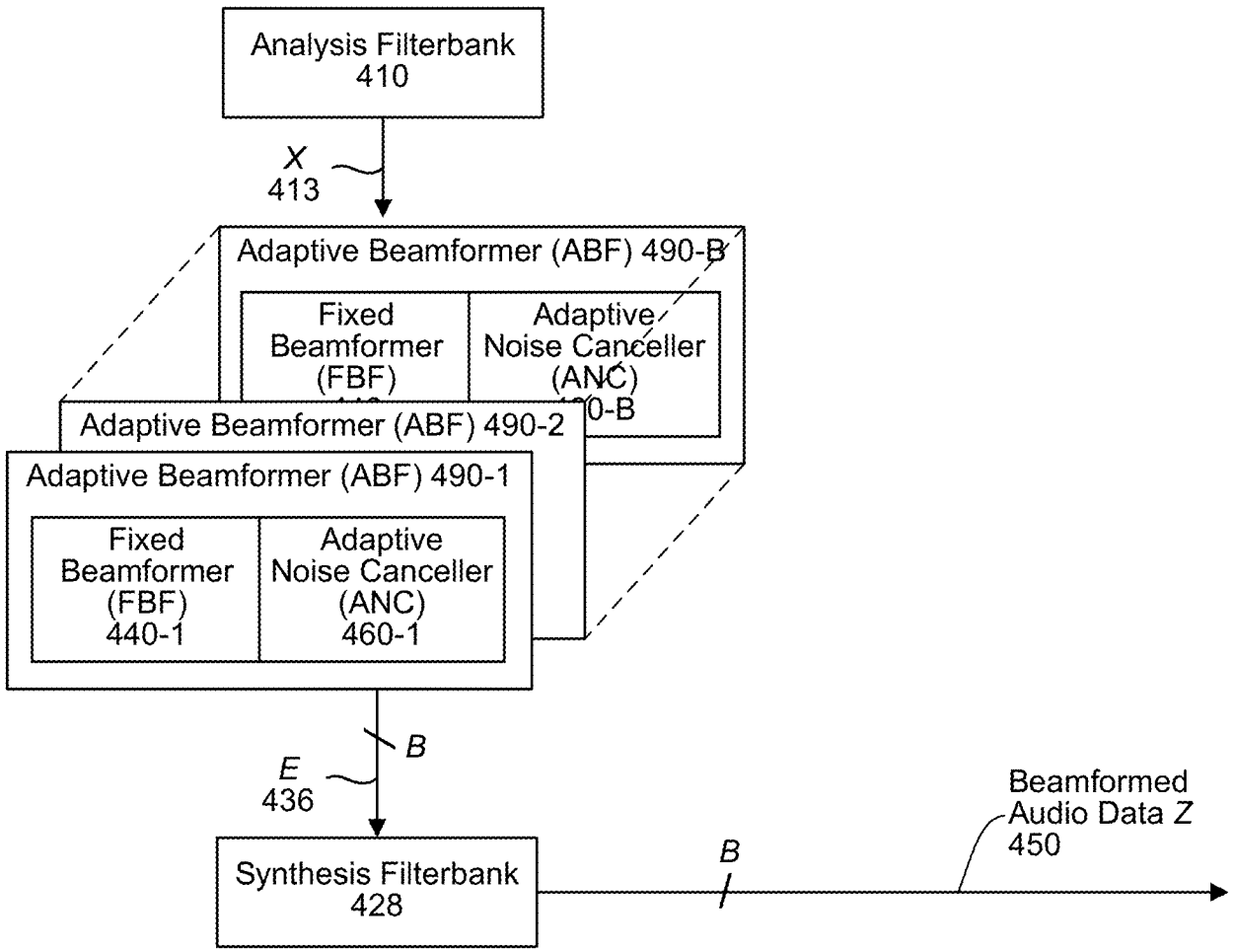
FIG. 6 illustrates a multiple FBF/ABF beamformer unit configuration for each beam according to embodiments of the present disclosure.

As illustrated in FIG. 6, the adaptive beamformer (ABF) unit 490 configuration (including the FBF unit 440 and the ANC unit 460) illustrated in FIG. 4, may be implemented multiple times in a single device 110. The number of adaptive beamformer (ABF) unit 490 blocks may correspond to the number of beams B. For example, if there are eight beams, there may be eight FBF units 440 and eight ANC units 460. Each adaptive beamformer (ABF) unit 490 may operate as described in reference to FIG. 4, with an individual output E 436 for each beam created by the respective adaptive beamformer (ABF) unit 490. Thus, B different outputs 436 may result. For device configuration purposes, there may also be B different other components, such as the synthesis filterbank 428, but that may depend on device configuration. Each individual adaptive beamformer (ABF) unit 490 may result in its own beamformed audio data Z 450, such that there may be B different beamformed audio data portions Z 450. Each beam's respective beamformed audio data Z 450 may be in a format corresponding to an input audio data 411 or in an alternate format. For example, the input audio data 411 and/or the beamformed audio data Z 450 may be sampled at a rate corresponding to 16 kHz and a mono-channel at 16 bits per sample, little endian format. Audio data in little endian format corresponds to storing the least significant byte of the audio data in the smallest address, as opposed to big endian format where the most significant byte of the audio data is stored in the smallest address.

Each particular FBF unit may be tuned with filter coefficient values to boost audio from one of the particular beams. For example, FBF unit 440-1 may be tuned to boost audio from beam 1, FBF unit 440-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF unit 440-7, direction 7, the beamformer filter coefficient $h_7$ for filter 512*g* may be high while beamformer filter coefficient values $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the output audio signal The filtered audio signals will then be summed together to create the output audio signal $Y_f$ 432. Thus, the FBF unit 440 may phase align microphone audio data toward a give n direction and add it up. So signals that are arriving from a particular direction are reinforced, but signals that are not arriving from the look direction are suppressed. The robust FBF coefficients are designed by solving a constrained convex optimization problem and by specifically taking into account the gain and phase mismatch on the microphones.

The individual beamformer filter coefficient values may be represented as $H_{BF,m}(r)$, where r=0, . . . R, where R denotes the number of beamformer filter coefficient values in the subband domain. Thus, the output $Y_f$ 432 of the filter and sum unit 430 may be represented as the summation of each microphone signal filtered by its beamformer coefficient and summed up across the M microphones:

$$Y(k, n) = \sum_{m=1}^{M} \sum_{r=0}^{R} H_{BF,m}(r) X_m(k, n-r) \tag{1}$$

Turning once again to FIG. 4, the output $Y_f$ 432, expressed in Equation 1, may be fed into a delay component 434, which delays the forwarding of the output Y until further adaptive noise canceling functions as described below may be performed. One drawback to output $Y_f$ 432, however, is that it may include residual directional noise that was not canceled by the FBF unit 440. To remove that directional noise, the device 110 may operate an adaptive noise canceller (ANC) unit 460 which includes components to obtain the remaining noise reference signal which may be used to remove the remaining noise from output Y.

As shown in FIG. 4, the adaptive noise canceller may include a number of nullformer blocks 418*a* through 418*p*. The device 110 may include P number of nullformer blocks 418 where P corresponds to the number of channels, where each channel corresponds to a direction in which the device may focus the nullformers 418 to isolate detected noise. The number of channels P is configurable and may be predetermined for a particular device 110. Each nullformer block is configured to operate similarly to the filter and sum block 430, only instead of the filter coefficient values for the nullformer blocks being selected to boost the look ahead direction, they are selected to boost one of the other, non-look ahead directions. Thus, for example, nullformer 418*a* is configured to boost audio from direction 1, nullformer 418*b* is configured to boost audio from direction 2, and so forth. Thus, the nullformer may actually dampen the desired audio (e.g., speech) while boosting and isolating undesired audio (e.g., noise). For example, nullformer 418*a* may be configured (e.g., using a high filter coefficient $h_1$ 512*a*) to boost the signal from microphone 502*a*/direction 1, regardless of the look ahead direction. Nullformers 418*b* through 418*p* may operate in similar fashion relative to their respective microphones/directions, though the individual coefficients for a particular channel's nullformer in one beam pipeline may differ from the individual coefficients from a nullformer for the same channel in a different beam's pipeline. The output Z 420 of each nullformer 418 will be a boosted signal corresponding to a non-desired direction. As audio from non-desired direction may include noise, each signal Z 420 may be referred to as a noise reference signal. Thus, for each channel 1 through P the adaptive noise canceller (ANC) unit 460 calculates a noise reference signal Z 420, namely $Z_1$ 420*a* through $Z_P$ 420*p*. Thus, the noise reference signals that are acquired by spatially focusing towards the various noise sources in the environment and away from the desired look-direction. The noise reference signal for channel p may thus be represented as $Z_p(k,n)$ where $Z_P$ is calculated as follows:

$$Z_p(k, n) = \sum_{m=1}^{M} \sum_{r=0}^{R} H_{NF,m}(p, r) X_m(k, n-r) \tag{2}$$

where $H_{NF,m}(p,r)$ represents the nullformer coefficients for reference channel p.

As described above, the coefficients for the nullformer filters 512 are designed to form a spatial null toward the look ahead direction while focusing on other directions, such as directions of dominant noise sources (e.g., noise source 302). The output from the individual nullformers $Z_1$ 420*a* through $Z_P$ 420*p* thus represent the noise from channels 1 through P.

The individual noise reference signals may then be filtered by noise estimation filter blocks 422 configured with weights W to adjust how much each individual channel's noise reference signal should be weighted in the eventual combined noise reference signal $\hat{Y}$ 425. The noise estimation filters (further discussed below) are selected to isolate the noise to be removed from output $Y_f$ 432. The individual channel's weighted noise reference signal $\hat{y}$ 424 is thus the channel's noise reference signal Z multiplied by the channel's weight W. For example, $\hat{y}_1=Z_1*W_1$, $\hat{y}_2=Z_2*W_2$, and so forth. Thus, the combined weighted noise estimate $\hat{Y}$ 425 may be represented as:

$$\hat{Y}_P(k, n) = \sum_{l=0}^{L} W_P(k, n, l) Z_P(k, n-l) \tag{3}$$

where $W_p(k,n,l)$ is the lth element of $W_p(k,n)$ and l denotes the index for the filter coefficient in subband domain. The noise estimates of the P reference channels are then added to obtain the overall noise estimate:

$$\hat{Y}(k, n) = \sum_{p=1}^{P} \hat{Y}_p(k, n) \tag{4}$$

The combined weighted noise reference signal $\hat{Y}$ 425, which represents the estimated noise in the audio signal, may then be subtracted from the FBF unit output $Y_f$ 432 to obtain a signal E 436, which represents the error between the combined weighted noise reference signal $\hat{Y}$ 425 and the FBF unit output $Y_f$ 432. That error, E 436, is thus the estimated desired non-noise portion (e.g., target signal portion) of the audio signal and may be the output of the adaptive noise canceller (ANC) unit 460. That error, E 436, may be represented as:

$$E(k,n)=Y(k,n)-\hat{Y}(k,n) \tag{5}$$

As shown in FIG. 4, the ABF unit output signal 436 may also be used to update the weights W of the noise estimation filter blocks 422 using sub-band adaptive filters, such as with a normalized least mean square (NLMS) approach:

$$W_p(k,n) = W_p(k,n-1) + \frac{\mu_p(k,n)}{\|Z_p(k,n)\|^2+\varepsilon} Z_p(k,n)E(k,n) \tag{6}$$

where $Z_p(k,n)=[Z_p(k,n)\ Z_p(k,n-1)\ \ldots\ Z_p(k,n-L)]^T$ is the noise estimation vector for the pth channel, $\mu_p(k,n)$ is the adaptation step-size for the pth channel, and $\varepsilon$ is a regularization factor to avoid indeterministic division. The weights may correspond to how much noise is coming from a particular direction.

As can be seen in Equation 6, the updating of the weights W involves feedback. The weights W are recursively updated by the weight correction term (the second half of the right hand side of Equation 6) which depends on the adaptation step size, $\mu_p(k,n)$, which is a weighting factor adjustment to be added to the previous weighting factor for the filter to obtain the next weighting factor for the filter (to be applied to the next incoming signal). To ensure that the weights are updated robustly (to avoid, for example, target signal cancellation) the step size $\mu_p(k,n)$ may be modulated according to signal conditions. For example, when the desired signal arrives from the look-direction, the step-size is significantly reduced, thereby slowing down the adaptation process and avoiding unnecessary changes of the weights W. Likewise, when there is no signal activity in the look-direction, the step-size may be increased to achieve a larger value so that weight adaptation continues normally. The step-size may be greater than 0, and may be limited to a maximum value. Thus, the device may be configured to determine when there is an active source (e.g., a speaking user) in the look-direction. The device may perform this determination with a frequency that depends on the adaptation step size.

The step-size controller 404 will modulate the rate of adaptation. Although not shown in FIG. 4, the step-size controller 404 may receive various inputs to control the step size and rate of adaptation including the noise reference signals 420, the FBF unit output $Y_f$ 432, the previous step size, the nominal step size (described below) and other data. The step-size controller may calculate Equations 6-13 below. In particular, the step-size controller 404 may compute the adaptation step-size for each channel p, sub-band k, and frame n. To make the measurement of whether there is an active source in the look-direction, the device may measure a ratio of the energy content of the beam in the look direction (e.g., the look direction signal in output $Y_f$ 432) to the ratio of the energy content of the beams in the non-look directions (e.g., the non-look direction signals of noise reference signals $Z_1$ 420*a* through $Z_P$ 420*p*). This may be referred to as a beam-to-null ratio (BNR). For each subband, the device may measure the BNR. If the BNR is large, then an active source may be found in the look direction, if not, an active source may not be in the look direction.

The BNR may be computed as:

$$BNR_p(k,n) = \frac{B_{YY}(k,n)}{N_{ZZ,p}(k,n)+\delta},\ k \in [k_{LB}, k_{UB}] \tag{7}$$

where, $k_{LB}$ denotes the lower bound for the subband range bin and $k_{UB}$ denotes the upper bound for the subband range bin under consideration, and $\delta$ is a regularization factor. Further, $B_{YY}(k,n)$ denotes the powers of the fixed beamformer output signal (e.g., output $Y_f$ 432) and $N_{ZZ,p}(k,n)$ denotes the powers of the pth nullformer output signals (e.g., the noise reference signals $Z_1$ 420*a* through $Z_P$ 420*p*). The powers may be calculated using first order recursive averaging as shown below:

$$B_{YY}(k,n) = \alpha B_{YY}(k,n-1) + (1-\alpha)|Y(k,n)|^2 \tag{8}$$

$$N_{ZZ,p}(k,n) = \alpha N_{ZZ,p}(k,n-1) + (1-\alpha)|Z_p(k,n)|^2$$

where, $\propto \in [0,1]$ is a smoothing parameter.

The BNR values may be limited to a minimum and maximum value as follows:

$$BNR_p(k,n) \in [BNR_{min}, BNR_{max}]$$

the BNR may be averaged across the subband bins:

$$BNR_p(n) = \frac{1}{(k_{UB}-k_{LB}+1)} \sum_{k_{LB}}^{k_{UB}} BNR_p(k,n) \tag{9}$$

the above value may be smoothed recursively to arrive at the mean BNR value:

$$\overline{BNR}_p(n)=\beta\overline{BNR}_p(n-1)+(1-\beta)BNR_p(n) \tag{10}$$

where $\beta$ is a smoothing factor.

The mean BNR value may then be transformed into a scaling factor in the interval of [0,1] using a sigmoid transformation:

$$\xi(n) = 1 - 0.5\left(1 + \frac{\upsilon(n)}{1+|\upsilon(n)|}\right) \tag{11}$$

$$\text{where } \upsilon(n) = \gamma\left(\overline{BNR}_p(n) - \sigma\right) \tag{12}$$

and $\gamma$ and $\sigma$ are tunable parameters that denote the slope ($\gamma$) and point of inflection ($\sigma$), for the sigmoid function.

Using Equation 11, the adaptation step-size for subband k and frame-index n is obtained as:

$$\mu_p(k,n) = \xi(n)\left(\frac{N_{ZZ,p}(k,n)}{B_{YY}(k,n)+\delta}\right)\mu_o \tag{13}$$

where $\mu_o$ is a nominal step-size. $\mu_o$ may be used as an initial step size with scaling factors and the processes above used to modulate the step size during processing.

At a first time period, audio signals from the microphone array 114 may be processed as described above using a first set of weights for the filters 422. Then, the error E 436 associated with that first time period may be used to calculate a new set of weights for the filters 422, where the new set of weights is determined using the step size calculations described above. The new set of weights may then be used to process audio signals from a microphone array 114 associated with a second time period that occurs after the first time period. Thus, for example, a first filter weight may be applied to a noise reference signal associated with a first audio signal for a first microphone/first direction from the first time period. A new first filter weight may then be calculated using the method above and the new first filter weight may then be applied to a noise reference signal associated with the first audio signal for the first microphone/first direction from the second time period. The same process may be applied to other filter weights and other audio signals from other microphones/directions.

The above processes and calculations may be performed across sub-bands k, across channels p and for audio frames n, as illustrated in the particular calculations and equations.

The estimated non-noise (e.g., output) audio signal E 436 may be processed by a synthesis filterbank 428 which converts the signal 436 into time-domain beamformed audio data Z 450 which may be sent to a downstream component for further operation. As illustrated in FIG. 6, there may be one component audio signal E 436 for each beam, thus for B beams there may be B audio signals E 436. Similarly, there may be one stream of beamformed audio data Z 450 for each beam, thus for B beams there may be B beamformed audio signals B 450. For example, a first beamformed audio signal may correspond to a first beam and to a first direction, a second beamformed audio signal may correspond to a second beam and to a second direction, and so forth.

As shown in FIGS. 4 and 6, the input audio data from a microphone array may include audio data 411 for each microphone 0 through M in the time domain, which may be converted by the analysis filterbank into spectral domain audio signals X 413 for each microphone 0 through M. The beamformer unit may then convert the audio signals X 413 into beamformer output signals E 436 in the spectral domain, with one signal for each beam 0 through B. The synthesis filterbank may then may convert the signals E 436 into time domain beamformer audio data Z 450, with one set of audio data Z 450 for each beam 0 through B.

Figure 7A:
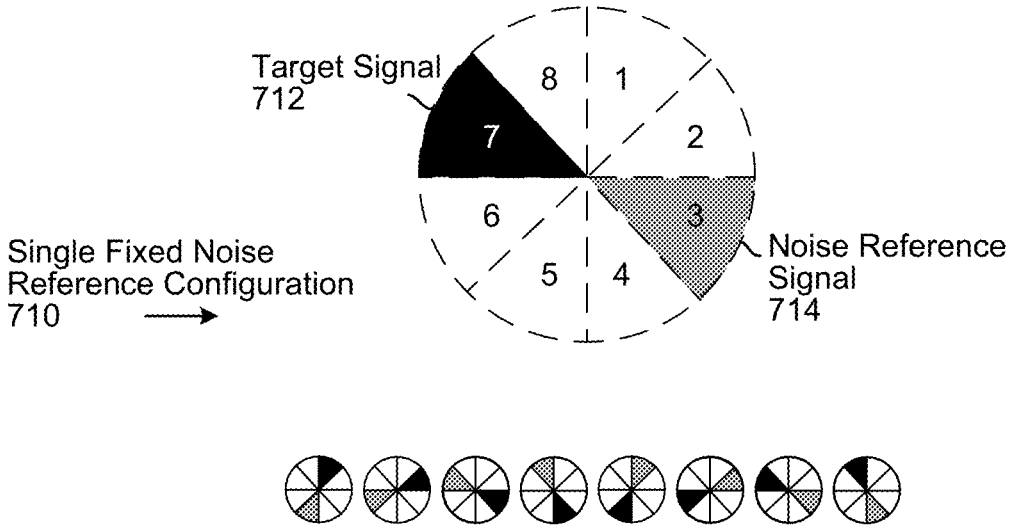
FIGS. 7A-7B illustrate examples of noise reference signals according to embodiments of the present disclosure.
Figure 7A:
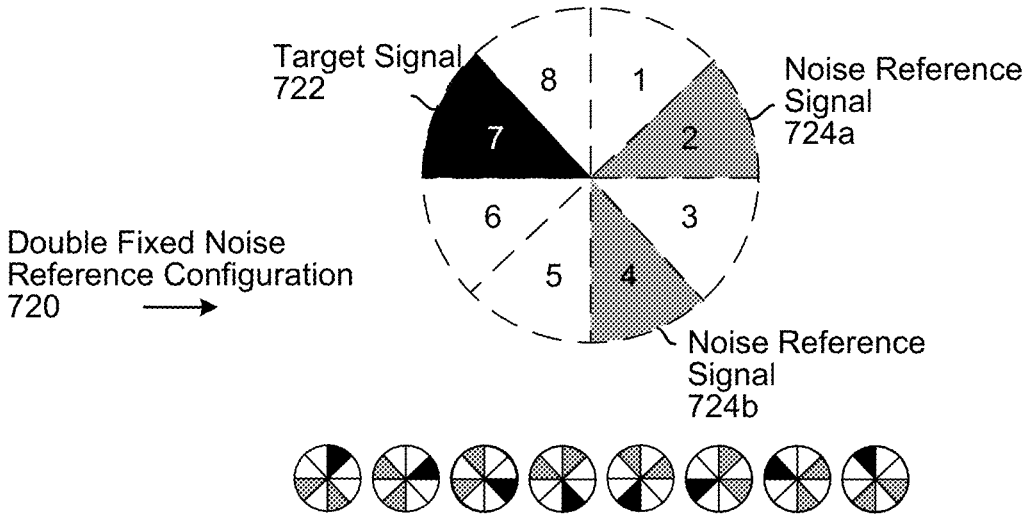
Figure 7B:
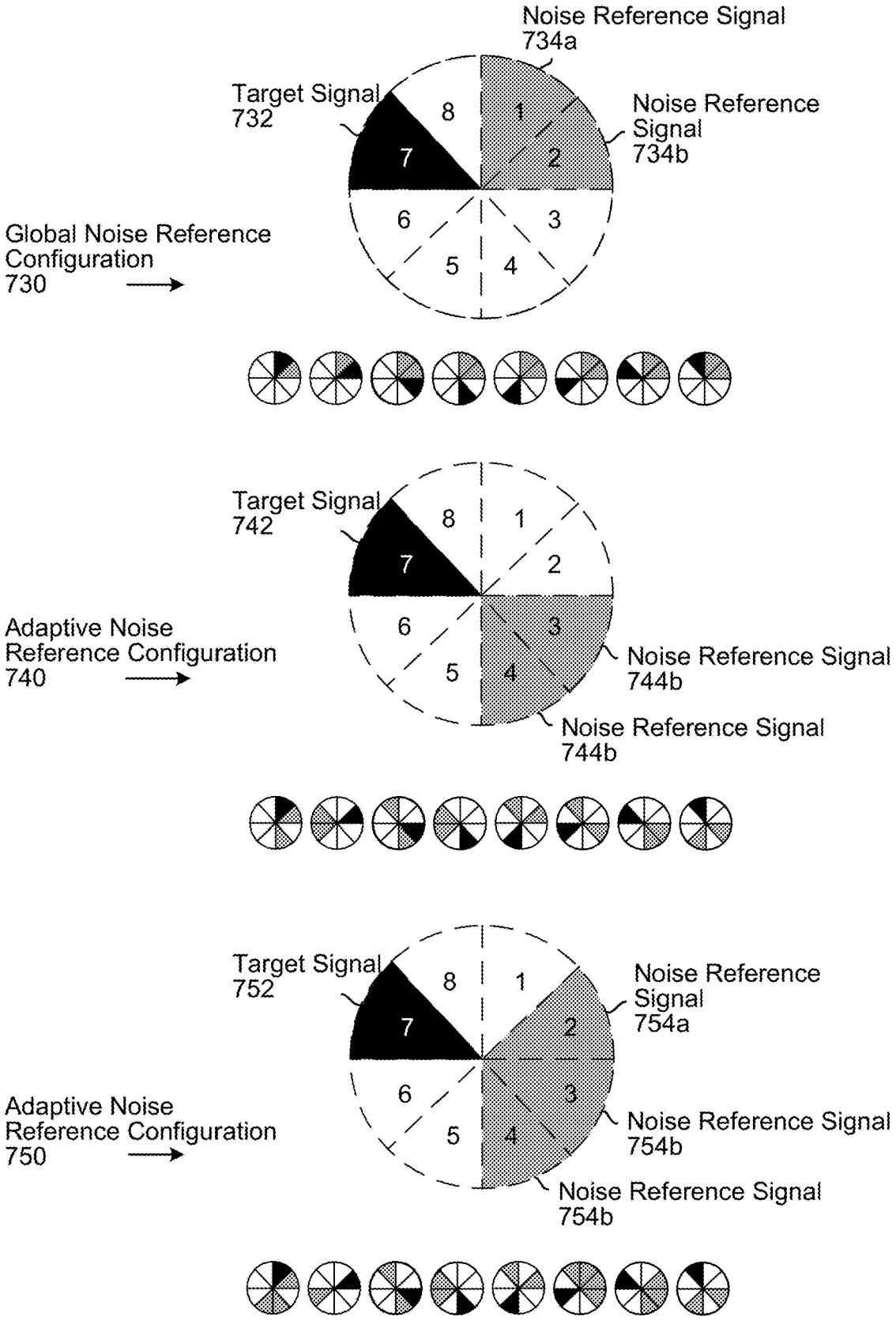

FIGS. 7A-7B illustrate examples of noise reference signals according to embodiments of the present disclosure. The device 110 may determine the noise reference signal(s) using a variety of techniques. In some examples, the device 110 may use the same noise reference signal(s) for each of the directional outputs. For example, the device 110 may select a first directional output associated with a particular direction as a noise reference signal and may determine the signal quality metric for each of the directional outputs by dividing a power value associated with an individual directional output by a power value associated with the first directional output (e.g., noise power level). Thus, the device 110 may determine a first signal quality metric by dividing a first power level associated with a second directional output by the noise power level, may determine a second signal quality metric by dividing a second power level associated with a third directional output by the noise power level, and so on. As the noise reference signal is the same for each of the directional outputs, instead of determining a ratio the device 110 may use the power level associated with each of the directional outputs as the signal quality metrics.

In some examples, each directional output may be associated with unique noise reference signal(s). To illustrate an example, the device 110 may determine the noise reference signal(s) using a fixed configuration based on the directional output. For example, the device 110 may select a first directional output (e.g., Direction 1) and may choose a second directional output (e.g., Direction 5, opposite Direction 1 when there are eight beams corresponding to eight different directions) as a first noise reference signal for the first directional output, may select a third directional output (e.g., Direction 2) and may choose a fourth directional output (e.g., Direction 6) as a second noise reference signal for the third directional output, and so on. This is illustrated in FIG. 7A as a single fixed noise reference configuration 710.

As illustrated in FIG. 7A, in the single fixed noise reference configuration 710, the device 110 may select a seventh directional output (e.g., Direction 7) as a target signal 712 and select a third directional output (e.g., Direction 3) as a noise reference signal 714. The device 110 may continue this pattern for each of the directional outputs, using Direction 1 as a target signal and Direction 5 as a noise reference signal, Direction 2 as a target signal and Direction 6 as a noise reference signal, Direction 3 as a target signal and Direction 7 as a noise reference signal, Direction 4 as a target signal and Direction 8 as a noise reference signal, Direction 5 as a target signal and Direction 1 as a noise reference signal, Direction 6 as a target signal and Direction 2 as a noise reference signal, Direction 7 as a target signal and Direction 3 as a noise reference signal, and Direction 8 as a target signal and Direction 4 as a noise reference signal.

As an alternative, the device 110 may use a double fixed noise reference configuration 720. For example, the device 110 may select the seventh directional output (e.g., Direction 7) as a target signal 722 and may select a second directional output (e.g., Direction 2) as a first noise reference signal 724*a* and a fourth directional output (e.g., Direction 4) as a second noise reference signal 724*b*. The device 110 may continue this pattern for each of the directional outputs, using Direction 1 as a target signal and Directions 4/6 as noise reference signals, Direction 2 as a target signal and Directions 5/7 as noise reference signals, Direction 3 as a target signal and Directions 6/8 as noise reference signals, Direction 4 as a target signal and Directions 7/9 as noise reference signal, Direction 5 as a target signal and Directions 8/2 as noise reference signals, Direction 6 as a target signal and Directions 1/3 as noise reference signals, Direction 7 as a target signal and Directions 2/4 as noise reference signals, and Direction 8 as a target signal and Directions 3/5 as noise reference signals.

While FIG. 7A illustrates using a fixed configuration to determine noise reference signal(s), the disclosure is not limited thereto. FIG. 7B illustrates examples of the device 110 selecting noise reference signal(s) differently for each target signal. As a first example, the device 110 may use a global noise reference configuration 730. For example, the device 110 may select the seventh directional output (e.g., Direction 7) as a target signal 732 and may select the first directional output (e.g., Direction 1) as a first noise reference signal 734*a* and the second directional output (e.g., Direction 2) as a second noise reference signal 734*b*. The device 110 may use the first noise reference signal 734*a* and the second noise reference signal 734*b* for each of the directional outputs (e.g., Directions 1-8).

As a second example, the device 110 may use an adaptive noise reference configuration 740, which selects two directional outputs as noise reference signals for each target signal. For example, the device 110 may select the seventh directional output (e.g., Direction 7) as a target signal 742 and may select the third directional output (e.g., Direction 3) as a first noise reference signal 744*a* and the fourth directional output (e.g., Direction 4) as a second noise reference signal 744*b*. However, the noise reference signals may vary for each of the target signals, as illustrated in FIG. 7B.

As a third example, the device 110 may use an adaptive noise reference configuration 750, which selects one or more directional outputs as noise reference signals for each target signal. For example, the device 110 may select the seventh directional output (e.g., Direction 7) as a target signal 752 and may select the second directional output (e.g., Direction 2) as a first noise reference signal 754*a*, the third directional output (e.g., Direction 3) as a second noise reference signal 754*b*, and the fourth directional output (e.g., Direction 4) as a third noise reference signal 754*c*. However, the noise reference signals may vary for each of the target signals, as illustrated in FIG. 7B, with a number of noise reference signals varying between one (e.g., Direction 6 as a noise reference signal for Direction 2) and four (e.g., Directions 1-3 and 8 as noise reference signals for Direction 6).

In some examples, the device 110 may determine a number of noise references based on a number of dominant audio sources. For example, if someone is talking while music is playing over loudspeakers and a blender is active, the device 110 may detect three dominant audio sources (e.g., talker, loudspeaker, and blender) and may select one dominant audio source as a target signal and two dominant audio sources as noise reference signals. Thus, the device 110 may select first audio data corresponding to the person speaking as a first target signal and select second audio data corresponding to the loudspeaker and third audio data corresponding to the blender as first reference signals. Similarly, the device 110 may select the second audio data as a second target signal and the first audio data and the third audio data as second reference signals, and may select the third audio data as a third target signal and the first audio data and the second audio data as third reference signals.

Additionally or alternatively, the device 110 may track the noise reference signal(s) over time. For example, if the music is playing over a portable loudspeaker that moves around the room, the device 110 may associate the portable loudspeaker with a noise reference signal and may select different portions of the beamformed audio data based on a location of the portable loudspeaker. Thus, while the direction associated with the portable loudspeaker changes over time, the device 110 selects beamformed audio data corresponding to a current direction as the noise reference signal.

While some of the examples described above refer to determining instantaneous values for a signal quality metric (e.g., a signal-to-interference ratio (SIR), a signal-to-noise ratio (SNR), or the like), the disclosure is not limited thereto. Instead, the device 110 may determine the instantaneous values and use the instantaneous values to determine average values for the signal quality metric. Thus, the device 110 may use average values or other calculations that do not vary drastically over a short period of time in order to select which signals on which to perform additional processing. For example, a first audio signal associated with an audio source (e.g., person speaking, loudspeaker, etc.) may be associated with consistently strong signal quality metrics (e.g., high SIR/SNR) and intermittent weak signal quality metrics. The device 110 may average the strong signal metrics and the weak signal quality metrics and continue to track the audio source even when the signal quality metrics are weak without departing from the disclosure.

Figure 8A:
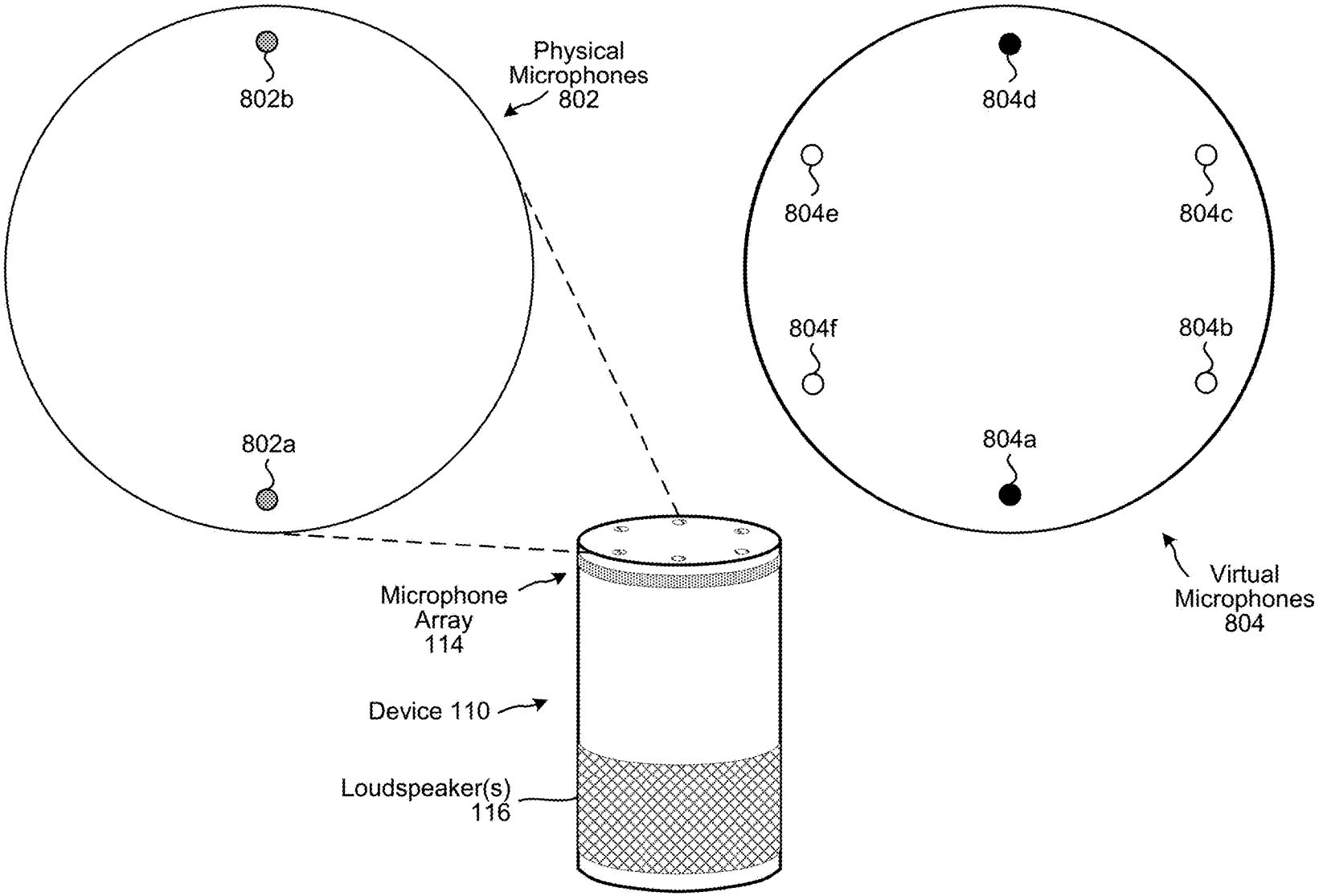
FIGS. 8A-8B illustrate examples of physical microphones and virtual microphones according to embodiments of the present disclosure.
Figure 8B:
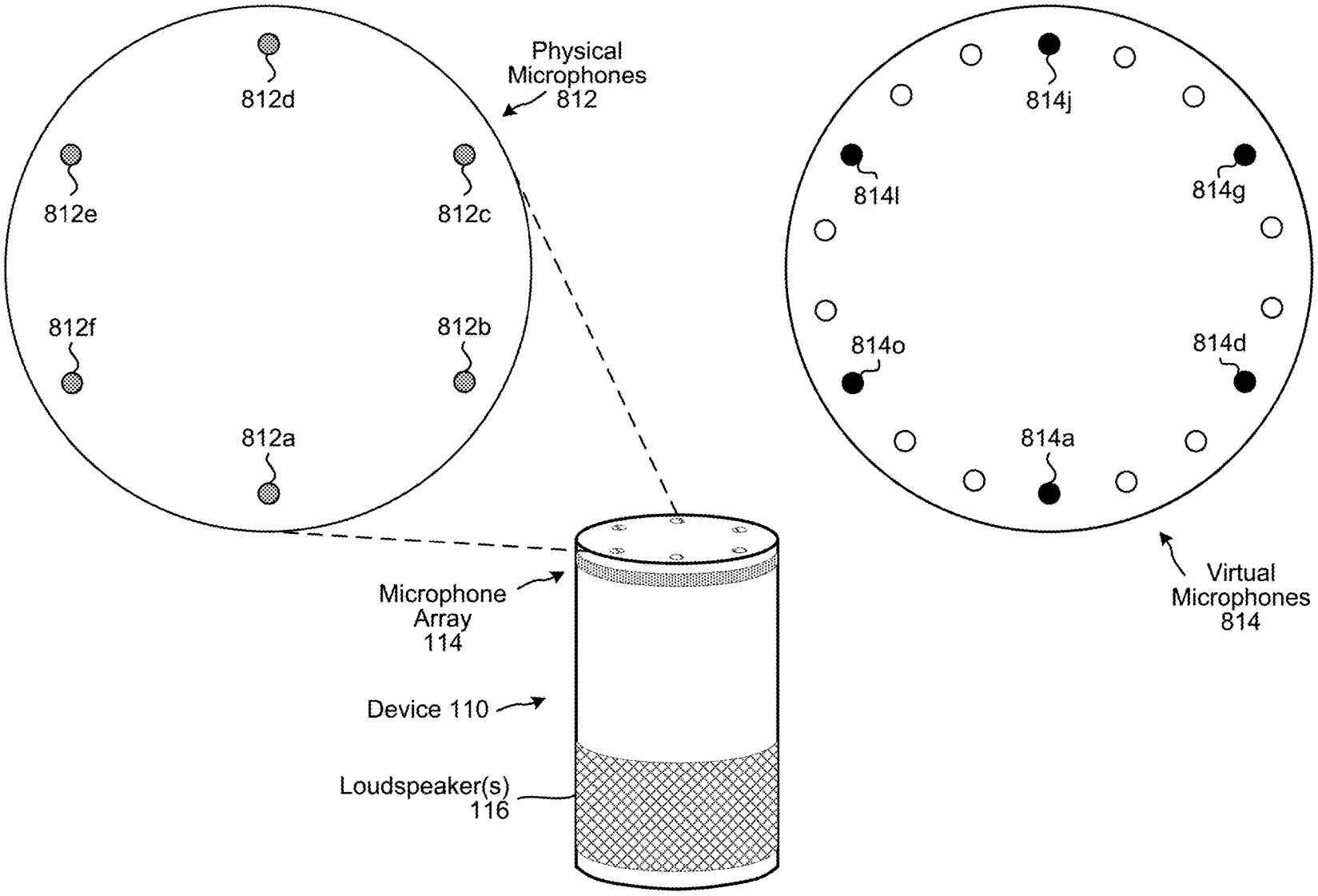

FIGS. 8A-8B illustrate examples of physical microphones and virtual microphones according to embodiments of the present disclosure. As illustrated in FIG. 8A, the microphone array 114 may include only two physical microphones 802 (e.g., first physical microphone 802*a* and second physical microphone 802*b*), which are illustrated as gray circles. Using these two physical microphones 802, the device 110 may perform beamforming to generate a plurality of beamformed audio data. For example, the device 110 may generate first beamformed audio data corresponding to a first direction, second beamformed audio data corresponding to a second direction, third beamformed audio data corresponding to a third direction, and so on. The device 110 may generate any number of beams (e.g., 6, 12, 18, 24, 36, etc.) without departing from the disclosure.

To improve the beamforming, the device 110 may generate virtual microphones 804. For example, FIG. 8A illustrates that the device 110 may generate six virtual microphones 804. As illustrated in FIG. 8A, the device 110 may generate a first virtual microphone 804*a*, a second virtual microphone 804*b*, a third virtual microphone 804*c*, a fourth virtual microphone 804*d*, a fifth virtual microphone 804*e*, and a sixth virtual microphone 804*f*. While many of the virtual microphones 804 (e.g., 804*b*, 804*c*, 804*e* and 804*f*) are located at a position without a physical microphone, and are thus illustrated in FIG. 8A using a white circle, some virtual microphones 804 (e.g., 804*a* and 804*d*) may share a position with the physical microphones 802 and are thus illustrated using a black circle. For example, the first virtual microphone 804*a* and the first physical microphone 802*a* share a first position on the device 110 and the fourth virtual microphone 804*d* and the second physical microphone 802*b* share a second position on the device 110.

As the first physical microphone 802*a* and the first virtual microphone 804*a* correspond to the first position, filter coefficient values are identical between the first physical microphone 802*a* and the first virtual microphone 804*a*. For ease of explanation and to avoid confusion, however, the disclosure may explicitly associate the first physical microphone 802*a* with the first virtual microphone 804*a* and/or first filter coefficient values corresponding to the first virtual microphone 804*a*, despite the first filter coefficient values being identical to filter coefficient values associated with the first physical microphone 802*a*. Similarly, as the second physical microphone 802*b* and the fourth virtual microphone 804*d* correspond to the second position, filter coefficient values are identical between the second physical microphone 802*b* and the fourth virtual microphone 804*d*. For ease of explanation and to avoid confusion, however, the disclosure may explicitly associate the second physical microphone 802*b* with the fourth virtual microphone 804*d* and/or fourth filter coefficient values corresponding to the fourth virtual microphone 804*d*, despite the fourth filter coefficient values being identical to filter coefficient values associated with the second physical microphone 802*b*.

While FIG. 8A illustrates that the device 110 may generate six virtual microphones 804, the disclosure is not limited thereto and the number of virtual microphones 804 may vary without departing from the present disclosure. For example, the device 110 may generate any number of virtual microphones (e.g., 6, 12, 18, 24, 36, etc.) without departing from the present disclosure. In some examples, the number of virtual microphones may be different from the number of beams, although the disclosure is not limited thereto and the number of virtual microphones may be equal to the number of beams without departing from the disclosure.

In addition to varying the number of virtual microphones and/or beams, a number of physical microphones included in the microphone array 114 may vary. As illustrated in FIG. 8B, the microphone array 114 may include six physical microphones 812 (e.g., first physical microphone 812*a*, second physical microphone 812*b*, third physical microphone 812*c*, fourth physical microphone 812*d*, fifth physical microphone 812*e*, and sixth physical microphone 812*f*), which are illustrated as gray circles. Using these six physical microphones 812, the device 110 may perform beamforming to generate a plurality of beamformed audio data. For example, the device 110 may generate first beamformed audio data corresponding to a first direction, second beamformed audio data corresponding to a second direction, third beamformed audio data corresponding to a third direction, and so on. The device 110 may generate any number of beams (e.g., 6, 12, 18, 24, 36, etc.) without departing from the disclosure.

To improve the beamforming, the device 110 may generate virtual microphones 814. For example, FIG. 8B illustrates that the device 110 may generate eighteen virtual microphones 814 (e.g., 814*a*-814*r*). While many of the virtual microphones 814 are unlabeled and illustrated in FIG. 8B using a white circle, some virtual microphones 814 (e.g., 814*a*, 814*d*, 814*g*, 814*j*, 8141, and 814*o*) share a position with the physical microphones 812 and are thus illustrated using a black circle. For example, the first virtual microphone 814*a* and the first physical microphone 812*a* share a first position on the device 110, the fourth virtual microphone 814*d* and the second physical microphone 812*b* share a second position on the device 110, and so on.

As the first physical microphone 812*a* and the first virtual microphone 814*a* correspond to the first position, filter coefficient values are identical between the first physical microphone 812*a* and the first virtual microphone 814*a*. For ease of explanation and to avoid confusion, however, the disclosure may explicitly associate the first physical microphone 812*a* with the first virtual microphone 814*a* and/or first filter coefficient values corresponding to the first virtual microphone 814*a*, despite the first filter coefficient values being identical to filter coefficient values associated with the first physical microphone 812*a*. Similarly, the same explanation applies to the fourth virtual microphone 814*d* and the second physical microphone 812*b*, the seventh virtual microphone 814*g* and the third physical microphone 812*c*, the tenth virtual microphone 814*j* and the fourth physical microphone 812*d*, the thirteenth virtual microphone 814*l* and the fifth physical microphone 812*e*, and the sixteenth virtual microphone 814*o* and the sixth physical microphone 812*f*.

While FIG. 8B illustrates that the device 110 may generate eighteen virtual microphones 814, the disclosure is not limited thereto and the number of virtual microphones 814 may vary without departing from the present disclosure. For example, the device 110 may generate any number of virtual microphones (e.g., 6, 12, 18, 24, 36, etc.) without departing from the present disclosure. In some examples, the number of virtual microphones may be different from the number of beams, although the disclosure is not limited thereto and the number of virtual microphones may be equal to the number of beams without departing from the disclosure.

Similarly, while FIG. 8B illustrates that the device 110 may include six physical microphones 812, the disclosure is not limited thereto and the number of physical microphones 812 may vary without departing from the disclosure. For example, the device 110 may include any number of physical microphones (e.g., 2, 3, 4, 6, 12, etc.) without departing from the disclosure. In some examples, the number of virtual microphones may be different from the number of physical microphones, although the disclosure is not limited thereto and the number of virtual microphones may be equal to the number of physical microphones without departing from the disclosure. Additionally or alternatively, while FIG. 8B illustrates that the number of virtual microphones 814 is a multiple of the number of physical microphones 812 (e.g., six physical microphones 812 corresponds to eighteen virtual microphones 814), the disclosure is not limited thereto and the number of virtual microphones 814 may be unrelated to the number of physical microphones 812.

When the device 110 only includes two physical microphones 802, as illustrated in FIG. 8A, the device 110 may perform beamforming by identifying virtual microphones 804 and/or filter coefficient values corresponding to the virtual microphones 804 that are associated with the two physical microphones 802 for each direction of interest (e.g., beam used during beamforming). For example, for a first direction of interest (e.g., Beam 1 corresponding to Direction 1), the device 110 may select a first filter coefficient value that is associated with the first physical microphone 802*a* and the first direction and may select a second filter coefficient value that is associated with the second physical microphone 802*b* and the first direction.

While the first physical microphone 802*a* shares the first position with the first virtual microphone 804*a*, the first filter coefficient value may correspond to one of the remaining virtual microphones 804 (e.g., 804*b*, 804*c*, 804*d*, 804*e*, or 804*f*) without departing from the disclosure. Thus, the first filter coefficient value may correspond to a virtual microphone having a different position than the first position corresponding to the first physical microphone 802*a*. Similarly, while the second physical microphone 802*b* shares the second position with the fourth virtual microphone 804*d*, the second filter coefficient value may correspond to one of the remaining virtual microphones 804 (e.g., 804*a*, 804*b*, 804*c*, 804*e*, or 804*f*) without departing from the disclosure. Thus, the second filter coefficient value may correspond to a virtual microphone having a different position than the second position corresponding to the second physical microphone 802*b*.

The device 110 may perform a series of simulations to determine the virtual microphones 804 and/or filter coefficient values corresponding to the virtual microphones 804 to associate with the two physical microphones 802 for each direction of interest. For example, the device 110 may determine filter coefficient values for each of the virtual microphones 804 and may perform simulations to determine power values for each direction of interest corresponding to each pair of virtual microphones 804. Thus, the device 110 may perform a first simulation to determine first power values for each direction of interest by applying filter coefficient values associated with the first virtual microphone 804*a* to first audio data captured by the first physical microphone 802*a* and applying filter coefficient values associated with the second virtual microphone 804*b* to second audio data captured by the second physical microphone 802*b*. Similarly, the device 110 may perform a second simulation to determine second power values for each direction of interest by applying filter coefficient values associated with the first virtual microphone 804*a* to the first audio data captured by the first physical microphone 802*a* and applying filter coefficient values associated with the third virtual microphone 804*c* to the second audio data captured by the second physical microphone 802*b*, and so on.

While the example illustrated above includes every combination of the virtual microphones 804, the disclosure is not limited thereto. Instead, the device 110 may perform simulations using specific combinations of the virtual microphones 804, such as virtual microphones 804 that are opposite to each other (e.g., separated by 180 degrees. For example, the device 110 may select the first virtual microphone 804*a* and the fourth virtual microphone 804*d* as a first pair, the second virtual microphone 804*b* and the fifth virtual microphone 804*e* as a second pair, and the third virtual microphone 804*c* and the sixth virtual microphone 804*f* as a third pair.

Thus, the device 110 may perform a first simulation to determine first power values for each direction of interest by applying filter coefficient values associated with the first virtual microphone 804*a* to first audio data captured by the first physical microphone 802*a* and applying filter coefficient values associated with the fourth virtual microphone 804*d* to second audio data captured by the second physical microphone 802*b*. Similarly, the device 110 may perform a second simulation to determine second power values for each direction of interest by applying filter coefficient values associated with the second virtual microphone 804*b* to the first audio data captured by the first physical microphone 802*a* and applying filter coefficient values associated with the fifth virtual microphone 804*e* to the second audio data captured by the second physical microphone 802*b*. The device 110 may perform a third simulation to determine third power values for each direction of interest by applying filter coefficient values associated with the third virtual microphone 804*c* to the first audio data captured by the first physical microphone 802*a* and applying filter coefficient values associated with the sixth virtual microphone 804*f* to the second audio data captured by the second physical microphone 802*b*.

In addition to performing simulations applying the pairs of virtual microphones to the first physical microphone 802*a* and the second physical microphone 802*b* as described above, the device 110 may also perform simulations applying the pairs of virtual microphones to the second physical microphone 802*b* and the first physical microphone 802*a* in that order. For example, the device 110 may perform a fourth simulation to determine fourth power values for each direction of interest by applying filter coefficient values associated with the fourth virtual microphone 804*d* to the first audio data captured by the first physical microphone 802*a* and applying filter coefficient values associated with the first virtual microphone 804*a* to the second audio data captured by the second physical microphone 802*b*.

After performing simulations for each combination of virtual microphones 804 and physical microphones 802, the device 110 may select the best power values for each direction of interest and may associate virtual microphones 804 and/or filter coefficient values corresponding to the best power values with each of the physical microphones 802. Thus, anytime the device 110 generates first beamformed audio data in the first direction, the device 110 may apply the first filter coefficient values (which may correspond to any of the virtual microphones 804) to the first input audio data captured by the first physical microphone 802*a* and the second filter coefficient values (which may correspond to any of the virtual microphones 804) to the second input audio data captured by the second physical microphone 802*b*.

In some examples, the device 110 may store an association between the virtual microphones 804 and the physical microphones 802 for each direction of interest. For example, the device 110 may associate the second virtual microphone 804*b* with the first physical microphone 802*a* for the first direction, and the device 110 may generate beamformed audio data in the first direction by determining a filter coefficient value corresponding to the second virtual microphone 804*b* and the first direction and applying the filter coefficient value to the first audio data captured by the first physical microphone 802*a*. However, the disclosure is not limited thereto and the device 110 may instead store an association between the filter coefficient value(s) and the physical microphones 802 without departing from the disclosure. For example, the device 110 may associate a particular filter coefficient value (e.g., corresponding to the second virtual microphone 804*b* and the first direction) with the first physical microphone 802*a* for the first direction, and the device 110 may generate beamformed audio data in the first direction by retrieving the particular filter coefficient value associated with the first physical microphone 802*a* for the first direction and applying the particular filter coefficient value to the first audio data captured by the first physical microphone 802*a*.

Additionally or alternatively, the device 110 may store an association between the virtual microphones 804 and the physical microphones 802 for each direction of interest as well as an association between the filter coefficient value(s) and the physical microphones 802 without departing from the disclosure. Thus, the device 110 may retrieve the virtual microphone 804 and/or the filter coefficient value corresponding to each physical microphone 802 for each direction of interest without departing from the disclosure.

While the above examples illustrate the device 110 performing the simulations, determining the best power values, and/or determining the virtual microphones 804 and/or filter coefficient value(s) to associate with each physical microphone 802 for each direction of interest, the disclosure is not limited thereto. Instead, a remote device (e.g., a remote server) may perform the simulations, determine the best power values, and/or determine the virtual microphones 804 and/or filter coefficient value(s) to associate with each physical microphone 802 for each direction of interest without departing from the disclosure. Thus, in some examples, the remote device may perform these steps and store these associations in a lookup table, database, and/or the like and the device 110 may store the lookup table, database, and/or the like.

Generating the associations and storing them in the lookup table, database, and/or the like may be performed offline and stored in the device 110 as part of a configuration or initialization step. Thus, when the device 110 performs beamforming during run-time or while in an operational state, the device 110 may retrieve the virtual microphone 804 and/or filter coefficient value that is associated with a physical microphone 802 for a particular direction without departing from the disclosure.

Figure 9A:
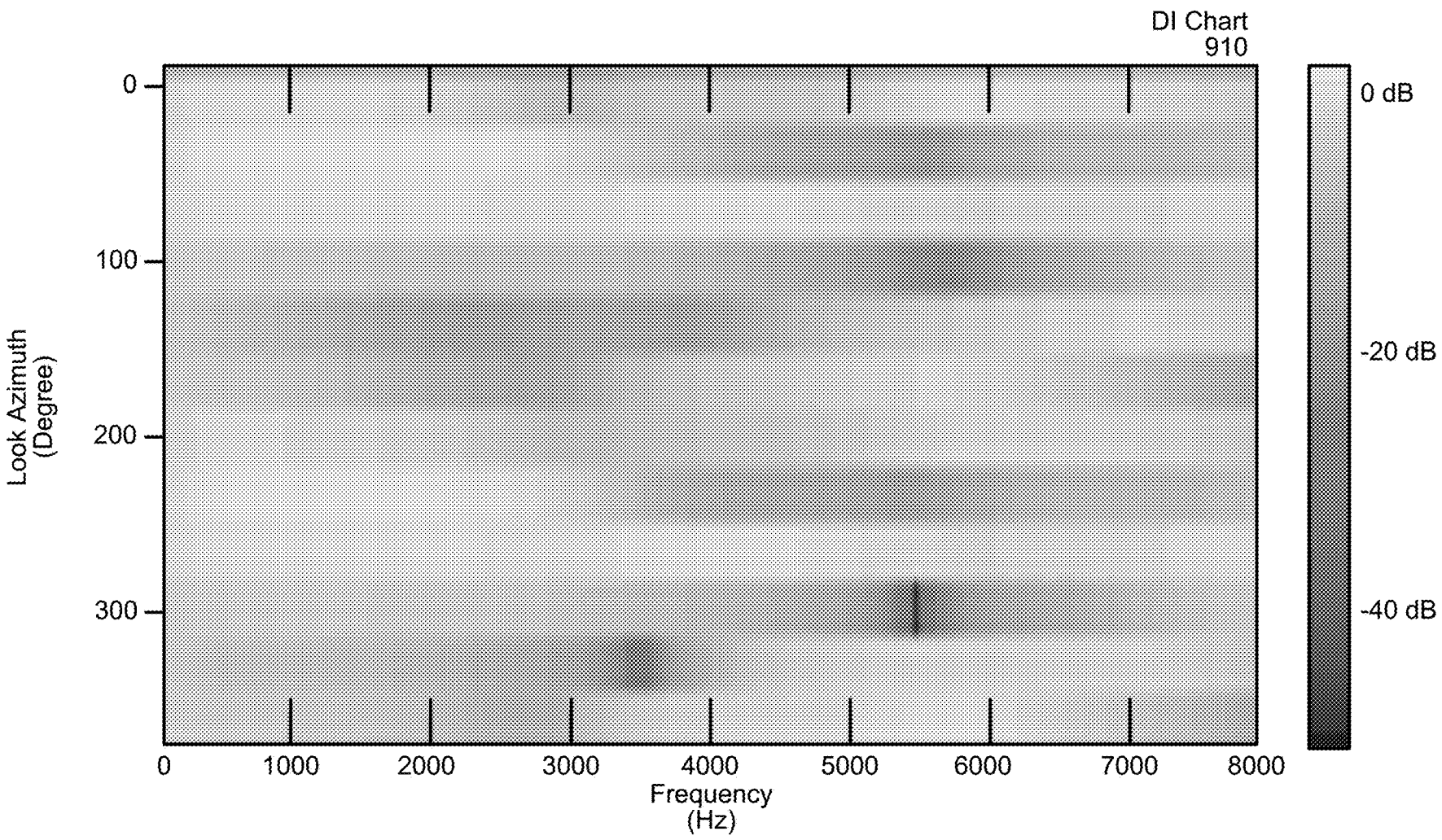
FIGS. 9A-9C illustrate examples of power values corresponding to pairs of virtual microphones according to embodiments of the present disclosure.
Figure 9B:
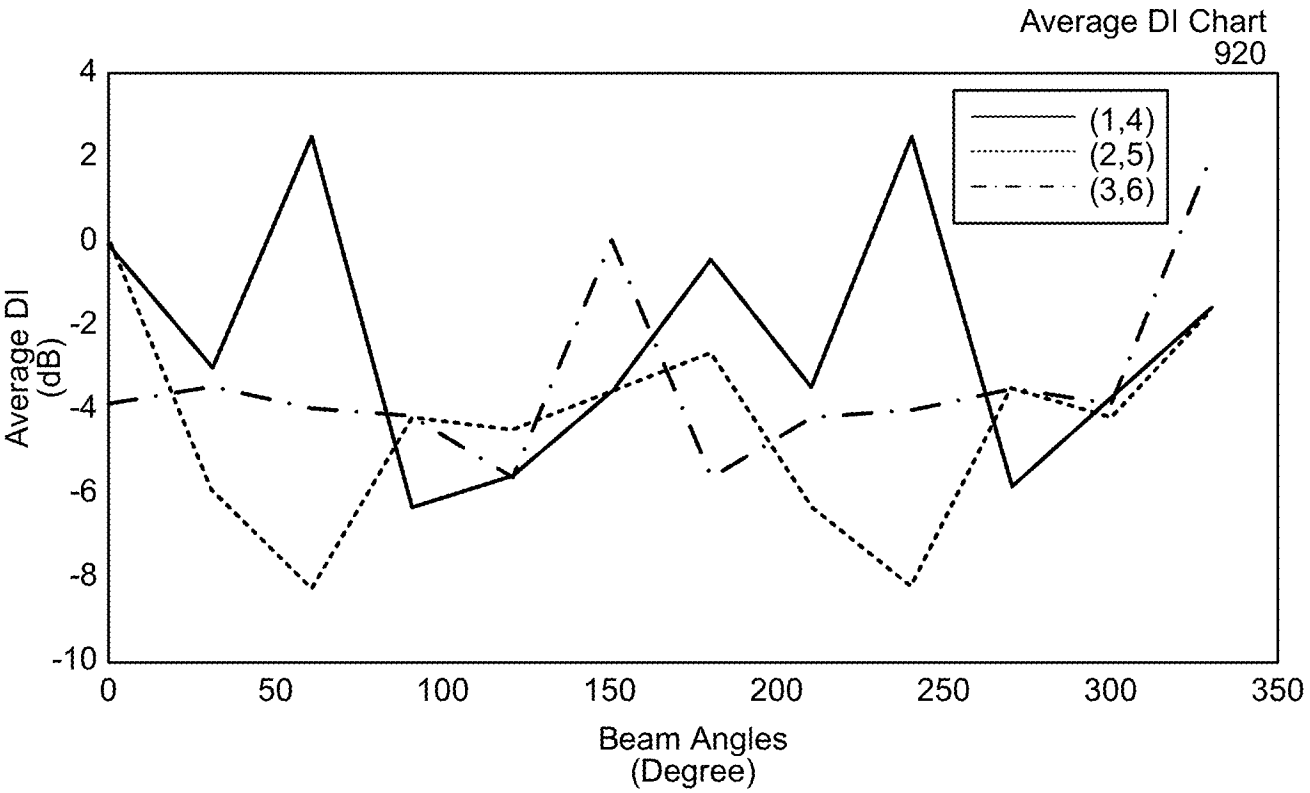
Figure 9C:
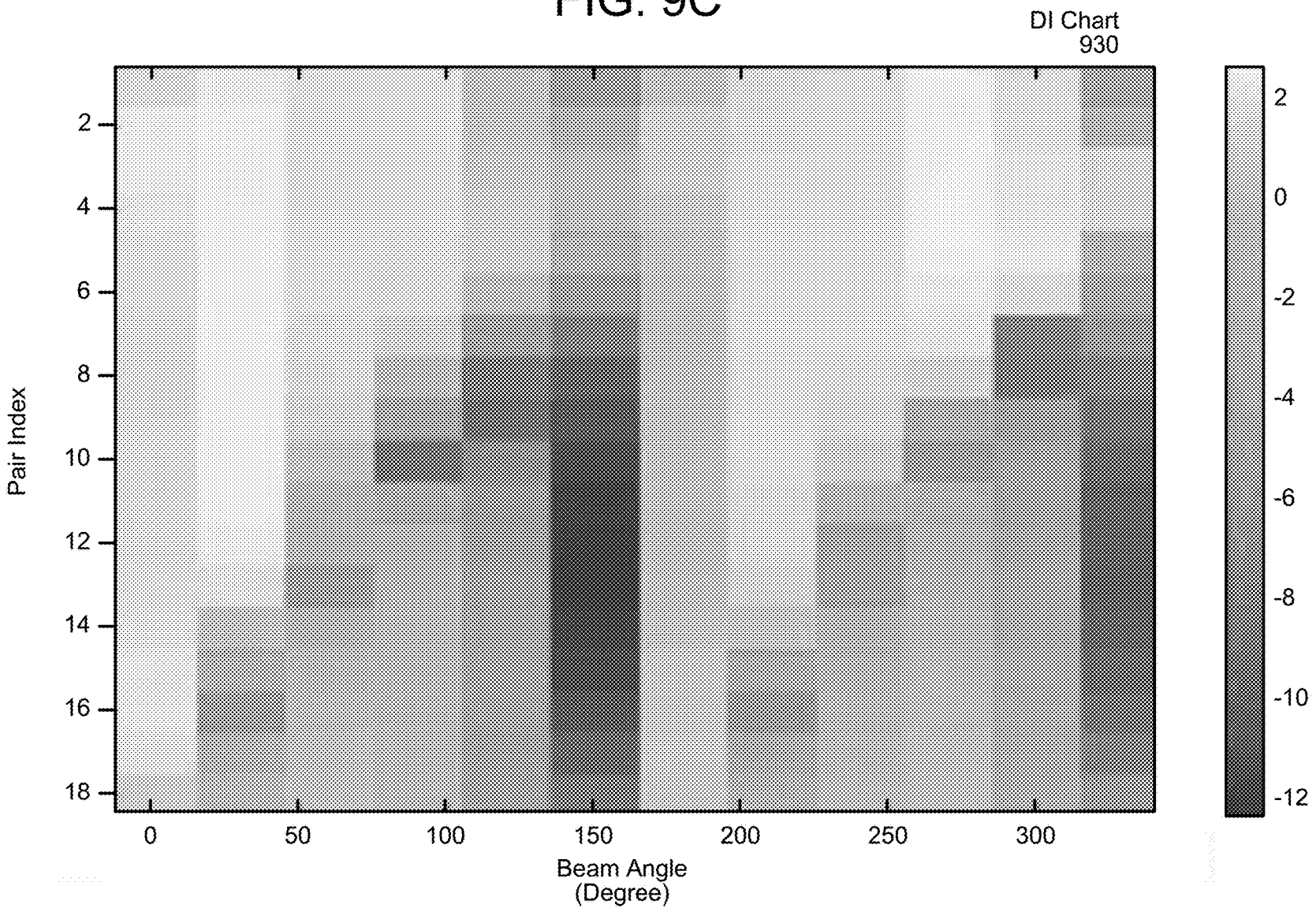

FIGS. 9A-9C illustrate examples of power values corresponding to pairs of virtual microphones according to embodiments of the present disclosure. For example, FIG. 9A illustrates an example of a directivity index (DI) chart 910 corresponding to a single pair of virtual microphones (e.g., first virtual microphone 804*a* and fourth virtual microphone 804*d*) that indicates power values for individual frequencies at each look direction (e.g., look azimuth, measured in degrees), FIG. 9B illustrates an example of an average DI chart 920 that indicates average power values (e.g., average of power values within a frequency range) corresponding to look directions (e.g., beam angles, measured in degrees) for each ordered pair of virtual microphones, and FIG. 9C illustrates an example of a DI chart 930 corresponding to every pair of virtual microphones (e.g., pair index) that indicates average power values at each look direction (e.g., beam angle, measured in degrees). Thus, the device 110 and/or remote device may generate the DI chart 910 for each pair of virtual microphones to indicate power values across frequencies and look directions, may generate the average DI chart 920 for each pair of virtual microphones to indicate average power values for each look direction, and then may generate the DI chart 930 to compare the results from each pair of virtual microphones.

As mentioned above, FIG. 9A corresponds to a first ordered pair of virtual microphones (e.g., first virtual microphone 804*a* and fourth virtual microphone 804*d*), with the order of the virtual microphones 804 corresponding to a specific order of the physical microphones 802. For example, the first DI chart 910 is generated using the first ordered pair of virtual microphones by applying first filter coefficient values associated with the first virtual microphone 804*a* to first audio data captured by the first physical microphone 802*a* and applying fourth filter coefficient values associated with the fourth virtual microphone 804*d* to second audio data captured by the second physical microphone 802*b*.

In contrast, a second DI chart may be generated using a second ordered pair of virtual microphones (e.g., fourth virtual microphone 804*d* and first virtual microphone 804*a*), which indicates that the fourth filter coefficient values associated with the fourth virtual microphone 804*d* are applied to the first audio data captured by the first physical microphone 802*a* and that the first filter coefficient values associated with the first virtual microphone 804*a* are applied to the second audio data captured by the second physical microphone 802*b*. Thus, each ordered pair of virtual microphones are applied to each combination of the physical microphones 802, resulting in separate DI charts like DI chart 910 for each ordered pair of virtual microphones.

When the ordered pair of virtual microphones 804 are generated using opposing directions (e.g., pairing first virtual microphone 804*a* and fourth virtual microphone 804*d*, second virtual microphone 804*b* and fifth virtual microphone 804*e*, etc.), the number of ordered pairs is equal to the number of virtual microphones. For example, six virtual microphones 804*a*-804*f* correspond to six ordered pairs (e.g., 804*a*/804*d*, 804*b*/804*e*, 804*c*/804*f*, 804*d*/804*a*, 804*e*/804*b*, and 804*f*/804*c*). However, as discussed above, the disclosure is not limited thereto and the virtual microphones 804 may be paired using any combination without departing from the disclosure. For example, the device 110 may determine every single combination of ordered pairs (e.g., 30 ordered pairs) without departing from the disclosure.

As illustrated in FIG. 9A, the DI chart 910 indicates look direction (e.g., look azimuth, measured in degrees) along the vertical axis (e.g., y-axis) and frequency (e.g., measured in Hertz (Hz)) along the horizontal axis (e.g., x-axis), with an intensity of the DI value (e.g., power value, measured in decibels (dB)) indicated by a color ranging between white (e.g., 0 dB) and black (e.g., −50 dB). For example, the DI chart 910 indicates that the first ordered pair of virtual microphones has overall good performance (e.g., −10 dB or higher), with ranges of poor performance, such as between 4500-6000 Hz at 30 degrees, 4500-6500 Hz at 90 degrees, 5000-6000 Hz at 200 degrees, and especially between 5000-6000 Hz at 270 degrees.

By simulating each ordered pair of virtual microphones 804, the device 110 may identify the best ordered pair of virtual microphones and/or filter coefficient values corresponding to the best ordered pair for each look direction. For example, the device 110 may select a first ordered pair for a first look direction and a second ordered pair for a second look direction.

To select the best ordered pair of virtual microphones, the device 110 may determine an average DI value across all frequencies, as illustrated in FIG. 9B. As mentioned above, FIG. 9B illustrates an example of an average DI chart 920 that indicates average power values corresponding to look directions for each ordered pair of virtual microphones. For example, FIG. 9B illustrates a first ordered pair (1, 4) (e.g., first virtual microphone 804*a* and fourth virtual microphone 804*d*), a second ordered pair (2, 5) (e.g., second virtual microphone 804*b* and fifth virtual microphone 804*e*), and a third ordered pair (3, 6) (e.g., third virtual microphone 804*c* and sixth virtual microphone 804*f*).

As illustrated in FIG. 9B, the DI chart 920 indicates average DI values (e.g., average power values within a frequency range, measured in dB) along the vertical axis (e.g., y-axis) and beam angles (e.g., look azimuth, measured in degrees) along the horizontal axis (e.g., x-axis). Using the DI chart 920, the device 110 may identify which ordered pair of virtual microphones produces better results for each beam angle. For example, the DI chart 920 indicates that the first ordered pair of virtual microphones has the best performance from 0-80 degrees and 160-260 degrees, the second ordered pair of virtual microphones has the best performance from 100-130 degrees, and the third ordered pair of virtual microphones has the best performance from 80-100 degrees, 130-160 degrees, and 260-360 degrees. Overall, the average power values are relatively strong (e.g., above −2 dB) except for a range of relatively weak power values (e.g., below −2 dB) from 80-130 degrees and from 260-310 degrees, which may be due to the physical configuration of the ordered pairs (e.g., distance between them).

As illustrated in FIG. 9B, the device 110 may identify the best ordered pair of virtual microphones and/or corresponding filter coefficient values based on average values over an entire frequency range. However, the disclosure is not limited thereto and the frequency range may vary. In some examples, the device 110 may identify the best ordered pair of virtual microphones and/or corresponding filter coefficient values based on a specific frequency range without departing from the disclosure. For example, while the DI chart 910 illustrates frequencies ranging from 0 Hz to 8000 Hz, the device 110 may generate the DI chart 920 based on a specific frequency range (e.g., 0 Hz to 5000 Hz or the like).

Additionally or alternatively, the device 110 may generate multiple average DI charts 920, each average DI chart 920 corresponding to a specific frequency range. For example, the device 110 may determine the best ordered pair of virtual microphones and/or corresponding filter coefficient values for each look direction for a first frequency range and separately determine the best ordered pair of virtual microphones and/or corresponding filter coefficient values for each look direction for a second frequency range. Thus, the device 110 may perform first beamforming for a first portion of the input audio data within the first frequency range and may perform second beamforming for a second portion of the input audio data within the second frequency range without departing from the disclosure.

FIG. 9C illustrates an example of a DI chart 930 corresponding to ordered pairs of virtual microphones (e.g., pair index). For example, the DI chart 930 illustrates 18 ordered pairs of virtual microphones, which may correspond to 18 virtual microphones (e.g., every ordered pair combination of 18 virtual microphones) or 36 virtual microphones (e.g., half of the ordered pair combinations for 36 virtual microphones).

In the latter example, the pair index would include ordered pair (1, 19) but not ordered pair (19, 1). Thus, a first pair index may correspond to a first ordered pair (1, 19), a second pair index may correspond to a second ordered pair (2, 20), a third pair index may correspond to a third ordered pair (3, 21), a fourth pair index may correspond to a fourth ordered pair (4, 22), a fifth pair index may correspond to a fifth ordered pair (5, 23), a sixth pair index may correspond to a sixth ordered pair (6, 24), a seventh pair index may correspond to a seventh ordered pair (7, 25), an eighth pair index may correspond to an eighth ordered pair (8, 26), a ninth pair index may correspond to a ninth ordered pair (9, 27), a tenth pair index may correspond to a tenth ordered pair (10, 28), an eleventh pair index may correspond to an eleventh ordered pair (11, 29), a twelfth pair index may correspond to a twelfth ordered pair (12, 30), a thirteenth pair index may correspond to a thirteenth ordered pair (13, 31), a fourteenth pair index may correspond to a fourteenth ordered pair (14, 32), a fifteenth pair index may correspond to a fifteenth ordered pair (15, 33), a sixteenth pair index may correspond to a sixteenth ordered pair (16, 34), a seventeenth pair index may correspond to a seventeenth ordered pair (17, 35), and an eighteenth pair index may correspond to an eighteenth ordered pair (18, 36). While these ordered pairs combine virtual microphones in opposite directions (e.g., 180 degrees apart), the disclosure is not limited thereto and the virtual microphones may be paired using any combination and/or separation without departing from the disclosure. For example, the device 110 may determine every single combination of ordered pairs (e.g., 1260 ordered pairs) using the 36 virtual microphones without departing from the disclosure. Additionally or alternatively, the number of virtual microphones may vary without departing from the disclosure.

As illustrated in FIG. 9C, the DI chart 930 indicates pair index (e.g., ordered pair of virtual microphones) along the vertical axis (e.g., y-axis) and beam angles (e.g., look azimuth, measured in degrees) along the horizontal axis (e.g., x-axis), with an intensity of the DI value (e.g., power value, measured in decibels (dB)) indicated by a color ranging between white (e.g., 0 dB) and black (e.g., −12 dB). For example, the DI chart 930 indicates that the first pair index (e.g., first ordered pair of virtual microphones) has overall good performance (e.g., −2 dB or higher), with ranges of poor performance (e.g., between −2 dB and −5 dB) centered on 150 degrees and 330 degrees. In fact, DI chart 930 indicates that each pair index has poor performance around 150 degrees and 330 degrees, with pair indexes 3-4 having the best performance at these beam angles.

By simulating each ordered pair of virtual microphones, the device 110 may identify the best ordered pair of virtual microphones and/or filter coefficient values corresponding to the best ordered pair for each look direction. For example, the DI chart 930 indicates that pairs 1-17 have good performance at 0 degrees, pairs 1-13 have good performance at 30 degrees, pairs 1-8 have good performance at 60 degrees, pairs 1-5 have good performance at 90 degrees, pairs 4-5 have adequate performance at 120 degrees, pairs 3-4 have adequate performance at 150 degrees, pairs 2-3 have adequate performance at 180 degrees, pairs 1-12 have good performance at 210 degrees, pairs 1-8 have good performance at 240 degrees, pairs 1-7 have good performance at 270 degrees, pairs 1-6 have good performance at 300 degrees, and pairs 3-4 have adequate performance at 330 degrees.

Thus, the device 110 may associate pair index 3 (e.g., third ordered pair (3, 21)) for 0, 30, 150, 180 and 330 degrees, associate pair index 1 (e.g., first ordered pair (1, 19)) for 60, 90, 210, 240, 270, and 300 degrees, and may associate pair index 4 (e.g., fourth ordered pair (4, 22)) for 120 degrees.

While FIG. 8A illustrates the device 110 only including two physical microphones 802, the disclosure is not limited thereto and the device 110 may include a plurality of microphones 812, as illustrated in FIG. 8B. When the device 110 includes a plurality of microphones 812, the device 110 may perform beamforming by identifying virtual microphones 814 and/or filter coefficient values corresponding to the virtual microphones 814 that are associated with each of the plurality of physical microphones 812 for each direction of interest (e.g., beam used during beamforming). Thus, to generate first beamformed audio data corresponding to the first direction, the device 110 may determine six filter coefficient values corresponding to the first direction, one for each of the six physical microphones 812*a*-812*f*.

However, the disclosure is not limited thereto and in some examples, the device 110 may perform beamforming by selecting only some (e.g., two) of the plurality of physical microphones 812 for each direction of interest. For example, the device 110 may select a first pair of physical microphones (e.g., first physical microphone 812*a* and second physical microphone 812*b*) for a first direction of interest and a second pair of physical microphones (e.g., first physical microphone 812*a* and third physical microphone 812*c*) for a second direction of interest. Thus, the device 110 may perform beamforming by identifying virtual microphones 814 and/or filter coefficient values corresponding to the virtual microphones 814 that are associated with each pair of physical microphones 812 for each direction of interest. For example, for the first direction the device 110 may select a first filter coefficient value that is associated with the first physical microphone 812*a* and the first direction and may select a second filter coefficient value that is associated with the second physical microphone 812*b* and the first direction, whereas for the second direction the device 110 may select a third filter coefficient value that is associated with the first physical microphone 812*a* and the second direction and may select a fourth filter coefficient value that is associated with the third physical microphone 812*c* and the second direction.

In some examples, the device 110 may select the two physical microphones 812 based on a distance between the two physical microphones 812 to improve results of beamforming. For example, a first set of physical microphone pairs that are separated by 60 degrees (e.g., first physical microphone 812*a* and second physical microphone 812*b*, second physical microphone 812*b* and third physical microphone 812*c*, etc.) correspond to a first distance, a second set of physical microphone pairs that are separated by 120 degrees (e.g., first physical microphone 812*a* and third physical microphone 812*c*, second physical microphone 812*b* and fourth physical microphone 812*d*, etc.) correspond to a second distance, and a third set of physical microphone pairs that are separated by 180 degrees (e.g., first physical microphone 812*a* and fourth physical microphone 812*d*, second physical microphone 812*b* and fifth physical microphone 812*e*, etc.) correspond to a third distance.

Figure 10:
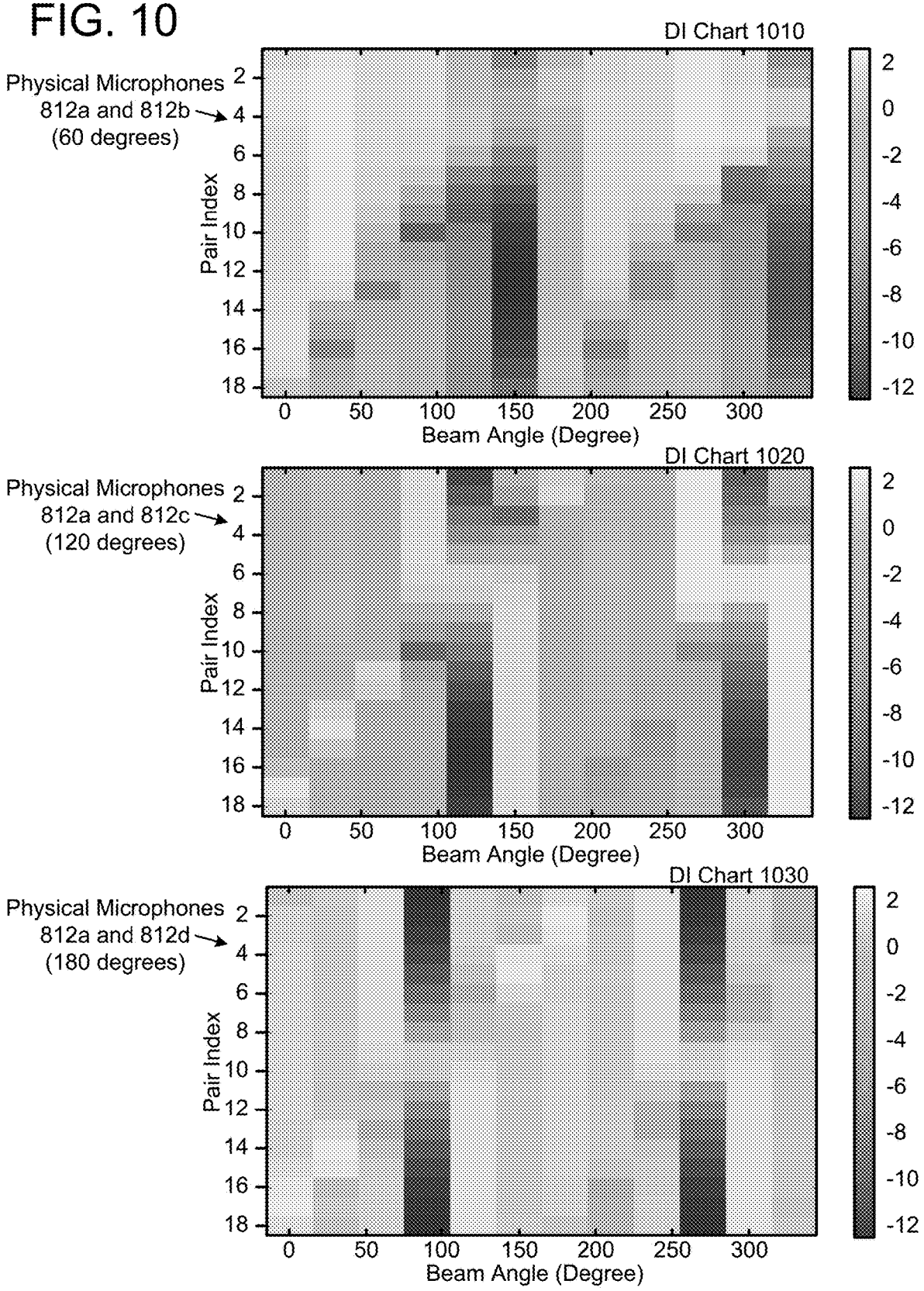
FIG. 10 illustrates examples of power values for pairs of physical microphones at different distances according to embodiments of the present disclosure.

FIG. 10 illustrates examples of power values for pairs of physical microphones at different distances according to embodiments of the present disclosure. For example, DI chart 1010 illustrates power values for one of the first set of physical microphone pairs that are separated by 60 degrees (e.g., first physical microphone 812*a* and second physical microphone 812*b*), which corresponds to a first distance, DI chart 1020 illustrates power values for one of the second set of physical microphone pairs that are separated by 120 degrees (e.g., first physical microphone 812*a* and third physical microphone 812*c*), which corresponds to a second distance, and power values for one of the third set of physical microphone pairs that are separated by 180 degrees (e.g., first physical microphone 812*a* and fourth physical microphone 812*d*), which corresponds to a third distance.

As illustrated in FIG. 10, the DI charts 1010/1020/1030 indicate pair indexes (e.g., ordered pair of virtual microphones) along the vertical axis (e.g., y-axis) and beam angles (e.g., look azimuth, measured in degrees) along the horizontal axis (e.g., x-axis), with an intensity of the DI value (e.g., power value, measured in decibels (dB)) indicated by a color ranging between white (e.g., 0 dB) and black (e.g., −12 dB). For example, the DI chart 1010 indicates that the third pair index (e.g., third ordered pair of virtual microphones (3, 21)) has overall good performance (e.g., −2 dB or higher), with ranges of poor performance (e.g., between −2 dB and −5 dB) centered on 150 degrees and 330 degrees.

As illustrated in DI chart 1010, each pair index has poor performance around 150 degrees and 330 degrees, with pair indexes 3-4 having the best performance at these beam angles. In contrast, DI chart 1020 indicates that each pair index has poor performance around 120 degrees and 300 degrees, with pair indexes 6-7 having the best performance at these beam angles. Finally, DI Chart 1030 indicates that each pair index has poor performance around 90 degrees and 270 degrees, with pair 1-10 having the best performance at these beam angles.

As illustrated in FIG. 10, the first set of physical microphone pairs corresponding to the first distance have poor results at 150 degrees, the second set of physical microphone pairs corresponding to the second distance have poor results at 120 degrees, and the third set of physical microphone pairs corresponding to the third distance have poor results at 90 degrees. Thus, the device 110 may select from the first or second set of physical microphone pairs for directions of interest around 90 degrees, may select from the first or third set of physical microphone pairs for directions of interest around 120 degrees, and may select from the second or third set of physical microphone pairs for directions of interest around 150 degrees.

To illustrate an example of beamforming using different physical microphones based on direction of interest, the device 110 may select a first direction of interest. Based on the first direction of interest, the device 110 may determine a first physical microphone pair associated with the first direction (e.g., first physical microphone 812*a* and second physical microphone 812*b*), may determine a first pair of virtual microphones and/or corresponding filter coefficient values associated with the first physical microphone pair and the first direction (e.g., first filter coefficient value corresponding to the $3^{rd}$ virtual microphone is associated with the first physical microphone 812*a* and the first direction, whereas second filter coefficient value corresponding to the $21^{st}$ virtual microphone is associated with the second physical microphone 812*b* and the first direction), and may generate first beamformed audio data corresponding to the first direction. For example, the device 110 may apply the first filter coefficient value to first audio data captured by the first physical microphone 812*a* and may apply the second filter coefficient value to second audio data captured by the second physical microphone 812*b*.

While FIGS. 9A-9C and 10 illustrate power values corresponding to a directivity index (DI) value, the disclosure is not limited thereto. Instead, the power values may be determined using any technique known to one of skill in the art, such as determining a white noise gain (WNG) value or the like.

Figure 11:
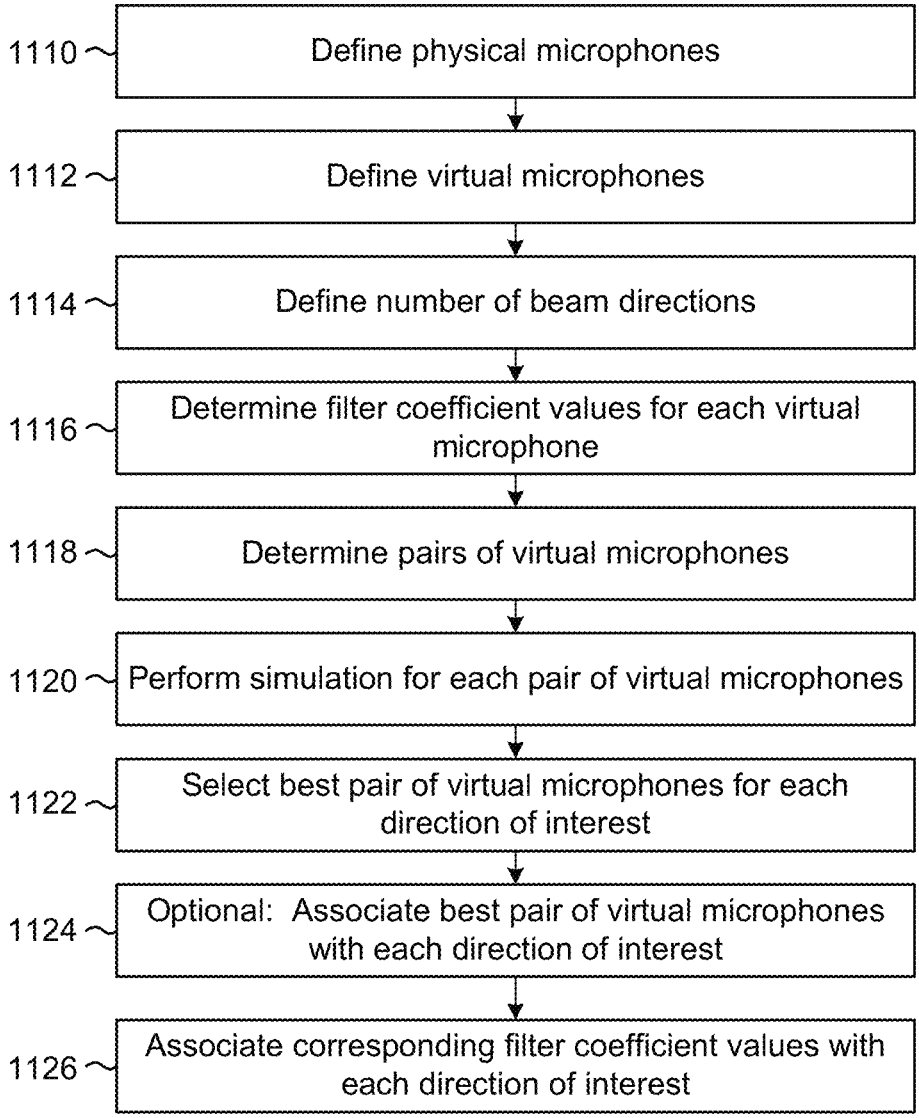
FIG. 11 is a flowchart conceptually illustrating an example method for determining filter coefficient values for each direction of interest according to embodiments of the present disclosure.

FIG. 11 is a flowchart conceptually illustrating an example method for determining filter coefficient values for each direction of interest according to embodiments of the present disclosure. As illustrated in FIG. 11, the system 100 may define (1110) physical microphones, define (1112) virtual microphones, define (1114) a number of beam directions, and determine (1116) filter coefficient values for each virtual microphone.

In step 1110, the system 100 may define a number of physical microphones included in the microphone array 114 and/or how many physical microphones to select at a time. For example, the microphone array 114 may include a plurality of microphones but the system 100 may select only two microphones at a time, so each simulation will be performed with only two of the physical microphones selected.

In step 1112, the number of virtual microphones may vary without departing from the disclosure, but the system 100 may define a particular number of virtual microphones in order to perform the simulations. For example, the system 100 may select a number of virtual microphones (e.g., 12, 18, 24, 36, etc.), with a higher number of virtual microphones increasing a number of simulations to perform by the system 100.

In step 1114, the system 100 may select a number of beam directions (e.g., 6, 12, 36, etc.), with the number of beam directions corresponding to an angle per beam. For example, six beam directions corresponds to an angle of 60 degrees per beam direction, whereas twelve beam directions corresponds to an angle of 30 degrees per beam direction, and 36 beam directions corresponds to an angle of 10 degrees per beam direction. Thus, a higher number of beam directions increases a number of simulations to perform by the system 100 but also increases an accuracy of beamforming. Additionally or alternatively, the number of beam directions may vary without departing from the disclosure and the system 100 may determine the best filter coefficient values for two or more different numbers of beam directions without departing from the disclosure. For example, the system 100 may select 12 beam directions (e.g., 30 degrees per beam direction) and perform first simulations to determine the best filter coefficient values for each of the 12 beam directions, and then select 36 beam directions (e.g., 10 degrees per beam direction) and perform second simulations to determine the best filter coefficient values for each of the 36 beam directions. Thus, the system 100 may store the best filter coefficient values for both 12 beam directions and 36 beam directions, enabling the device 110 to select between 12 beam directions or 36 beam directions during run-time processing.

In step 1116, the filter coefficient values for each virtual microphone are determined based on the number of virtual microphones and the number of beam directions. For example, the number of virtual microphones dictates a position for each of the virtual microphones and the number of beam directions impacts the filter coefficient value determined based on a position of an individual virtual microphone. The filter coefficient values may be determined using minimum variance distortionless response (MVDR) beamformer techniques, Linearly Constrained Minimum Variance (LCMV) beamformer techniques, and/or generalized eigenvalue (GEV) beamformer techniques, although the disclosure is not limited thereto and the filter coefficient values may be determined using any technique known to one of skill in the art without departing from the disclosure.

After defining the physical microphones (e.g., selecting two physical microphones), defining the virtual microphones (e.g., determining a number of virtual microphones and corresponding positions for each virtual microphone), defining the number of beam directions (e.g., determining how many directions of interest to simulate), and determining the filter coefficient values for each virtual microphone, the system 100 may determine (1118) pairs of virtual microphones. For example, the system 100 may generate ordered pairs of the virtual microphones and may perform simulations for each of the ordered pairs, for half of the ordered pairs (e.g., first ordered pair (1, 19) but not second ordered pair (19, 1)), a portion of the ordered pairs, and/or any combination thereof.

As discussed above, the system 100 may generate the ordered pairs based on a specific configuration of the virtual microphones, such as selecting virtual microphones that are opposite each other (e.g., 180 degrees apart). For example, when the system 100 selects 36 virtual microphones, a first ordered pair (1, 19) may correspond to a first virtual microphone and a nineteenth virtual microphone that is opposite (e.g., 180 degrees from) the first virtual microphone, a second ordered pair (2, 20) may correspond to a second virtual microphone and a twentieth virtual microphone that is opposite the second virtual microphone, etc. However, the disclosure is not limited thereto and the system 100 may generate pairs of virtual microphones having any configuration without departing from the disclosure. For example, the system 100 may determine an ordered pair (1, 4) that corresponds to the first virtual microphone and a fourth virtual microphone (e.g., offset by 30 degrees), an ordered pair (1, 7) that corresponds to the first virtual microphone and a seventh virtual microphone (e.g., offset by 60 degrees), an ordered pair (1, 10) that corresponds to the first virtual microphone and a tenth virtual microphone (e.g., offset by 90 degrees), an ordered pair (1, 28) that corresponds to the first virtual microphone and a twenty-eighth virtual microphone (e.g., offset by 270 degrees), and/or the like without departing from the disclosure.

While step 1118 illustrates an example of the system 100 selecting pairs of virtual microphones, this corresponds to two physical microphones and the disclosure is not limited thereto. Instead, the system 100 may define three or more physical microphones in step 1110 and the system 100 may therefore selecting combinations of three or more virtual microphones without departing from the disclosure. Thus, one of skill in the art may apply the techniques illustrated in FIG. 11 and other figures to determine filter coefficient values associated with virtual microphones for three or more physical microphones without departing from the disclosure.

After determining the pairs of virtual microphones in step 1118, the system 100 may perform (1120) a simulation for each pair of virtual microphones and select (1122) a best pair of virtual microphones for each direction of interest. For example, the system 100 may perform a simulation for a first pair of virtual microphones (e.g., first ordered pair (1, 19)) and determine directivity index (DI) values across frequencies and look directions, as illustrated in FIG. 9A. Based on the DI values, the system 100 may determine an average DI value within a desired frequency range for each look direction and may compare different pairs of virtual microphones based on the average DI values. The system 100 may identify the best average DI values (e.g., power values) for a specific look direction and determine the pair of virtual microphones corresponding to the best average DI values. While the example illustrated above uses DI values, the disclosure is not limited thereto and one of skill in the art may use other power values (e.g., white noise gain (WNG) values, etc.) without departing from the disclosure.

In some examples, there may be multiple power values that are similar to each other, and the system 100 may select a pair of virtual microphones based on other considerations and/or criteria in addition to the power values in a specific direction of interest, such as power values across multiple directions of interest or the like. For example, a first pair of virtual microphones may perform well across a wide range of look directions (e.g., have high power values from 0 degrees to 100 degrees), whereas a second pair of virtual microphones may perform extremely well in a narrow range of look directions (e.g., have high power values from 0 degrees to 30 degrees) but have weak performance in other directions (e.g., have low power values from 30 degrees to 100 degrees). Thus, instead of selecting the second pair of virtual microphones from 0 degrees to 30 degrees (e.g., as the second pair outperforms the first pair within this range) and selecting the first pair of virtual microphones from 30 degrees to 100 degrees, the system 100 may instead select the first pair of virtual microphones from 0 degrees to 100 degrees (e.g., despite the first pair of virtual microphones not having the highest power values between 0-30 degrees).

The system 100 may optionally associate (1124) the best pair of virtual microphones with each direction of interest and may associate (1126) corresponding filter coefficient values with each direction of interest. Thus, in some examples the system 100 may store an association between a first pair of virtual microphones and a first direction of interest, while in other examples the system 100 may store an association between a first pair of filter coefficient values and the first direction of interest. Additionally or alternatively, the system 100 may store an association between the first pair of virtual microphones, the first pair of filter coefficient values, and the first direction of interest without departing from the disclosure.

Depending on which association is stored, the device 110 may retrieve the filter coefficient values associated with a specific direction of interest using a different technique. For example, if the first pair of filter coefficient values are associated with the first direction of interest, the system 100 may retrieve the first pair of filter coefficient values associated with the first direction of interest and perform beamforming by applying the first pair of filter coefficient values to the input audio data received from the physical microphones. However, if the first pair of virtual microphones are associated with the first direction of interest (e.g., instead of actual filter coefficient values), the system 100 may identify the first pair of virtual microphones, determine the filter coefficient values associated with the first pair of virtual microphones and the first direction of interest, and perform beamforming by applying the filter coefficient values to the input audio data received from the physical microphones.

Figure 12:
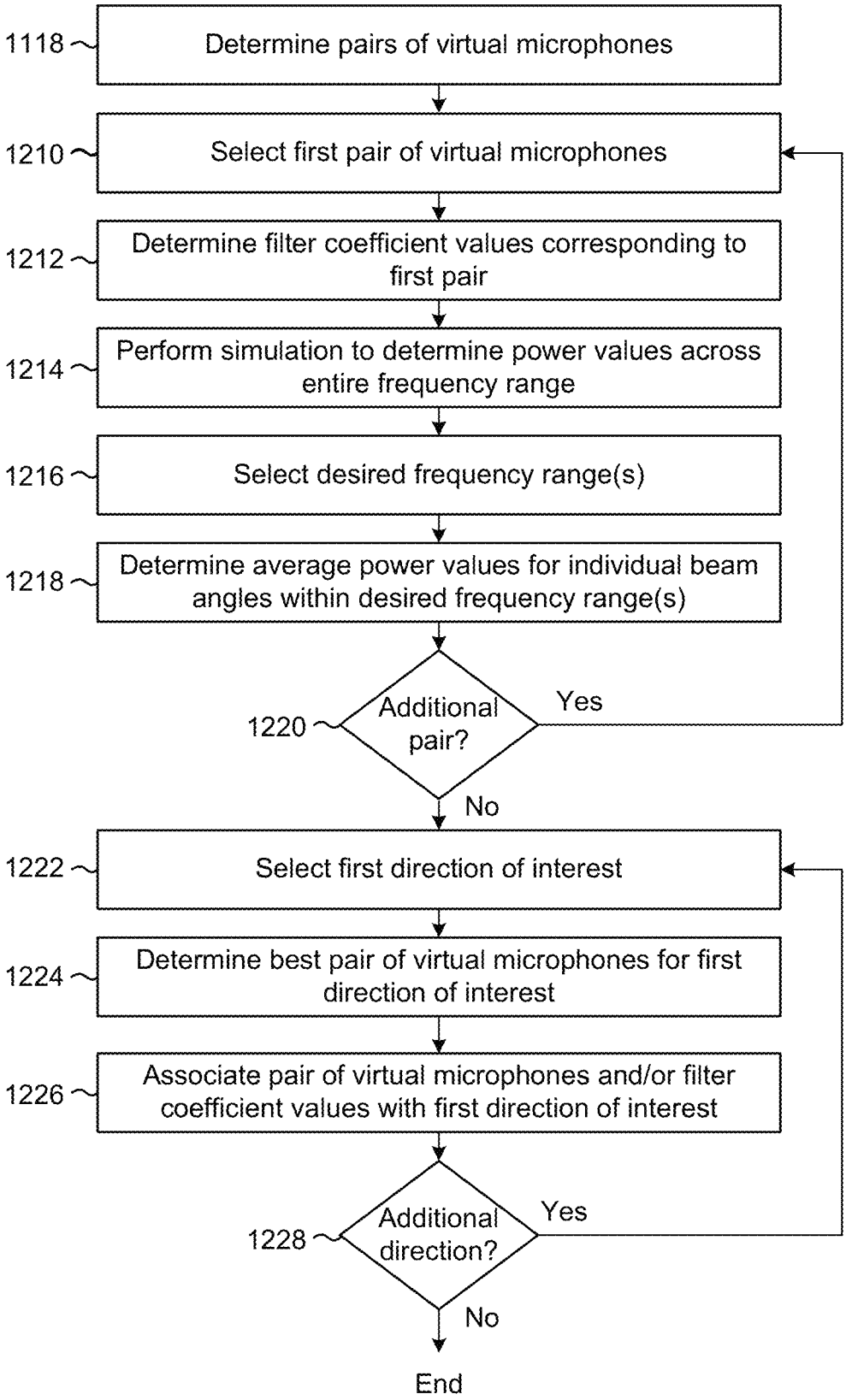
FIG. 12 is a flowchart conceptually illustrating an example method for determining filter coefficient values for each direction of interest according to embodiments of the present disclosure.

FIG. 12 is a flowchart conceptually illustrating an example method for determining filter coefficient values for each direction of interest according to embodiments of the present disclosure. FIG. 12 illustrates additional details associated with performing simulations to determine the best filter coefficient values and associating the filter coefficient values with each direction of interest, as described above with regard to steps 1120-1126.

As illustrated in FIG. 12, the system 100 may determine (1118) pairs of virtual microphones as described above. After determining the pairs of virtual microphones in step 1118 (and defining other characteristics in steps 1110-1116), the system 100 may perform a simulation for each pair of virtual microphones. For example, the system 100 may select (1210) a first pair of virtual microphones, determine (1212) filter coefficient values corresponding to the first pair of virtual microphones, and perform a simulation to determine power values across an entire frequency range. For example, the system 100 may perform the simulation and determine power values (e.g., directivity index (DI) values) corresponding to each look direction across the frequency range, as illustrated in FIG. 9A.

The system 100 may select (1216) desired frequency range(s) and determine (1218) average power values for individual beam angles within the desired frequency range(s). For example, the system 100 may select a single frequency range (e.g., 0 Hz to 5000 Hz) and determine average power values within the frequency range for each direction of interest. Alternatively, the system 100 may select two or more frequency ranges (e.g., select a first frequency range of 0 Hz to 5000 Hz and a second frequency range of 5000 Hz to 8000 Hz) and determine first average power values within the first frequency range for each direction of interest and second average power values within the second frequency range for each direction of interest. Thus, the system 100 is capable of determining the best filter coefficient values for individual frequency ranges (e.g., frequency bands or subband processing) to further improve the beamformed audio data generated during beamforming.

The system 100 may determine (1220) if there is an additional pair of virtual microphones and, if so, may loop to step 1210 and repeat steps 1210-1218 for the additional pair of virtual microphones. If there are no additional pairs of virtual microphones, the system 100 may proceed to steps 1222-1226 to determine the best filter coefficient values for each direction of interest.

The system 100 may select (1222) a first direction of interest and may determine (1224) a best pair of virtual microphones for the first direction of interest. For example, the system 100 may determine the best power values associated with the first direction of interest and identify the pair of virtual microphones corresponding to the best power values. In some examples, there may be multiple power values that are similar to each other, and the system 100 may select a pair of virtual microphones based on other considerations and/or criteria in addition to the power values in a specific direction of interest, such as power values across multiple directions of interest or the like. For example, a first pair of virtual microphones may perform well across a wide range of look directions (e.g., have high power values from 0 degrees to 100 degrees), whereas a second pair of virtual microphones may perform extremely well in a narrow range of look directions (e.g., have high power values from 0 degrees to 30 degrees) but have weak performance in other directions (e.g., have low power values from 30 degrees to 100 degrees). Thus, instead of selecting the second pair of virtual microphones from 0 degrees to 30 degrees (e.g., as the second pair outperforms the first pair within this range) and selecting the first pair of virtual microphones from 30 degrees to 100 degrees, the system 100 may instead select the first pair of virtual microphones from 0 degrees to 100 degrees (e.g., despite the first pair of virtual microphones not having the highest power values between 0-30 degrees).

The system 100 may associate (1226) the selected pair of virtual microphones and/or corresponding filter coefficient values with the first direction of interest. Thus, the system 100 may store an association between a first pair of virtual microphones and a first direction of interest, an association between a first pair of filter coefficient values and the first direction of interest, and/or an associate between the first pair of virtual microphones and the first direction of interest along with an association between the first pair of filter coefficient values and the first direction of interest.

Depending on which association is stored, the device 110 may retrieve the filter coefficient values associated with a specific direction of interest using a different technique. For example, if the first pair of filter coefficient values are associated with the first direction of interest, the system 100 may retrieve the first pair of filter coefficient values associated with the first direction of interest and perform beamforming by applying the first pair of filter coefficient values to the input audio data received from the physical microphones. However, if the first pair of virtual microphones are associated with the first direction of interest (e.g., instead of actual filter coefficient values), the system 100 may identify the first pair of virtual microphones, determine the filter coefficient values associated with the first pair of virtual microphones and the first direction of interest, and perform beamforming by applying the filter coefficient values to the input audio data received from the physical microphones.

The system 100 may determine (1228) if there is an additional direction of interest and, if so, may loop to step 1222 and repeat steps 1222-1226 for the additional direction of interest. If there are no additional directions of interest, the system 100 may end processing as virtual microphones and/or filter coefficient values have been associated with each direction of interest. The system 100 may repeat the steps illustrated in FIGS. 11 and 12 to determine filter coefficient values for a different number of physical microphones, virtual microphones, and/or look directions without departing from the disclosure.

Figure 13A:
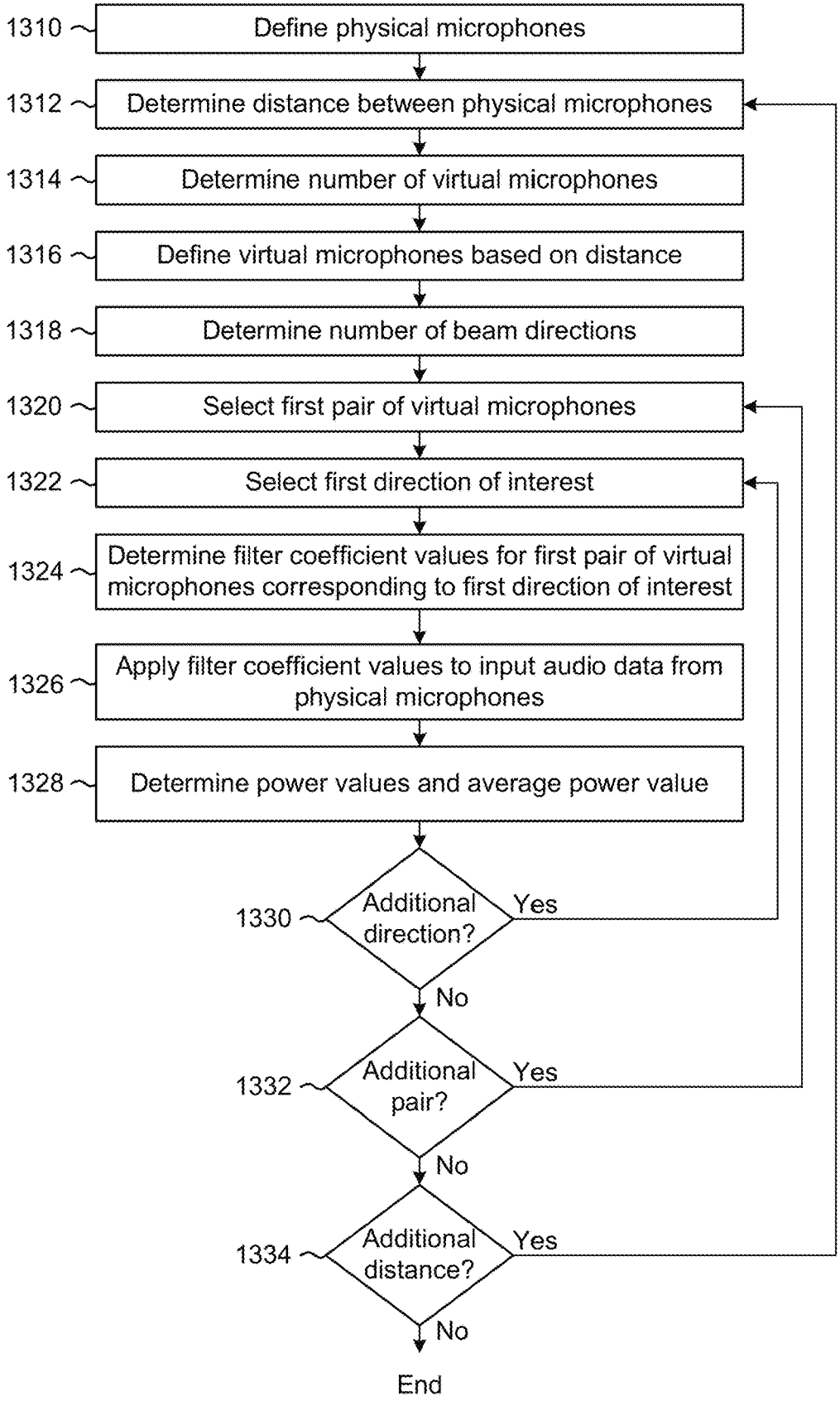
FIGS. 13A-13B are flowcharts conceptually illustrating example methods for determining physical microphones and filter coefficient values for each direction of interest according to embodiments of the present disclosure.
Figure 13B:
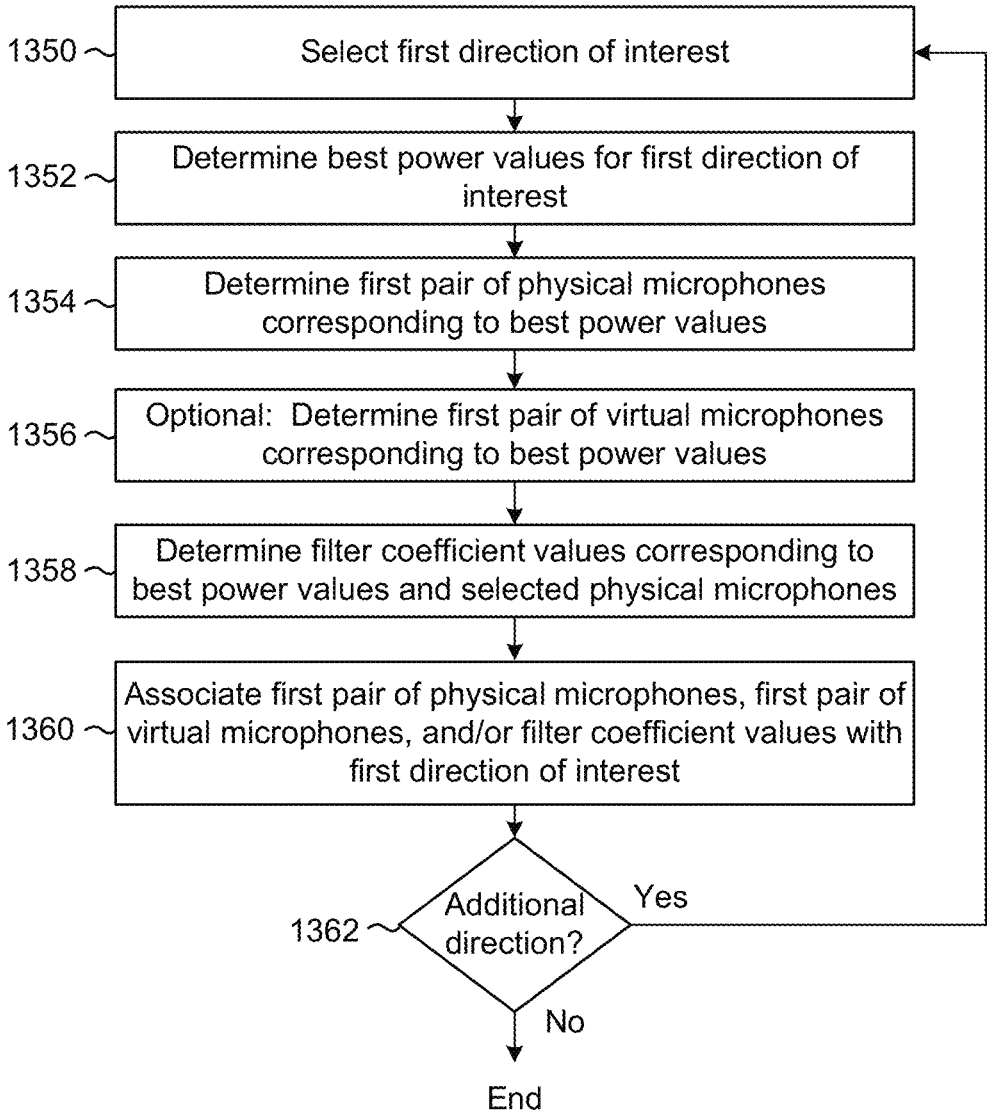

FIGS. 13A-13B are flowcharts conceptually illustrating example methods for determining physical microphones and filter coefficient values for each direction of interest according to embodiments of the present disclosure. As illustrated in FIG. 13A, the system 100 may define (1310) physical microphones and determine (1312) a distance between the physical microphones. For example, the system 100 may determine a number of physical microphones included in the microphone array 114 and/or how many physical microphones to select at a time. In some examples, the microphone array 114 may include a plurality of microphones but the system 100 may select only two microphones at a time, so each simulation will be performed with only two of the physical microphones selected. For example, the system 100 may select two physical microphones in the microphone array and may determine the distance between them.

The system 100 may determine (1314) a number of virtual microphones and define (1316) virtual microphones based on the distance. For example, the system 100 may determine a radius based on the distance and may define the virtual microphones in a circle using the radius. The number of virtual microphones may vary without departing from the disclosure, but the system 100 may define a particular number of virtual microphones in order to perform the simulations. For example, the system 100 may select a number of virtual microphones (e.g., 12, 18, 24, 36, etc.), with a higher number of virtual microphones increasing a number of simulations to perform by the system 100.

The system 100 may determine (1318) a number of beam directions (e.g., 6, 12, 36, etc.), with the number of beam directions corresponding to an angle per beam. For example, six beam directions corresponds to an angle of 60 degrees per beam direction, whereas twelve beam directions corresponds to an angle of 30 degrees per beam direction, and 36 beam directions corresponds to an angle of 10 degrees per beam direction. Thus, a higher number of beam directions increases a number of simulations to perform by the system 100 but also increases an accuracy of beamforming. Additionally or alternatively, the number of beam directions may vary without departing from the disclosure and the system 100 may determine the best filter coefficient values for two or more different numbers of beam directions without departing from the disclosure. For example, the system 100 may select 12 beam directions (e.g., 30 degrees per beam direction) and perform first simulations to determine the best filter coefficient values for each of the 12 beam directions, and then select 36 beam directions (e.g., 10 degrees per beam direction) and perform second simulations to determine the best filter coefficient values for each of the 36 beam directions. Thus, the system 100 may store the best filter coefficient values for both 12 beam directions and 36 beam directions, enabling the device 110 to select between 12 beam directions or 36 beam directions during run-time processing.

The system 100 may select (1320) a pair of virtual microphones on which to perform simulations. For example, the system 100 may generate ordered pairs of the virtual microphones and may perform simulations for each of the ordered pairs, for half of the ordered pairs (e.g., first ordered pair (1, 19) but not second ordered pair (19, 1)), a portion of the ordered pairs, and/or any combination thereof.

As discussed above, the system 100 may generate the ordered pairs based on a specific configuration of the virtual microphones, such as selecting virtual microphones that are opposite each other (e.g., 180 degrees apart). For example, when the system 100 selects 36 virtual microphones, a first ordered pair (1, 19) may correspond to a first virtual microphone and a nineteenth virtual microphone that is opposite (e.g., 180 degrees from) the first virtual microphone, a second ordered pair (2, 20) may correspond to a second virtual microphone and a twentieth virtual microphone that is opposite the second virtual microphone, etc. However, the disclosure is not limited thereto and the system 100 may generate pairs of virtual microphones having any configuration without departing from the disclosure. For example, the system 100 may determine an ordered pair (1, 4) that corresponds to the first virtual microphone and a fourth virtual microphone (e.g., offset by 30 degrees), an ordered pair (1, 7) that corresponds to the first virtual microphone and a seventh virtual microphone (e.g., offset by 60 degrees), an ordered pair (1, 10) that corresponds to the first virtual microphone and a tenth virtual microphone (e.g., offset by 90 degrees), an ordered pair (1, 28) that corresponds to the first virtual microphone and a twenty-eighth virtual microphone (e.g., offset by 270 degrees), and/or the like without departing from the disclosure.

While step 1320 illustrates an example of the system 100 selecting a pair of virtual microphones, this corresponds to two physical microphones and the disclosure is not limited thereto. Instead, the system 100 may define three or more physical microphones and the system 100 may therefore selecting combinations of three or more virtual microphones without departing from the disclosure. Thus, one of skill in the art may apply the techniques illustrated in FIG. 13A and other figures to determine filter coefficient values associated with virtual microphones for three or more physical microphones without departing from the disclosure.

The system 100 may select (1322) a first direction of interest and may determine (1324) filter coefficient values for the first pair of virtual microphones corresponding to the first direction of interest. The filter coefficient values for each virtual microphone are determined based on the number of virtual microphones and the number of beam directions. For example, the number of virtual microphones dictates a position for each of the virtual microphones and the number of beam directions impacts the filter coefficient value determined based on a position of an individual virtual microphone. The filter coefficient values may be determined using minimum variance distortionless response (MVDR) beamformer techniques, Linearly Constrained Minimum Variance (LCMV) beamformer techniques, and/or generalized eigenvalue (GEV) beamformer techniques, although the disclosure is not limited thereto and the filter coefficient values may be determined using any technique known to one of skill in the art without departing from the disclosure.

The system 100 may apply (1326) the filter coefficient values to input audio data from the physical microphones and may determine (1328) power values and an average power value within a desired frequency range. For example, the system 100 may perform a simulation for a first pair of virtual microphones (e.g., first ordered pair (1, 19)) and determine directivity index (DI) values across frequencies and look directions, as illustrated in FIG. 9A. Based on the DI values, the system 100 may determine an average DI value within a desired frequency range for the first direction of interest.

The system 100 may determine (1330) if there is an additional direction of interest and, if so, may loop to step 1322 and repeat steps 1322-1328 for the additional direction of interest.

If there are no additional directions of interest, the system 100 may determine (1332) if there is an additional pair of virtual microphones and, if so, may loop to step 1320 and repeat steps 1320-1330 for the additional pair of virtual microphones.

If there are no additional pairs of virtual microphones, the system 100 may determine (1334) if there is an additional distance between physical microphones (e.g., can the system 100 select two physical microphones from the microphone array that have a different distance). If so, the system 100 may loop to step 1312 and repeat steps 1312-1332 for the additional distance (e.g., additional pair of physical microphones). If there isn't an additional distance to simulate (e.g., there are no additional pairs of physical microphones), the system 100 may end the simulation process as each combination of physical microphones, virtual microphones and direction of interest have been simulated.

To determine the best filter coefficient values for each direction of interest, the system 100 may perform the steps illustrated in FIG. 13B. As illustrated in FIG. 13B, the system 100 may select (1350) a first direction of interest and may determine (1352) best power values associated with the first direction of interest. For example, the system 100 may identify the best average DI values (e.g., power values) for the first direction of interest, although the disclosure is not limited thereto and one of skill in the art may use other power values (e.g., white noise gain (WNG) values, etc.) without departing from the disclosure.

The system 100 may determine (1354) a first pair of physical microphones corresponding to the best power values, may optionally determine (1356) a first pair of virtual microphones corresponding to the best power values and the selected physical microphones, and may determine (1358) filter coefficient values corresponding to the best power values and the selected physical microphones.

In some examples, there may be multiple power values that are similar to each other, and the system 100 may select the best power values based on other considerations and/or criteria in addition to the power values in the first direction of interest, such as power values across multiple directions of interest or the like. For example, a first pair of virtual microphones may perform well across a wide range of look directions (e.g., have high power values from 0 degrees to 100 degrees), whereas a second pair of virtual microphones may perform extremely well in a narrow range of look directions (e.g., have high power values from 0 degrees to 30 degrees) but have weak performance in other directions (e.g., have low power values from 30 degrees to 100 degrees). Thus, instead of selecting the second pair of virtual microphones from 0 degrees to 30 degrees (e.g., as the second pair outperforms the first pair within this range) and selecting the first pair of virtual microphones from 30 degrees to 100 degrees, the system 100 may instead select the first pair of virtual microphones from 0 degrees to 100 degrees (e.g., despite the first pair of virtual microphones not having the highest power values between 0-30 degrees).

Additionally or alternatively, the same processing may be applied based on pairs of physical microphones, such that the system 100 may select a first pair of physical microphones due to strong performance across a number of directions of interest despite a second pair of physical microphones outperforming the first pair of physical microphones in a narrow range.

The system 100 may associate (1360) the first pair of physical microphones, the first pair of virtual microphones, and/or the filter coefficient values corresponding to the pair of virtual microphones with the first direction of interest. Thus, the system 100 may store an association between a first pair of physical microphones and a first direction of interest, an association between a first pair of virtual microphones and the first direction of interest, an association between a first pair of filter coefficient values and the first direction of interest, and/or a combination thereof without departing from the disclosure. For example, in some examples the system 100 may store an association between the first pair of physical microphones, the filter coefficients, and the first direction of interest, whereas in other examples the system 100 may store an association between the first pair of physical microphones, the first pair of virtual microphones, and the first direction of interest.

Depending on which association is stored, the device 110 may retrieve the filter coefficient values associated with a specific direction of interest using a different technique. For example, if the first pair of filter coefficient values are associated with the first direction of interest, the system 100 may retrieve the first pair of filter coefficient values associated with the first direction of interest and perform beamforming by applying the first pair of filter coefficient values to the input audio data received from the physical microphones. However, if the first pair of virtual microphones are associated with the first direction of interest (e.g., instead of actual filter coefficient values), the system 100 may identify the first pair of virtual microphones, determine the filter coefficient values associated with the first pair of virtual microphones and the first direction of interest, and perform beamforming by applying the filter coefficient values to the input audio data received from the physical microphones.

The system 100 may determine (1362) if there is an additional direction of interest and, if so, may loop to step 1350 and repeat steps 1350-1360 for the additional direction of interest. If there are no additional directions of interest, the system 100 may end processing as physical microphones, virtual microphones and/or filter coefficient values have been associated with each direction of interest. The system 100 may repeat the steps illustrated in FIGS. 13A-13B to determine filter coefficient values for a different number of physical microphones, virtual microphones, and/or look directions without departing from the disclosure.

The steps illustrated in FIGS. 11-13B may be performed offline and the filter coefficient values and/or associations may be stored in the device 110 for run-time processing (e.g., beamforming). While the device 110 may be configured to perform the steps illustrated in FIGS. 11-13B, these steps may instead be performed by a remote device, such as remote server(s) associated with the system 100. Therefore, the description of FIGS. 11, 12, and 13A-13B refer to the system 100 performing the steps illustrated. In contrast, FIG. 14 illustrates steps that may be performed during run-time processing to perform beamforming, so the following description refers to the device 110 performing the steps illustrated in FIG. 14.

Figure 14:
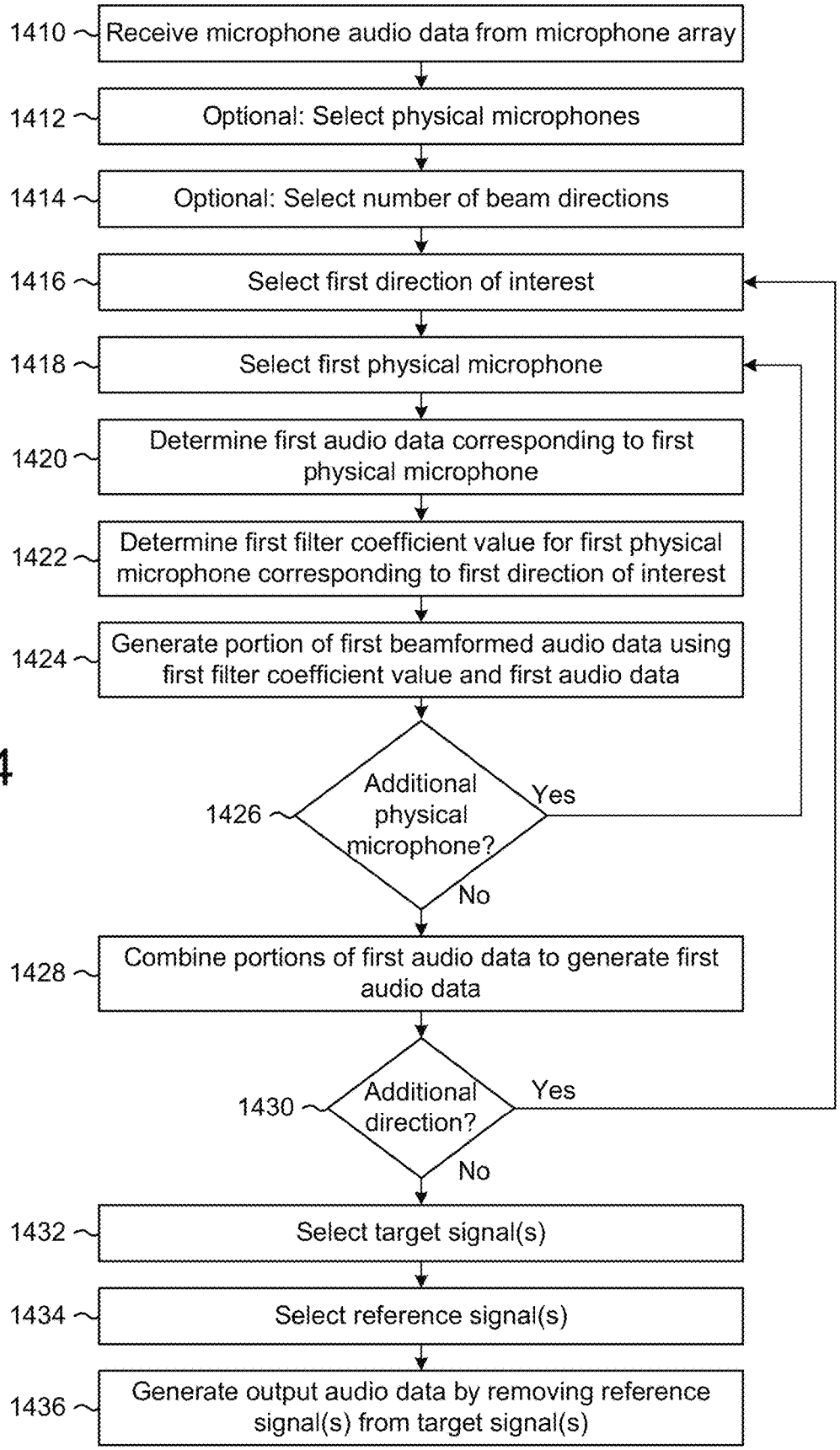
FIG. 14 is a flowchart conceptually illustrating an example method for identifying filter coefficient values and generating beamformed audio data according to embodiments of the present disclosure.

FIG. 14 is a flowchart conceptually illustrating an example method for identifying filter coefficient values and generating beamformed audio data according to embodiments of the present disclosure. As illustrated in FIG. 14, the device 110 may receive (1410) microphone audio data from the microphone array 114, may optionally select (1412) physical microphones, and may optionally (1414) select a number of beam directions. For example, the device 110 may be configured to select two physical microphones from a plurality of microphones included in the microphone array. However, the disclosure is not limited thereto, and the microphone array may only include two physical microphones and/or the device 110 may select three or more microphones from the microphone array 114. Additionally or alternatively, the device 110 may select a specific number of beam directions (e.g., 6, 12, 24, 36, etc.) in step 1414, but the disclosure is not limited thereto and the device 110 may automatically select the same number of beam directions each time the device 110 performs beamforming.

The device 110 may select (1416) a first direction of interest, select (1418) a first physical microphone, determine (1420) first audio data corresponding to the first physical microphone, determine (1422) a first filter coefficient value associated with the first physical microphone corresponding to the first direction of interest, and may generate (1424) a portion of first beamformed audio data using the first filter coefficient value and the first audio data. For example, the device 110 may retrieve the first filter coefficient value from a lookup table, association table, database, and/or the like, wherein the first filter coefficient value was calculated previously (e.g., offline) based on a virtual microphone and associated with the first physical microphone and the first direction of interest.

In some examples, the device 110 may store specific filter coefficient values and associate each filter coefficient value with a physical microphone and a directions of interest. For example, if the device 110 associates the first filter coefficient value with the first physical microphone and the first direction of interest, the device 110 may retrieve the first filter coefficient value associated with the first direction of interest and perform beamforming by applying the first filter coefficient value to the first audio data received from the first physical microphone. However, the disclosure is not limited thereto and the device 110 may instead associate the first virtual microphone with the first physical microphone and the first direction of interest. In this example, the device 110 may store filter coefficient values associated with the first virtual microphone for each direction of interest. Thus, the device 110 may determine that the first physical microphone and the first direction of interest are associated with the first virtual microphone, may retrieve the first filter coefficient value associated with the first virtual microphone and the first direction of interest, and perform beamforming by applying the first filter coefficient value to the first audio data received from the first physical microphone. Thus, one of skill in the art may determine the filter coefficient value using different techniques without departing from the disclosure.

The device 110 may determine (1426) if there is an additional physical microphone and, if so, may loop to step 1418 and repeat steps 1418-1424 for the additional physical microphone. If there are no additional physical microphones, the device 110 may combine (1428) portions of the first audio data generated in step 1424 to generate the first audio data (e.g., beamformed audio data corresponding to the first direction of interest).

The device 110 may determine (1430) if there is an additional direction of interest and, if so, may loop to step 1416 and repeat steps 1416-1428 for the additional direction of interest.

If there are no additional directions of interest, the device 110 may select (1432) target signal(s), may select (1434) reference signal(s), and may generate (1436) output audio data by subtracting the reference signal(s) from the target signal(s). For example, the device 110 may perform ARA algorithm processing to isolate speech associated with a particular direction of interest (e.g., desired speech in a first direction) by subtracting acoustic noise (e.g., an echo signal, undesired speech, ambient noise, etc.) from other directions.

While FIG. 14 illustrates the device 110 performing steps 1432-1436 to perform acoustic interference cancellation (AIC) processing after beamforming, the disclosure is not limited thereto. Instead, the device 110 may perform steps 1410-1430 to perform beamforming and may use the beamformed audio data generated by the beamforming without performing AIC processing. For example, the beamformed audio data may be sent to other components of the device 110 and/or to remote devices without departing from the disclosure.

While FIGS. 8A-8B illustrate the device 110 generating virtual microphones in a circular configuration (e.g., in a circle using the same radius as the physical microphones), the disclosure is not limited thereto. Instead, the device 110 may generate virtual microphones using any configuration known to one of skill in the art without departing from the disclosure. For example, the device 110 may generate virtual microphones in geometric shapes (e.g., circle, square, rectangle, etc.), may generate virtual microphones covering an entire surface of the device 110, and/or may generate multiple virtual microphone configurations without departing from the disclosure.

Figure 15:
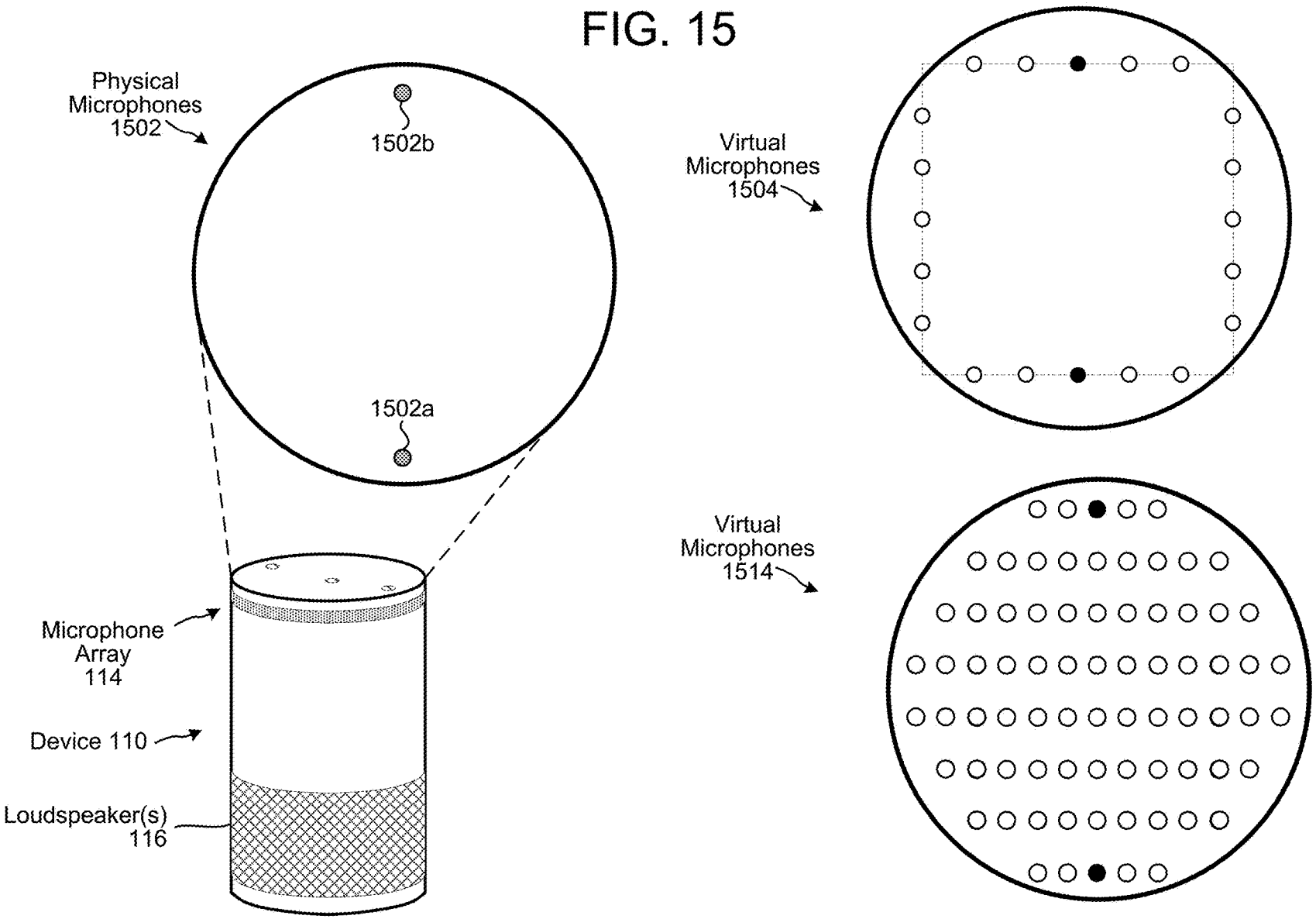
FIG. 15 illustrates examples of virtual microphone configurations according to embodiments of the present disclosure.

FIG. 15 illustrates examples of virtual microphone configurations according to embodiments of the present disclosure. As illustrated in FIG. 15, the device 110 may generate virtual microphones 1504 in a square configuration, with the virtual microphones 1504 spaced based on a distance between the physical microphones 1502. However, the disclosure is not limited thereto and the square can be larger or smaller than the distance between the physical microphones 1502 without departing from the disclosure.

FIG. 15 also illustrates an example of virtual microphones 1514 that cover a large portion of a surface of the device 110. Thus, instead of aligning the virtual microphones in a specific geometric shape or orientation, the device 110 may use any potential position for a virtual microphone in order to improve the filter coefficient values for the physical microphones 1502. While this configuration requires additional processing to determine the optimal virtual microphones for each direction of interest, this processing may be performed offline and the device 110 may store the filter coefficient values based on results of the offline processing.

While FIG. 15 illustrates a number of different virtual microphones 1504/1514, the determination of which virtual microphone is best for a particular direction of interest may be performed offline by a remote device. Thus, while FIG. 15 illustrates a number of possible positions for the virtual microphones, the offline processing may identify only a select number of virtual microphone positions to use when performing beamforming. Thus, the device 110 may not store filter coefficient values for each of the virtual microphones illustrated in FIG. 15, but may instead store filter coefficient values for the selected virtual microphones having the best performance.

While many of the virtual microphones 1504/1514 are located at a position without a physical microphone, and are thus illustrated in FIG. 15 using a white circle, some virtual microphones 1504/1514 may share a position with the physical microphones 1502 and are thus illustrated using a black circle. For example, the first physical microphone 1502*a* shares a first position on the device 110 with a first virtual microphone of the virtual microphones 1504/1514 and the second physical microphone 1502*b* shares a second position on the device 110 with a second virtual microphone of the virtual microphones 1504/1514.

As the first physical microphone 1502*a* and the first virtual microphone of the virtual microphones 1504/1514 correspond to the first position, filter coefficient values are identical between the first physical microphone 1502*a* and the first virtual microphone. For ease of explanation and to avoid confusion, however, the disclosure may explicitly associate the first physical microphone 1502*a* with the first virtual microphone and/or first filter coefficient values corresponding to the first virtual microphone, despite the first filter coefficient values being identical to filter coefficient values associated with the first physical microphone 1502*a*. Similarly, as the second physical microphone 1502*b* and the second virtual microphone of the virtual microphones 1504/1514 correspond to the second position, filter coefficient values are identical between the second physical microphone 1502*b* and the second virtual microphone. For ease of explanation and to avoid confusion, however, the disclosure may explicitly associate the second physical microphone 1502*b* with the second virtual microphone and/or second filter coefficient values corresponding to the second virtual microphone, despite the second filter coefficient values being identical to filter coefficient values associated with the second physical microphone 1502*b*.

While FIG. 15 illustrates the device 110 only including two physical microphones 1502, the disclosure is not limited thereto and the device 110 may include any number of physical microphones without departing from the disclosure. For example, the device 110 may include there or more physical microphones and may either select two physical microphones to use for each direction of interest or may use all of the physical microphones for each direction of interest.

Figure 16:
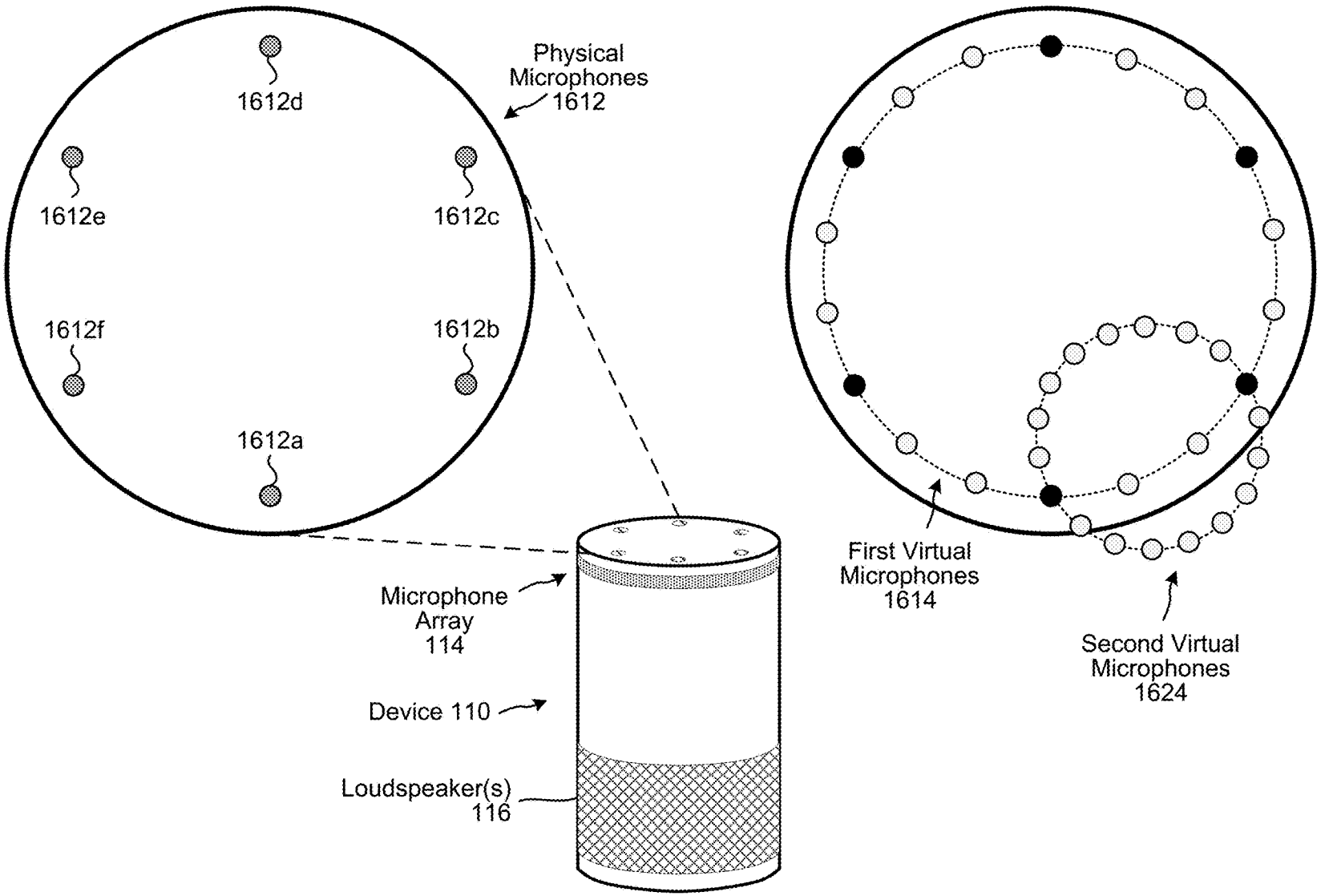
FIG. 16 illustrates an example of multiple virtual microphone configurations according to embodiments of the present disclosure.

FIG. 16 illustrates an example of multiple virtual microphone configurations according to embodiments of the present disclosure. In some examples, the device 110 may include three or more physical microphones and may select two physical microphones for a particular direction of interest. To improve performance, the device 110 may determine virtual microphones using multiple different configurations, such as a different configuration of virtual microphones based on the selected physical microphone pair.

As illustrated in FIG. 16, the device 110 may include a plurality of physical microphones 1612 and may determine filter coefficient values using first virtual microphones 1614 and/or second virtual microphones 1624. To illustrate an example, for a first direction of interest the device 110 may select a first pair of physical microphones (e.g., 1612*a* and 1612*d*) that have a first distance between them. When using the first pair of physical microphones 1612*a*/1612*d* to generate first beamformed audio data in the first direction of interest, the device 110 may use filter coefficient values determined from the first virtual microphones 1614, which correspond to a circle having a diameter equal to the first distance. However, for a second direction of interest the device 110 may select a second pair of physical microphones (e.g., 1612*a* and 1612*b*) that have a second distance between them. When using the second pair of physical microphones 1612*a*/1612*b* to generate second beamformed audio data in the second direction of interest, the device 110 may use filter coefficient values determined from the second virtual microphones 1624, which correspond to a circle having a diameter equal to the second distance.

While many of the virtual microphones 1614/1624 are located at a position without a physical microphone, and are thus illustrated in FIG. 16 using a white circle, some virtual microphones 1614/1624 may share a position with the physical microphones 1612 and are thus illustrated using a black circle. For example, the first physical microphone 1612*a* shares a first position on the device 110 with a first virtual microphone of the virtual microphones 1614/1624 and the second physical microphone 1612*b* shares a second position on the device 110 with a second virtual microphone of the virtual microphones 1614/1624.

As the first physical microphone 1612*a* and the first virtual microphone of the virtual microphones 1614/1624 correspond to the first position, filter coefficient values are identical between the first physical microphone 1612*a* and the first virtual microphone. For ease of explanation and to avoid confusion, however, the disclosure may explicitly associate the first physical microphone 1612*a* with the first virtual microphone and/or first filter coefficient values corresponding to the first virtual microphone, despite the first filter coefficient values being identical to filter coefficient values associated with the first physical microphone 1612*a*. Similarly, as the second physical microphone 1612*b* and the second virtual microphone of the virtual microphones 1614/1624 correspond to the second position, filter coefficient values are identical between the second physical microphone 1612*b* and the second virtual microphone. For ease of explanation and to avoid confusion, however, the disclosure may explicitly associate the second physical microphone 1612*b* with the second virtual microphone and/or second filter coefficient values corresponding to the second virtual microphone, despite the second filter coefficient values being identical to filter coefficient values associated with the second physical microphone 1612*b*.

While FIG. 16 illustrates the first virtual microphones 1614 and the second virtual microphones 1624 in a circular configuration, the disclosure is not limited thereto and the virtual microphones may be in any configuration as discussed above with regard to FIG. 15. Thus, the system 100 may determine filter coefficient values for each direction of interest using one or more configurations for the virtual microphones.

Figure 17A:
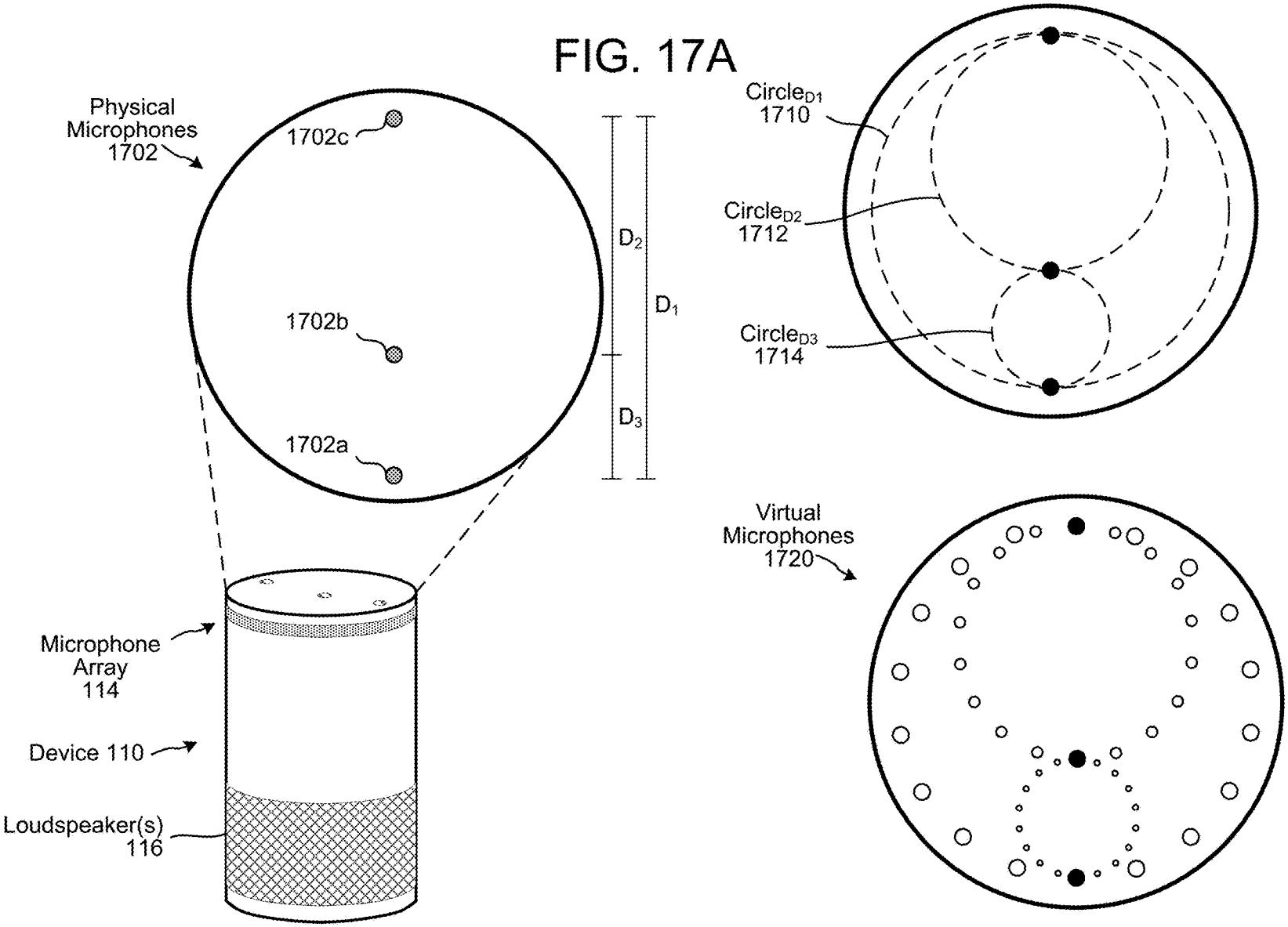
FIGS. 17A-17B illustrate examples of multiple virtual microphone configurations using three physical microphones according to embodiments of the present disclosure.
Figure 17B:
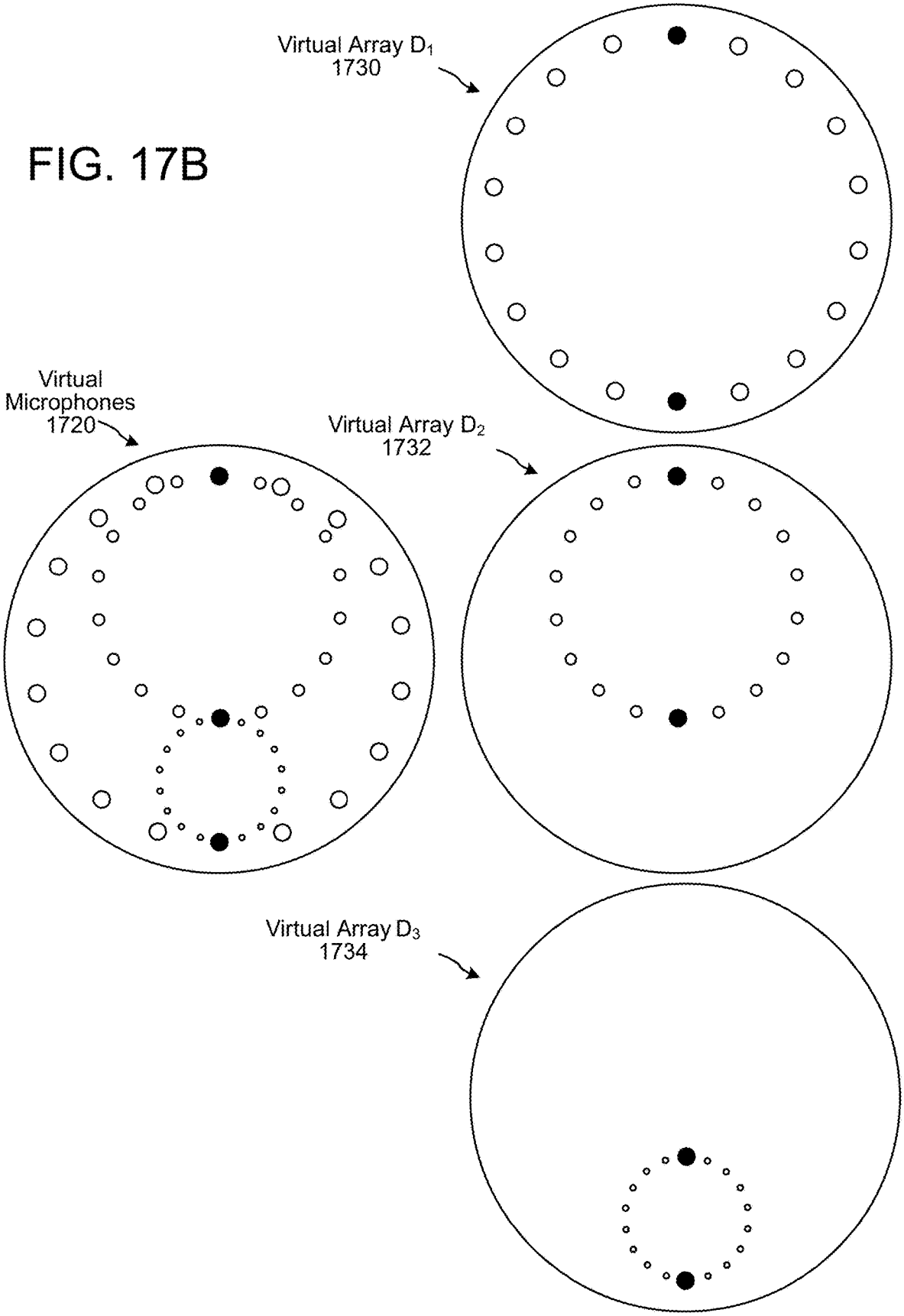

FIGS. 17A-17B illustrate examples of multiple virtual microphone configurations using three physical microphones according to embodiments of the present disclosure. While FIGS. 8A and 15 illustrate the device 110 including two physical microphones and FIGS. 8B and 16 illustrate the device 110 including six physical microphones, FIGS. 17A-17B illustrate an example in which the device 110 includes three physical microphones 1702. Thus, the device 110 may select a first pair of physical microphones (e.g., 1702*a* and 1702*c*) having a first distance $D_1$, a second pair of physical microphones (e.g., 1702*b* and 1702*c*) having a second distance $D_2$, and/or a third pair of physical microphones (e.g., 1702*a* and 1702*b*) having a third distance $D_3$. As discussed above with regard to FIG. 10, a distance between a pair of physical microphones may correspond to inferior beamforming results in a particular direction of interest. For example, the first pair of physical microphones may have poor results in a first direction of interest (e.g., 90 degrees), the second pair of physical microphones may have poor results in a second direction of interest (e.g., 120 degrees), and the third pair of physical microphones may have poor results in a third direction of interest (e.g., 150 degrees). By selecting different pairs of physical microphones depending on the direction of interest, the device 110 may improve beamformed audio data by avoiding these directions associated with poor results.

Additionally or alternatively, FIG. 17A illustrates that the device 110 may determine filter coefficient values based on three different configurations for virtual microphones 1720. For example, as the first pair of physical microphones 1702*a*/1702*c* have the first distance $D_1$, the device 110 may select virtual microphones along a first circle $Circle_{D1}$ 1710 having a first diameter equal to the first distance $D_1$. Similarly, as the second pair of physical microphones 1702*b*/1702*c* have the second distance $D_2$, the device 110 may select virtual microphones along a second circle $Circle_{D2}$ 1712 having a second diameter equal to the second distance $D_2$. Finally, as the third pair of physical microphones 1702*a*/1702*b* have the third distance $D_3$, the device 110 may select virtual microphones along a third circle $Circle_{D3}$ 1714 having a third diameter equal to the third distance $D_3$.

While many of the virtual microphones 1720 are located at a position without a physical microphone, and are thus illustrated in FIGS. 17A-17B using a white circle, some virtual microphones 1720 may share a position with the physical microphones 1702 and are thus illustrated using a black circle. For example, the first physical microphone 1702*a* shares a first position on the device 110 with a first virtual microphone of the virtual microphones 1720, the second physical microphone 1702*b* shares a second position on the device 110 with a second virtual microphone of the virtual microphones 1720, and the third physical microphone 1702*c* shares a third position on the device 110 with a third virtual microphone of the virtual microphones 1720.

As the first physical microphone 1702*a* and the first virtual microphone of the virtual microphones 1720 correspond to the first position, filter coefficient values are identical between the first physical microphone 1702*a* and the first virtual microphone. For ease of explanation and to avoid confusion, however, the disclosure may explicitly associate the first physical microphone 1702*a* with the first virtual microphone and/or first filter coefficient values corresponding to the first virtual microphone, despite the first filter coefficient values being identical to filter coefficient values associated with the first physical microphone 1702*a*.

Similarly, as the second physical microphone 1702*b* and the second virtual microphone of the virtual microphones 1720 correspond to the second position, filter coefficient values are identical between the second physical microphone 1702*b* and the second virtual microphone. For ease of explanation and to avoid confusion, however, the disclosure may explicitly associate the second physical microphone 1702*b* with the second virtual microphone and/or second filter coefficient values corresponding to the second virtual microphone, despite the second filter coefficient values being identical to filter coefficient values associated with the second physical microphone 1702*b*.

Finally, as the third physical microphone 1702*c* and the third virtual microphone of the virtual microphones 1720 correspond to the third position, filter coefficient values are identical between the third physical microphone 1702*c* and the third virtual microphone. For ease of explanation and to avoid confusion, however, the disclosure may explicitly associate the third physical microphone 1702*c* with the third virtual microphone and/or third filter coefficient values corresponding to the third virtual microphone, despite the third filter coefficient values being identical to filter coefficient values associated with the third physical microphone 1702*c*.

FIG. 17B illustrates the virtual microphones 1720 in more detail. As illustrated in FIG. 17B, the first pair of physical microphones 1702*a*/1702*c* are associated with a first virtual array $D_1$ 1730 corresponding to the first circle $Circle_{D1}$ 1710. Similarly, the second pair of physical microphones 1702*b*/1702*c* are associated with a second virtual array $D_2$ 1732 corresponding to the second circle $Circle_{D2}$ 1712. Finally, the third pair of physical microphones 1702*a*/1702*b* are associated with a third virtual array $D_3$ 1734 corresponding to the third circle $Circle_{D3}$ 1714.

By determining the filter coefficient values using different virtual microphone configurations for each pair of physical microphones, the device 110 may improve beamforming results. For example, the first virtual array $D_1$ 1730 may result in better filter coefficient values that are more accurate for each direction of interest when using the first pair of microphones, whereas the second virtual array $D_2$ 1732 may result in better filter coefficient values that are more accurate for each direction of interest when using the second pair of microphones. Thus, the system 100 may accurately correct for minor imperfections when calculating filter coefficient values for each of the physical microphones in each of the directions of interest (e.g., correcting for imperfections associated with determining filter coefficient values using MVDR techniques).

For ease of illustration, the virtual microphones 1720 are illustrated using different sizes in FIGS. 17A-17B. However, this is intended for illustrative purposes only (e.g., to precisely illustrate relative positions of the second virtual array $D_2$ 1732 and/or the third virtual array $D_3$ 1734) and each of the virtual microphones 1720 may be identical without departing from the disclosure. Thus, while illustrated as being larger, the virtual microphones of the first virtual array $D_1$ 1730 may be the same as the virtual microphones of the second virtual array $D_2$ 1732 and/or the third virtual array $D_3$ 1734.

FIGS. 18A-18D illustrate examples of lookup tables for filter coefficient values according to embodiments of the present disclosure. While the lookup tables are illustrated in the form of a table, the disclosure is not limited thereto. Instead, the information illustrated in FIGS. 18A-18D may be stored as a vector, a matrix, and/or simply data without departing from the disclosure.

As illustrated in FIG. 18A, the system 100 (e.g., the device 110 and/or a remote device) may store a first filter coefficient table 1810 corresponding to filter coefficient values for potential virtual microphones. For example, the first filter coefficient table 1810 may include an entry for each direction of interest associated with a potential position of a virtual microphone. Thus, a size of the first filter coefficient table 1810 may depend on a number of beam directions (e.g., 8 beam directions corresponds to 8 entries for each potential position, 16 beam directions corresponds to 16 entries for each potential position, etc.) and a number of potential positions (e.g., configuration of the virtual microphones on the device 110).

While not necessary, the first filter coefficient table 1810 may include potential positions corresponding to actual positions of the physical microphones of the device 110. For example, the optimal filter coefficient value for a particular physical microphone and direction of interest may correspond to the actual position of the physical microphone. Thus, the first filter coefficient table 1810 may include a column indicating whether a physical microphone is present (e.g., the potential position corresponds to a physical microphone).

To illustrate an example, if the first filter coefficient table 1810 includes 12 directions of interest using a configuration of 18 virtual microphones arranged in a circle as illustrated in FIG. 8B, the first filter coefficient table 1810 would include a total of 216 entries. However, the number of potential positions may vary depending on the configuration of the virtual microphones. If the first filter coefficient table 1810 instead includes 12 directions of interest using a configuration of 36 virtual microphones, the first filter coefficient table 1810 may include 432 entries. In this example, the 36 virtual microphones may be arranged as a group of 36 in a first configuration (e.g., 36 virtual microphones in a circle having a first diameter), or may be arranged as two groups of 18 in a second configuration (e.g., 18 virtual microphones in first circle having a first diameter and 18 virtual microphones in a second circle having a second diameter).

Similarly, the number of directions of interest may vary. If the first filter coefficient table 1810 includes 6 directions of interest using a configuration of 18 virtual microphones, the first filter coefficient table 1810 may include 108 entries. In some examples, the first filter coefficient table 1810 may include a maximum number of directions of interest (e.g., 36 directions of interest corresponding to 10 degree increments, although the disclosure is not limited thereto) and the system 100 may select a subset of the first filter coefficient table 1810 based on a desired number of directions of interest. For example, instead of using 36 directions of interest for each potential position (e.g., 0 degrees, 10 degrees, 20 degrees, etc.), the system 100 may select only 12 directions of interest by selecting every third entry (e.g., 0 degrees, 30 degrees, 60 degrees, etc.).

As illustrated in FIG. 18A, the first filter coefficient table 1810 may include n potential positions. For each potential position, the first filter coefficient table 1810 may include coordinates (e.g., two-dimensional (x, y) coordinates relative to a fixed point on a surface of the device 110, three-dimensional (x, y, z) coordinates relative to the device, etc.) associated with the potential positions and whether a physical microphone is present at the potential position. In addition, the first filter coefficient table 1810 may include a direction of interest (e.g., beam direction) and a corresponding filter coefficient value. For example, a first potential position has coordinates (0, 0), which corresponds to a physical microphone (e.g., "Physical microphone present?": Yes), and the first filter coefficient table 1810 illustrates four filter coefficient values corresponding to four directions of interest (e.g., $W_1$ corresponding to 0 degrees, $W_2$ corresponding to 90 degrees, $W_3$ corresponding to 180 degrees, $W_4$ corresponding to 270 degrees).

While the first filter coefficient table 1810 illustrates each of the filter coefficient values with a different variable (e.g., $W_1$-$W_n$), this is intended for illustrative purposes only and some of the filter coefficient values may end up being identical without departing from the disclosure. In addition, while the first filter coefficient table 1810 only illustrates four directions of interest for each potential position, this is intended for ease of illustration and the disclosure is not limited thereto.

The first filter coefficient table 1810 may be determined using techniques known to one of skill in the art based on the potential position, the number of look directions, a configuration of the device 110, and/or other information. For example, the system 100 may determine filter coefficient values for the first filter coefficient table 1810 using MVDR techniques. While the first filter coefficient table 1810 corresponds to raw filter coefficient values associated with the potential positions of the virtual microphones and/or physical microphones, FIGS. 18B-18D illustrate filter coefficient tables corresponding to the optimal filter coefficient values for each direction of interest.

As illustrated in FIG. 18B, a second filter coefficient table 1820 includes filter coefficient values for each direction of interest using a fixed pair of physical microphones (e.g., first physical microphone $PMic_1$ and second physical microphone $PMic_2$). For example, the device 110 may only include two physical microphones as in the example illustrated in FIG. 8A. Based on the fixed pair of physical microphones, the second filter coefficient table 1820 may include a pair of filter coefficient values for each beam direction. For example, the second filter coefficient table 1820 may include a first pair of filter coefficient values ($W_1$, $W_2$) for a first beam direction (e.g., 0 degrees), a second pair of filter coefficient values ($W_3$, $W_4$) for a second beam direction (e.g., 30 degrees), and so on.

An order of the pair of filter coefficient values corresponds to the fixed pair of physical microphones, such that for the first beam direction (e.g., 0 degrees), the device 110 may generate beamformed audio data by applying the first filter coefficient value $W_1$ to first audio data generated by the first physical microphone $PMic_1$ and applying the second filter coefficient value $W_2$ to second audio data generated by the second physical microphone $PMic_2$. Similarly, for the second beam direction (e.g., 30 degrees), the device 110 may generate beamformed audio data by applying the third filter coefficient value $W_3$ to the first audio data generated by the first physical microphone $PMic_1$ and applying the fourth filter coefficient value $W_4$ to the second audio data generated by the second physical microphone $PMic_2$.

The number of beam directions included in the second filter coefficient table 1820 depends on a number of directions of interest calculated by the system 100. In some examples, the second filter coefficient table 1820 may include a maximum number of directions of interest (e.g., 36 directions of interest corresponding to 10 degree increments, although the disclosure is not limited thereto) and the device 110 may select a subset of the second filter coefficient table 1820 based on a desired number of directions of interest at runtime. For example, instead of generating beamformed audio data using 36 directions of interest (e.g., 0 degrees, 10 degrees, 20 degrees, etc.), the device 110 may select only 12 directions of interest by selecting every third entry (e.g., 0 degrees, 30 degrees, 60 degrees, etc.).

While the second filter coefficient table 1820 illustrates each of the filter coefficient values ($W_a$, $W_b$) with a different variable (e.g., $W_1$-$W_{16}$), this is intended for illustrative purposes only and some of the filter coefficient values may end up being identical without departing from the disclosure. In addition, while the second filter coefficient table 1820 illustrates twelve directions of interest for each potential position, this is intended for ease of illustration and the disclosure is not limited thereto.

As illustrated in FIG. 18B, the second filter coefficient table 1820 may optionally include a virtual microphone corresponding to each filter coefficient value. For example, the second filter coefficient table 1820 may include the first pair of filter coefficient values ($W_1$, $W_2$) for the first beam direction (e.g., 0 degrees) and may explicitly associate the first beam direction with a first pair of virtual microphones ($VMic_1$, $VMic_2$) used to generate the first pair of filter coefficient values ($W_1$, $W_2$). However, the disclosure is not limited thereto and the second filter coefficient table 1820 may omit the virtual microphones without departing from the disclosure, as only the filter coefficient value is required to generate beamformed audio data. Additionally or alternatively, the second filter coefficient table 1820 may omit the filter coefficient values and the device 110 may determine the filter coefficient values based on the virtual microphones without departing from the disclosure. For example, the device 110 may identify a plurality of filter coefficient values associated with the first virtual microphone $VMic_1$ and may identify the first filter coefficient $W_1$ based on the beam direction (e.g., 0 degrees).

While FIG. 18B illustrates an example using a fixed pair of physical microphones, the disclosure is not limited thereto. Instead, the system 100 may select a pair of physical microphones for each direction of interest. As illustrated in FIG. 18C, a third filter coefficient table 1830 includes filter coefficient values for each direction of interest using a variable pairs of physical microphones (e.g., first physical microphone $PMic_1$, second physical microphone $PMic_2$, etc.). For example, the device 110 may include an array of six physical microphones, as in the example illustrated in FIG. 8B, and may select two of the six physical microphones (e.g., ($PMic_e$, $PMic_f$)) for each individual direction of interest. Based on the selected pair of physical microphones ($PMic_e$, $PMic_f$), the third filter coefficient table 1830 may include a pair of filter coefficient values for each beam direction. For example, the third filter coefficient table 1830 may include a first pair of filter coefficient values ($W_1$, $W_2$) for a first beam direction (e.g., 0 degrees), a second pair of filter coefficient values ($W_3$, $W_4$) for a second beam direction (e.g., 30 degrees), and so on.

An order of the pair of filter coefficient values corresponds to the selected pair of physical microphones, such that for the first beam direction (e.g., 0 degrees), the device 110 may generate beamformed audio data by applying the first filter coefficient value $W_1$ to first audio data generated by the first physical microphone $PMic_1$ and applying the second filter coefficient value $W_2$ to second audio data generated by the second physical microphone $PMic_2$. Similarly, for a third beam direction (e.g., 60 degrees), the device 110 may generate beamformed audio data by applying the fifth filter coefficient value $W_5$ to the first audio data generated by the first physical microphone $PMic_1$ and applying the sixth filter coefficient value $W_6$ to the third audio data generated by the third physical microphone $PMic_3$.

The number of beam directions included in the third filter coefficient table 1830 depends on a number of directions of interest calculated by the system 100. In some examples, the third filter coefficient table 1830 may include a maximum number of directions of interest (e.g., 36 directions of interest corresponding to 10 degree increments, although the disclosure is not limited thereto) and the device 110 may select a subset of the third filter coefficient table 1830 based on a desired number of directions of interest at runtime. For example, instead of generating beamformed audio data using 36 directions of interest (e.g., 0 degrees, 10 degrees, 20 degrees, etc.), the device 110 may select only 12 directions of interest by selecting every third entry (e.g., 0 degrees, 30 degrees, 60 degrees, etc.).

While the third filter coefficient table 1830 illustrates each of the filter coefficient values ($W_a$, $W_b$) with a different variable (e.g., $W_1$-$W_{16}$), this is intended for illustrative purposes only and some of the filter coefficient values may end up being identical without departing from the disclosure. In addition, while the third filter coefficient table 1830 illustrates twelve directions of interest for each potential position, this is intended for ease of illustration and the disclosure is not limited thereto.

As illustrated in FIG. 18C, the third filter coefficient table 1830 may optionally include a virtual microphone corresponding to each filter coefficient value. For example, the third filter coefficient table 1830 may include the first pair of filter coefficient values ($W_1$, $W_2$) for the first beam direction (e.g., 0 degrees) and may explicitly associate the first beam direction with a first pair of virtual microphones ($VMic_1$, $VMic_2$) used to generate the first pair of filter coefficient values ($W_1$, $W_2$). However, the disclosure is not limited thereto and the third filter coefficient table 1830 may omit the virtual microphones without departing from the disclosure, as only the filter coefficient value is required to generate beamformed audio data. Additionally or alternatively, the third filter coefficient table 1830 may omit the filter coefficient values and the device 110 may determine the filter coefficient values based on the virtual microphones without departing from the disclosure. For example, the device 110 may identify a plurality of filter coefficient values associated with the first virtual microphone $VMic_1$ and may identify the first filter coefficient $W_1$ based on the beam direction (e.g., 0 degrees).

The device 110 may generate beamformed audio data in a subband domain without departing from the disclosure. For example, the device 110 may separate different frequency ranges (e.g., subbands) and may generate the beamformed audio data differently for each frequency range without departing from the disclosure. Thus, the system 100 may store different filter coefficient values and perform beamforming based on different frequency ranges (e.g., subbands). For example, the system 100 may generate a first pair of filter coefficient values for a first beam direction and a first frequency range (e.g., 0 kHz-3 kHz) and may generate a second pair of filter coefficient values for the first beam direction and a second frequency range (e.g., 3 kHz-8 kHz). As illustrated in FIG. 18D, a fourth filter coefficient table 1840 includes filter coefficient values for each direction of interest, pair of physical microphones (e.g., first physical microphone $PMic_1$ and second physical microphone $PMic_2$), and individual frequency range (e.g., 0 kHz-3 kHz, 3 kHz-8 kHz, 8 kHz-20 kHz, etc.). For example, the fourth filter coefficient table 1840 may include a first pair of filter coefficient values ($W_1$, $W_2$) for a first beam direction (e.g., 0 degrees) and a first frequency range (e.g., 0 kHz-3 kHz), a second pair of filter coefficient values ($W_3$, $W_4$) for the first beam direction and a second frequency range (e.g., 3 kHz-8 kHz), and so on.

Many of the examples of performing beamforming refer to performing beamforming in the frequency domain. Thus, the system 100 may determine the filter coefficient values $g(\omega)$ in the frequency domain. For example, the device 110 may receive first input audio data in the time domain and may perform Fast Fourier Transform (FFT) processing on the first input audio data to generate second input audio data in the frequency domain. The device 110 may then apply the filter coefficient values $g(\omega)$ in the frequency domain to the second input audio data to generate the beamformed audio data. After processing the beamformed audio data, the device 110 may perform Inverse Fast Fourier Transform (IFFT) processing to generate output audio data in the time domain. The device 110 may operate in the subband domain similarly to the description above about operating in the frequency domain, except the FFT/IFFT processing would be applied to each of the individual frequency ranges separately.

However, the disclosure is not limited thereto and the system 100 may perform beamforming in the time domain without departing from the disclosure. Thus, the system 100 may determine the filter coefficient values $g(t)$ in the time domain. For example, the device 110 may apply the filter coefficient values $g(t)$ in the time domain to the first input audio data to generate the beamformed audio data. Additionally or alternatively, the system 100 may determine first filter coefficient values $g(t)$ in the time domain and/or second filter coefficient values $g(\omega)$ in the frequency domain without departing from the disclosure.

Figure 19:
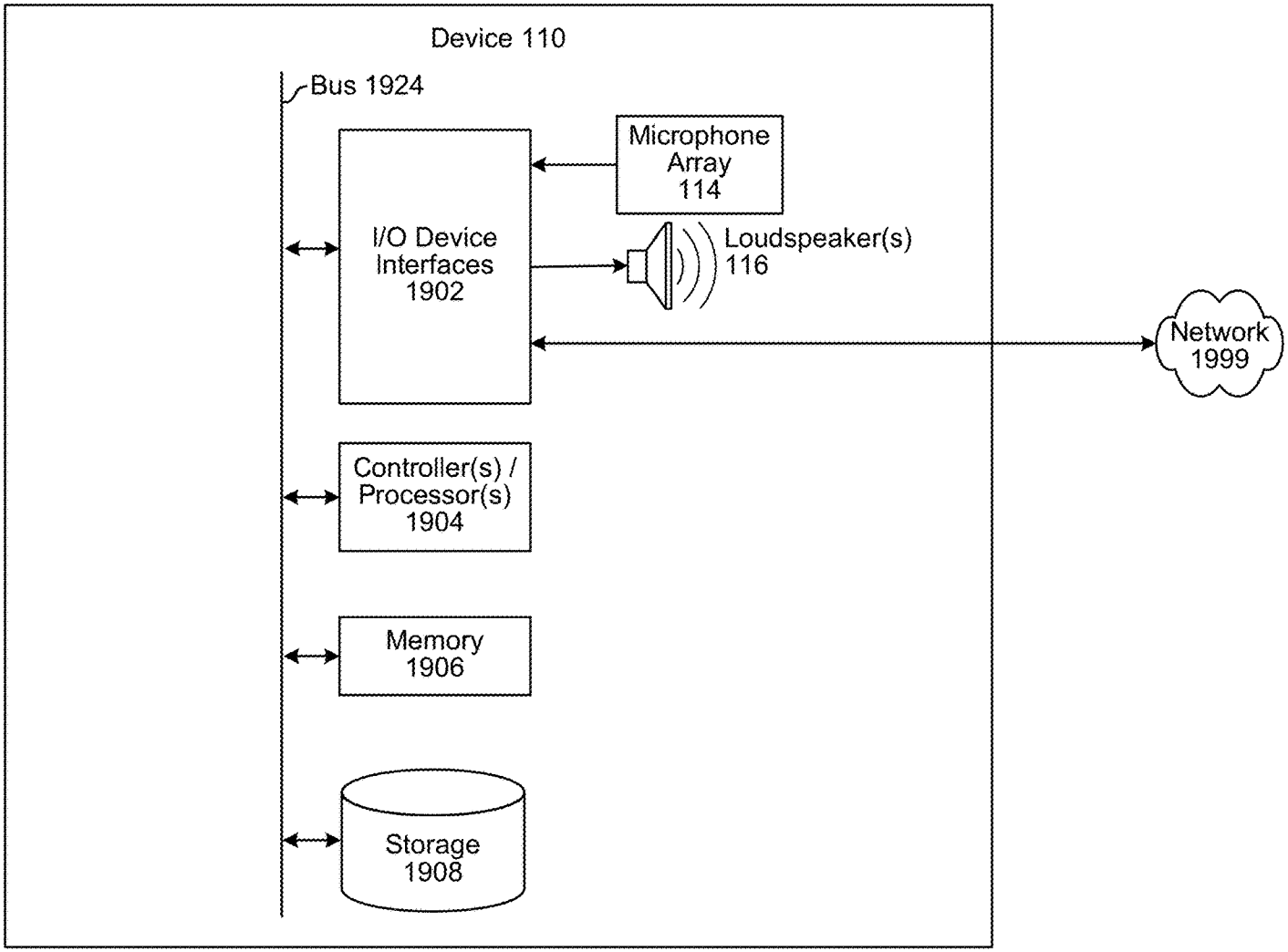
FIG. 19 is a block diagram conceptually illustrating example components of a device according to embodiments of the present disclosure.

FIG. 19 is a block diagram conceptually illustrating example components of the device 110. In operation, the device 110 may include computer-readable and computer-executable instructions that reside on the device, as will be discussed further below.

The device 110 may include one or more audio capture device(s), such as a microphone array 114 which may include a plurality of microphones 202/802/812. The audio capture device(s) may be integrated into a single device or may be separate.

The device 110 may also include an audio output device for producing sound, such as loudspeaker(s) 116. The audio output device may be integrated into a single device or may be separate.

The device 110 may include an address/data bus 1924 for conveying data among components of the device 110. Each component within the device may also be directly connected to other components in addition to (or instead of) being connected to other components across the bus 1924.

The device 110 may include one or more controllers/processors 1904, which may each include a central processing unit (CPU) for processing data and computer-readable instructions, and a memory 1906 for storing data and instructions. The memory 1906 may include volatile random access memory (RAM), non-volatile read only memory (ROM), non-volatile magnetoresistive (MRAM) and/or other types of memory. The device 110 may also include a data storage component 1908, for storing data and controller/processor-executable instructions (e.g., instructions to perform operations discussed herein). The data storage component 1908 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1902.

Computer instructions for operating the device 110 and its various components may be executed by the controller(s)/processor(s) 1904, using the memory 1906 as temporary "working" storage at runtime. The computer instructions may be stored in a non-transitory manner in non-volatile memory 1906, storage 1908, or an external device. Alternatively, some or all of the executable instructions may be embedded in hardware or firmware in addition to or instead of software.

The device 110 may include input/output device interfaces 1902. A variety of components may be connected through the input/output device interfaces 1902, such as the microphone array 114, the loudspeaker(s) 116, and a media source such as a digital media player (not illustrated). The input/output interfaces 1902 may include A/D converters (not illustrated) and/or D/A converters (not illustrated).

The input/output device interfaces 1902 may also include an interface for an external peripheral device connection such as universal serial bus (USB), FireWire, Thunderbolt or other connection protocol. The input/output device interfaces 1902 may also include a connection to one or more networks 1999 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1999, the device 110 may be distributed across a networked environment.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system. For example, certain components such as an FBF unit 440 (including filter and sum component 430) and adaptive noise canceller (ANC) unit 460 may be arranged as illustrated or may be arranged in a different manner, or removed entirely and/or joined with other non-illustrated components.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the adaptive noise canceller (ANC) unit 460, adaptive beamformer (ABF) unit 490, etc. may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving, from a first physical microphone, first audio data corresponding to a first period of time, the first physical microphone having a first position on a device;

selecting a first direction relative to the device;

determining, using a lookup table, that a first virtual microphone is associated with the first physical microphone and the first direction, the first virtual microphone corresponding to a first plurality of filter coefficient values;

selecting a first filter coefficient value, from the first plurality of filter coefficient values, that corresponds to the first direction, wherein the first filter coefficient value is based on a second position relative to the device that is different from the first position;

receiving, from a second physical microphone, second audio data corresponding to the first period of time, the second physical microphone having a third position on the device;

determining, using the lookup table, that a second virtual microphone is associated with the second physical microphone and the first direction, the second virtual microphone corresponding to a second plurality of filter coefficient values;

selecting a second filter coefficient value, from the second plurality of filter coefficient values, that corresponds to the first direction, wherein the second filter coefficient value is based on a fourth position relative to the device that is different from the third position; and generating third audio data corresponding to the first direction, wherein generating the third audio data comprises:

generating a first portion of the third audio data by applying the first filter coefficient value to the first audio data, and generating a second portion of the third audio data by applying the second filter coefficient value to the second audio data.

2. The computer-implemented method of claim 1, further comprising:

selecting a second direction relative to the device;

generating fourth audio data corresponding to the second direction;

determining that the third audio data includes a first representation of speech;

determining that the fourth audio data includes a first representation of acoustic noise generated by at least one noise source; and generating fifth audio data by subtracting at least a portion of the fourth audio data from the third audio data, wherein the fifth audio data represents the speech without the acoustic noise.

3. The computer-implemented method of claim 1, further comprising:

receiving fourth audio data associated with a third microphone;

determining that a second direction is associated with the first physical microphone and the third microphone;

determining a third filter coefficient value associated with the first physical microphone and corresponding to the second direction, wherein the third filter coefficient value corresponds to a fifth position that is different from the first position;

determining a fourth filter coefficient value associated with the third microphone and corresponding to the second direction, wherein the fourth filter coefficient value corresponds to a sixth position that is different from a seventh position of the third microphone;

generating a first portion of fifth audio data based on the first audio data and the third filter coefficient value, the fifth audio data corresponding to the second direction; and generating a second portion of the fifth audio data based on the fourth audio data and the fourth filter coefficient value.

4. The computer-implemented method of claim 1, further comprising:

selecting the first filter coefficient value, from the first plurality of filter coefficient values, that corresponds to the first direction and a first frequency range;

selecting the second filter coefficient value, from the second plurality of filter coefficient values, that corresponds to the first direction and the first frequency range;

determining, using the lookup table, that a third virtual microphone is associated with the first physical microphone and the first direction for a second frequency range, the third virtual microphone corresponding to a third plurality of filter coefficient values;

selecting, from the third plurality of filter coefficient values, a third filter coefficient value that corresponds to the first physical microphone, the first direction and the second frequency range;

determining, using the lookup table, that a fourth virtual microphone is associated with the second physical microphone and the first direction for the second frequency range, the fourth virtual microphone corresponding to a fourth plurality of filter coefficient values;

selecting, from the fourth plurality of filter coefficient values, a fourth filter coefficient value that corresponds to the second physical microphone, the first direction and the second frequency range;

generating a third portion of the third audio data by applying the third filter coefficient value to the first audio data, the third portion of the third audio data corresponding to the second frequency range; and generating a fourth portion of the third audio data by applying the fourth filter coefficient value to the second audio data, the fourth portion of the third audio data corresponding to the second frequency range.

5. A computer-implemented method, the method comprising:

receiving first audio data originating from a first physical microphone of a device, the first audio data corresponding to a first period of time, the first physical microphone having a first position relative to the device;

determining a first filter coefficient value for the first physical microphone that corresponds to a first direction, wherein the first filter coefficient value is previously calculated based on a second position relative to the device that is different from the first position;

receiving second audio data originating from a second physical microphone of the device, the second audio data corresponding to the first period of time, the second physical microphone having a third position relative to the device;

determining a second filter coefficient value for the second physical microphone that corresponds to the first direction, wherein the second filter coefficient value is previously calculated based on a fourth position relative to the device that is different from the third position;

generating a first portion of third audio data by applying the first filter coefficient value to the first audio data, the first portion of the third audio data corresponding to the first direction; and generating a second portion of the third audio data by applying the second filter coefficient value to the second audio data, the second portion of the third audio data corresponding to the first direction.

6. The computer-implemented method of claim 5, further comprising:

determining a third filter coefficient value associated with the first physical microphone and corresponding to a second direction;

determining a fourth filter coefficient value associated with the second physical microphone and corresponding to the second direction;

generating a first portion of fourth audio data based on the first audio data and the third filter coefficient value, the fourth audio data corresponding to the second direction;

generating a second portion of the fourth audio data based on the second audio data and the fourth filter coefficient value; and generating fifth audio data by subtracting at least a portion of the fourth audio data from the third audio data.

7. The computer-implemented method of claim 5, further comprising:

determining that a first virtual microphone is associated with the first physical microphone and the first direction;

determining a first plurality of filter coefficient values associated with the first virtual microphone, wherein the first plurality of filter coefficient values includes the first filter coefficient value;

determining that a second virtual microphone is associated with the second physical microphone and the first direction; and determining a second plurality of filter coefficient values associated with the second virtual microphone, wherein the second plurality of filter coefficient values includes the second filter coefficient value.

8. The computer-implemented method of claim 5, further comprising:

determining a third filter coefficient value associated with the first physical microphone and corresponding to a second direction, wherein the third filter coefficient value is previously calculated based on a fifth position relative to the device that is different from the first position;

determining a fourth filter coefficient value associated with the second physical microphone and corresponding to the second direction, wherein the fourth filter coefficient value is previously calculated based on a sixth position relative to the device that is different from the third position;

generating a first portion of fourth audio data based on the first audio data and the third filter coefficient value, the fourth audio data corresponding to the second direction; and generating a second portion of the fourth audio data based on the second audio data and the fourth filter coefficient value.

9. The computer-implemented method of claim 5, further comprising:

receiving fourth audio data associated with a third physical microphone having a fifth position relative to the device;

determining that a second direction is associated with the first physical microphone and the third physical microphone;

determining a third filter coefficient value associated with the first physical microphone and corresponding to the second direction, wherein the third filter coefficient value corresponds to a sixth position relative to the device that is different from the first position;

determining a fourth filter coefficient value associated with the third physical microphone and corresponding to the second direction, wherein the fourth filter coefficient value corresponds a seventh position relative to the device that is different from the fifth position;

generating a first portion of fifth audio data based on the first audio data and the third filter coefficient value, the fifth audio data corresponding to the second direction; and generating a second portion of the fifth audio data based on the fourth audio data and the fourth filter coefficient value.

10. The computer-implemented method of claim 5, further comprising:

determining the first filter coefficient value associated with the first physical microphone, wherein the first filter coefficient value corresponds to the first direction and a first frequency range and is calculated based on the second position;

determining the second filter coefficient value associated with the second physical microphone, wherein the second filter coefficient value corresponds to the first direction and the first frequency range and is calculated based on the fourth position;

determining a third filter coefficient value associated with the first physical microphone, wherein the third filter coefficient value corresponds to the first direction and a second frequency range and is calculated based on a fifth position relative to the device;

determining a fourth filter coefficient value associated with the second physical microphone, wherein the fourth filter coefficient value corresponds to the first direction and the second frequency range and is calculated based on a sixth position relative to the device;

generating a third portion of the third audio data based on the first audio data and the third filter coefficient value, the third portion of the third audio data corresponding to the first direction and the second frequency range; and generating a fourth portion of the third audio data based on the second audio data and the fourth filter coefficient value, the fourth portion of the third audio data corresponding to the first direction and the second frequency range.

11. The computer-implemented method of claim 5, wherein:

a plurality of virtual microphones are arranged in a circle on a surface of the device;

the first filter coefficient value is previously determined based on a first virtual microphone of the plurality of virtual microphones;

the first virtual microphone is at the second position, the second position being on the circle;

the second filter coefficient value is previously determined based on a second virtual microphone of the plurality of virtual microphones; and the second virtual microphone is at the fourth position, the fourth position being on the circle and opposite the second position.

12. The computer-implemented method of claim 5, wherein:

a first plurality of virtual microphones are associated with a first combination of the first physical microphone and the second physical microphone;

a second plurality of virtual microphones are associated with a second combination of the first physical microphone and a third physical microphone having a fifth position relative to the device;

the first filter coefficient value is previously determined based on a first virtual microphone of the first plurality of virtual microphones; and the second filter coefficient value is previously determined based on a second virtual microphone of the second plurality of virtual microphones.

13. A system comprising:

at least one processor; and memory including instructions operable to be executed by the at least one processor to cause the system to:

receive first audio data originating from a first physical microphone of a device, the first audio data corresponding to a first period of time, the first physical microphone having a first position relative to the device;

determine a first filter coefficient value for the first physical microphone that corresponds to a first direction, wherein the first filter coefficient value is previously calculated based on a second position relative to the device that is different from the first position;

receive second audio data originating from a second physical microphone of the device, the second audio data corresponding to the first period of time, the second physical microphone having a third position relative to the device;

determine a second filter coefficient value for the second physical microphone that corresponds to the first direction, wherein the second filter coefficient value is previously calculated based on a fourth position relative to the device that is different from the third position;

generate a first portion of third audio data by applying the first filter coefficient value to the first audio data, the first portion of the third audio data corresponding to the first direction; and generate a second portion of the third audio data by applying the second filter coefficient value to the second audio data, the second portion of the third audio data corresponding to the first direction.

14. The system of claim 13, wherein the memory further comprises instructions that, when executed by the at least one processor, further cause the system to:

determine a third filter coefficient value associated with the first physical microphone and corresponding to a second direction;

determine a fourth filter coefficient value associated with the second physical microphone and corresponding to the second direction;

generate a first portion of fourth audio data based on the first audio data and the third filter coefficient value, the fourth audio data corresponding to the second direction;

generate a second portion of the fourth audio data based on the second audio data and the fourth filter coefficient value; and generate fifth audio data by subtracting at least a portion of the fourth audio data from the third audio data.

15. The system of claim 13, wherein the memory further comprises instructions that, when executed by the at least one processor, further cause the system to:

determine that a first virtual microphone is associated with the first physical microphone and the first direction;

determine a first plurality of filter coefficient values associated with the first virtual microphone, wherein the first plurality of filter coefficient values includes the first filter coefficient value;

determine that a second virtual microphone is associated with the second physical microphone and the first direction; and determine a second plurality of filter coefficient values associated with the second virtual microphone, wherein the second plurality of filter coefficient values includes the second filter coefficient value.

16. The system of claim 13, wherein the memory further comprises instructions that, when executed by the at least one processor, further cause the system to:

determine a third filter coefficient value associated with the first physical microphone and corresponding to a second direction, wherein the third filter coefficient value is previously calculated based on a fifth position relative to the device that is different from the first position;

determine a fourth filter coefficient value associated with the second physical microphone and corresponding to the second direction, wherein the fourth filter coefficient value is previously calculated based on a sixth position relative to the device that is different from the third position;

generate a first portion of fourth audio data based on the first audio data and the third filter coefficient value, the fourth audio data corresponding to the second direction; and generate a second portion of the fourth audio data based on the second audio data and the fourth filter coefficient value.

17. The system of claim 13, wherein the memory further comprises instructions that, when executed by the at least one processor, further cause the system to:

receive fourth audio data associated with a third physical microphone having a fifth position relative to the device;

determine that a second direction is associated with the first physical microphone and the third physical microphone;

determine a third filter coefficient value associated with the first physical microphone and corresponding to the second direction, wherein the third filter coefficient value corresponds to a sixth position relative to the device that is different from the first position;

determine a fourth filter coefficient value associated with the third physical microphone and corresponding to the second direction, wherein the fourth filter coefficient value corresponds a seventh position relative to the device that is different from the fifth position;

generate a first portion of fifth audio data based on the first audio data and the third filter coefficient value, the fifth audio data corresponding to the second direction; and generate a second portion of the fifth audio data based on the fourth audio data and the fourth filter coefficient value.

18. The system of claim 13, wherein the memory further comprises instructions that, when executed by the at least one processor, further cause the system to:

determine the first filter coefficient value associated with the first physical microphone, wherein the first filter coefficient value corresponds to the first direction and a first frequency range and is calculated based on the second position;

determine the second filter coefficient value associated with the second physical microphone, wherein the second filter coefficient value corresponds to the first direction and the first frequency range and is calculated based on the fourth position;

determine a third filter coefficient value associated with the first physical microphone, wherein the third filter coefficient value corresponds to the first direction and a second frequency range and is calculated based on a fifth position relative to the device;

determine a fourth filter coefficient value associated with the second physical microphone, wherein the fourth filter coefficient value corresponds to the first direction and the second frequency range and is calculated based on a sixth position relative to the device;

generate a third portion of the third audio data based on the first audio data and the third filter coefficient value, the third portion of the third audio data corresponding to the first direction and the second frequency range; and generate a fourth portion of the third audio data based on the second audio data and the fourth filter coefficient value, the fourth portion of the third audio data corresponding to the first direction and the second frequency range.

19. The system of claim 13, wherein:

a plurality of virtual microphones are arranged in a circle on a surface of the device;

the first filter coefficient value is previously determined based on a first virtual microphone of the plurality of virtual microphones;

the first virtual microphone is at the second position, the second position being on the circle;

the second filter coefficient value is previously determined based on a second virtual microphone of the plurality of virtual microphones; and the second virtual microphone is at the fourth position, the fourth position being on the circle and opposite the second position.

20. The system of claim 13, wherein:

a first plurality of virtual microphones are associated with a first combination of the first physical microphone and the second physical microphone;

a second plurality of virtual microphones are associated with a second combination of the first physical microphone and a third physical microphone having a fifth position relative to the device;

the first filter coefficient value is previously determined based on a first virtual microphone of the first plurality of virtual microphones; and the second filter coefficient value is previously determined based on a second virtual microphone of the second plurality of virtual microphones.

* * * * *